US005957989A

United States Patent [19]

Egawa et al.

[11] Patent Number: 5,957,989

[45] **Date of Patent: *Sep. 28, 1999**

[54] INTERFERENCE PREVENTING SYSTEM FOR CONSTRUCTION MACHINE

[75] Inventors: Eiji Egawa, Tsuchiura; Hiroshi Watanabe, Ushiku; Hiroyuki Adachi, Tsuchiura; Junichi Hosono, Ibaraki; Toshiaki Nishida, Ibaraki; Mitsuo Kihara, Ibaraki; Masakazu Haga, Ibaraki, all of Japan

[73] Assignee: Hitachi Construction Machinery Co. Ltd., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/760,572

[22] Filed: Dec. 4, 1996

[30] Foreign Application Priority Data

| | | | |
|---|---|---|---|
| Jan. 22, 1996 | [JP] | Japan | 8-008686 |
| Mar. 21, 1996 | [JP] | Japan | 8-064687 |
| Mar. 21, 1996 | [JP] | Japan | 8-064688 |
| Mar. 21, 1996 | [JP] | Japan | 8-064689 |

[51] Int. Cl.[6] ..... E02F 9/24; E02F 9/22; E02F 3/43

[52] U.S. Cl. ..... 701/50; 37/348

[58] Field of Search ..... 701/50; 395/90; 37/348

[56] References Cited

U.S. PATENT DOCUMENTS

| | | | |
|---|---|---|---|
| 5,136,928 | 8/1992 | Hachisu | 91/392 |
| 5,490,081 | 2/1996 | Kuromoto et al. | 364/474.2 |
| 5,704,141 | 1/1998 | Miura et al. | 37/348 |
| 5,784,944 | 7/1998 | Tozawa et al. | 91/361 |

FOREIGN PATENT DOCUMENTS

| | | |
|---|---|---|
| 0 711 876 | 5/1996 | European Pat. Off. . |
| 2-256722 | 10/1990 | Japan . |
| 3-208923 | 9/1991 | Japan . |
| 3-217523 | 9/1991 | Japan . |
| 6-146331 | 5/1994 | Japan . |
| 6-248667 | 9/1994 | Japan . |
| 6-294150 | 10/1994 | Japan . |
| 6-313323 | 11/1994 | Japan . |
| 6-104985 | 12/1994 | Japan . |
| 7-158123 | 6/1995 | Japan . |
| 7-197492 | 8/1995 | Japan . |
| 8-4046 | 1/1996 | Japan . |
| 2 222 997 | 3/1990 | United Kingdom . |
| 2 272 204 | 5/1994 | United Kingdom . |

*Primary Examiner*—Michael Zanelli
*Attorney, Agent, or Firm*—Fay, Sharpe, Beall, Fagan, Minnich & McKee

[57] ABSTRACT

A calculating portion 7*a* calculates a distance from the tip end of a front device to an interference prevention area, and a detection line 7*m* detects a moving speed of a boom 1. If the tip end of the front device comes close to the interference prevention area when the boom 1 is moving upward, control is made such that, while continuing to move the boom 1 upward, a control gain calculating portion 7*h* and a multiplier 7*i* cooperatively calculate a target speed of an arm in the arm dumping direction (interference avoiding direction) corresponding to the boom-up speed, and an input limit value calculating portion 7*c*, an adder 7*j* and a minimum value selecting portion 7*f* cooperatively control the arm to move in the interference avoiding direction relative to a vehicle body. Interference avoidance control enabling the tip end of the front device to be moved smoothly along the vicinity of a boundary of the interference prevention area is thereby effected and the front device can be prevented from interfering with the vehicle body without reducing the maneuverability and the working efficiency.

31 Claims, 33 Drawing Sheets

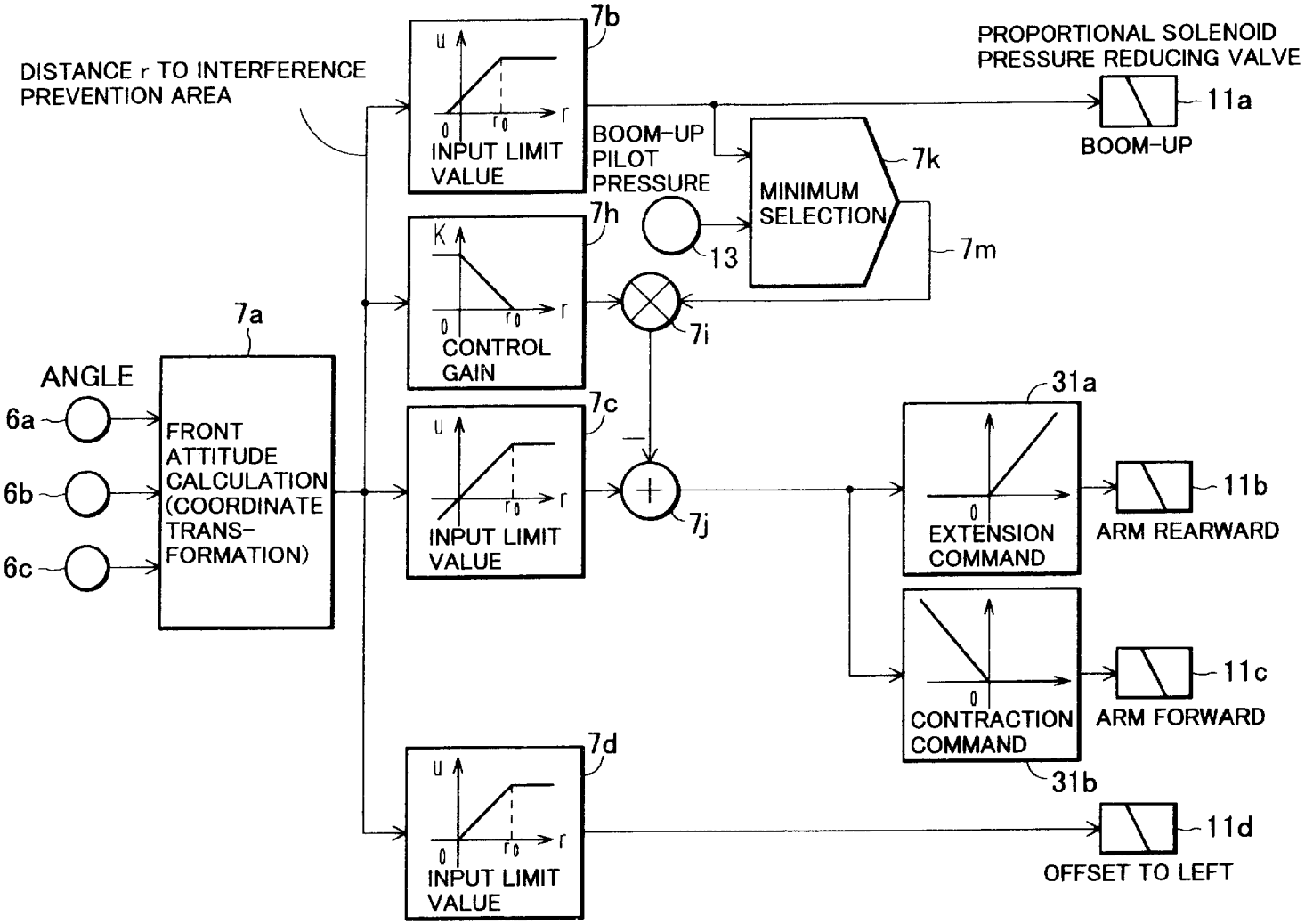
FIG.8
PROPORTIONAL SOLENOID PRESSURE REDUCING VALVE
11a
BOOM-UP
11b
ARM REARWARD
11c
ARM FORWARD
11d
OFFSET TO LEFT
31a
EXTENSION COMMAND
31b
CONTRACTION COMMAND
7m
7k
MINIMUM SELECTION
13
BOOM-UP PILOT PRESSURE
7i
7j
7b
INPUT LIMIT VALUE
7h
CONTROL GAIN
7c
INPUT LIMIT VALUE
7d
INPUT LIMIT VALUE
DISTANCE r TO INTERFERENCE PREVENTION AREA
7a
FRONT ATTITUDE CALCULATION (COORDINATE TRANS-FORMATION)
ANGLE
6a
6b
6c

INTERFERENCE PREVENTING SYSTEM FOR CONSTRUCTION MACHINE

BACKGROUND OF THE INVENTION

1. Field of the Invention

The present invention relates to an interference preventing system for a construction machine having a multi-articulated front device, and more particularly to an interference preventing system for a hydraulic excavator having a front device including an arm, a boom, a bucket, an offset, etc., which prevents the front device from interfering with a vehicle body, in particular, a cab.

2. Description of the Related Art

A hydraulic excavator is operated by an operator manipulating front members such as a boom and so on with respective manual control levers. In a front device including an offset to provide a wide range of excavation, however, there is a risk that the front device may interfere with a vehicle body, in particular, a cab depending on its attitude.

Therefore, interference preventing system for preventing such an interference are described in JP-A-3-217523 and JP-B 6-104985.

According to the proposal of JP-A-3-217523, an interference between the front device and the cab can be prevented by stopping the operation of the front device when the tip end of the front device moves closer to the cab than respective planes set around the cab on the front side, the upper side and the lateral side.

According to the proposal of JP-B-6-104985, an interference between the front device and the cab can be prevented by, when the tip end of the front device moves closer to the cab than respective planes set around the cab on the front side, the upper side and the lateral side, automatically operating a boom cylinder, a bucket cylinder and a lateral shift cylinder (offset cylinder) so that the tip end of the front device goes to outside the set planes.

SUMMARY OF THE INVENTION

However, the foregoing prior art system have the problems as follows.

With the prior art system described in JP-A-3-217523, since all actuators are stopped inside the planes set for prevention of the interference, the excavating operation cannot be continuously performed near the cab and hence the working efficiency (word load) is remarkably reduced.

With the prior art system described in JP-B-6-104985, when the tip end of the front device enters inside the set planes, the boom cylinder, the bucket cylinder and the lateral shift cylinder (offset cylinder) are all changed into automatic operation. Accordingly, after changed into automatic operation, the cylinders are moved without reflecting the command contents of respective operation signals so far input for moving the cylinders (i.e., the intention of the operator), and cannot be operated as intended by the operator near the cab. This results in the problems that the motion of the front device is not smooth, the maneuverability of the front device is lowered, and the work efficiency (work load) is remarkably reduced as with the foregoing prior art system.

Further, when the tip end of the front device enters inside the set planes, the automatic operation is effected so as to merely move the tip end of the front device outside the set planes. Therefore, after the tip end of the front device is once moved outside the set planes, it is caused to enter inside the set planes again in accordance with the operation signals. After that, the tip end of the front device is moved outside the set planes once again under the automatic operation. With such motions repeated, the front device becomes jerk in its operation and hence the maneuverability is much deteriorated.

An object of the present invention is to provide an interference preventing system for a construction machine which can prevent a front device from interfering with a vehicle body without deteriorating the maneuverability and the working efficiency.

(1) To achieve the above object, the present invention provides an interference preventing system for a construction machine comprising a vehicle body, a front device mounted on the vehicle body and made up of a plurality of front members including first and second front members pivotable in the vertical direction, a plurality of hydraulic actuators for driving the plurality of front members, a plurality of operating means for instructing operations of the plurality of front members, and a plurality of flow control valves for controlling flow rates of a hydraulic fluid supplied to the associated hydraulic actuators in accordance with respective operation signals input from the plurality of operating means, the interference preventing system regulating motion of the front device when the front device come close to the vehicle body, wherein the interference preventing system comprises (a) first detecting means for detecting status variables in relation to a position and attitude of the front device, (b) calculating means for calculating the position and attitude of the front device based on detected values of the first detecting means, (c) second detecting means for detecting the operation of the first front member in accordance with the operation signal from the operating means, and (d) first control means for controlling, based on a calculated value of the calculating means and a detected value of the second detecting means, the second front member to move in the interference avoiding direction relative to the vehicle body while continuing to operate the first front member in accordance with the operation signal, when a predetermined portion of the front device comes close to the vehicle body while the first front member is being moved in accordance with the operation signal.

In the present invention constituted as set forth above, if the predetermined portion of the front device comes close to the vehicle body when the first front member is being moved in accordance with the operation signal, the second front member is moved in the interference avoiding direction relative to the vehicle body while continuing to operate the first front member in accordance with the operation signal. The predetermined portion of the front device is thus moved by a resultant of the continued motion of the first front member and the motion of the second front member in the interference avoiding direction. Therefore, the front device can be moved continuously while it is prevented from interfering with the vehicle body (hereinafter referred to as interference avoidance control).

Also, since the second front member is moved in the interference avoiding direction relative to the vehicle body while continuing to operate the first front member, the front device can be operated as intended by an operator in accordance with the operation signal.

Further, since the first front member is continued to operate in accordance with the operation signal, the interference avoidance control can be achieved in which the front device will not become jerk in its operation and the predetermined portion of the front device is smoothly moved around the vehicle body.

(2) In the above (1), preferably, the first control means controls the second front member to move in the forward direction relative to the vehicle body as said interference avoiding direction relative to the vehicle body.

When a construction machine is an offset type hydraulic excavator including an offset front member, an interference between a front device and a vehicle body can also be prevented by laterally moving the offset front member. In such a case of laterally moving the offset front member, however, the tip end position of the front device is also laterally changed. More specifically, for example, in loading work where an upper structure is swung while the tip end of the front device is moved upward, followed by discharging earth and sand in a bucket onto a dump truck, it is required that after discharging earth and sand onto the dump truck and returning the front device to the original position by swing operation, the offset front member must be further operated to set the tip end of the front device to the original lateral position again. Therefore, the time required for one cycle of work is prolonged and the working efficiency is remarkably reduced.

By moving the second front member in the forward direction that is the interference avoiding direction relative to the vehicle body, the front device can be prevented from interfering with the vehicle body without the tip end of the front device being laterally moved. Therefore, the tip end of the front device is not changed in its lateral position and the time required for one cycle of work can be shortened. As a result, it is possible to avoid an interference of the front device with the vehicle body and to carry out work with good efficiency.

(3) In the above (1), preferably, the first control means calculates, based on a detected value of the second detecting means, a target speed of the second front member in the interference avoiding direction corresponding to an operating speed of the first front member, and controls the second front member to move at the calculated target speed.

With such an arrangement, when the second front member is moved in the interference avoiding direction relative to the vehicle body while continuing to operate the first front member in accordance with the operation signal as mentioned above, the motion of the second front member for interference avoidance is made at a speed corresponding to the operating speed of the first front member, and a speed balance is ensured between the first and second front members. For example, when the motion of the first front member is slow, the motion of the second front member in the interference avoiding direction is also slow, and when the motion of the first front member is fast, the motion of the second front member in the interference avoiding direction is also fast. Therefore, the interference avoidance control can be achieved in which the motion of the front device is smoother. In addition, even if the operating speed of the first front member is changed, the distance at which the tip end of the front device comes close to the vehicle body is not largely changed and hence a wide work area can be ensured.

(4) In the above (3), preferably, the first control means calculates a higher target speed of the second front member in the interference avoiding direction as the operating speed of the first front member increases.

(5) Also in the above (3), preferably, the first control means calculates a higher target speed of the second front member in the interference avoiding direction as the predetermined portion of the front device comes closer to the vehicle body.

With such an arrangement, the second front member can be smoothly moved in the interference avoiding direction at a speed corresponding to the distance between the predetermined portion of the front device and the vehicle body.

(6) In the above (5), preferably, the first control means calculates a larger control gain as the predetermined portion of the front device comes closer to the vehicle body, and multiplies the detected value of the second detecting means by the calculated control gain, thereby producing the target speed of the second front member in the interference avoiding direction.

(7) Alternatively, in the above (3), the first control means may calculate, based on the calculated value of the calculating means and the detected value of the second detecting means, a component of the speed at the predetermined portion of the front device in the direction toward the vehicle body when the first front member is being moved in accordance with the operation signal, calculate a larger control gain as the predetermined portion of the front device comes closer to the vehicle body, and multiply the calculated speed component by the calculated control gain, thereby producing the target speed of the second front member in the interference avoiding direction.

When the predetermined portion of the front device approaches the vehicle body, a component of the operating speed of the first front member which is related to an interference of the front device with the vehicle body is a component directing toward the vehicle-body. Therefore, by multiplying such a speed component by the calculated control gain to thereby produce the target speed of the second front member in the interference avoiding direction, the speed of the second front member in the interference avoiding direction is made more precisely corresponding to the operating speed of the first front member, resulting in the smoother interference avoidance control.

(8) In the above (1), preferably, the second detecting means is means for detecting the operation signal applied to the flow control valve associated with the first front member.

By detecting the operation of the first front member from the operation signal applied to the flow control valve associated with the first front member, the second front member can be moved in the interference avoiding direction with a better response than in the case of detecting the actual motion of the first front member.

(9) In the above (1), preferably, the calculating means includes means for calculating, based on the detected values of the first detecting means, a distance from the predetermined portion of the front device to an area preset around the vehicle body, and the first control means starts the control at the time the calculated distance becomes not larger than a preset distance.

With such an arrangement, when the predetermined portion of the front device comes close to the vehicle body and the distance to the preset area becomes not larger than the control start distance, the control is effected to move the second front member in the interference avoiding direction while continuing to move the first front member in accordance with the operation signal, as set forth in the above (1). As a result, the interference avoidance control can be achieved in which the predetermined portion of the front device is moved in the vicinity of a boundary of the preset area.

(10) In the above (1), preferably, the calculating means includes means for calculating, based on the detected values of the first detecting means, a distance from the predetermined portion of the front device to an area preset around the vehicle body, and the first control means modifies the operation signal from the operating means for the first front member such that when the calculated distance is not larger than a preset first control start distance, the first front member is further slowed down as the calculated distance reduces, and then starts the control at the time the calculated distance becomes not larger than a second control start distance that is equal to or smaller than the first control start distance.

With such an arrangement, when the predetermined portion of the front device comes close to the vehicle body and the distance to the preset area becomes not larger than the first control start distance, the first front member is slowed down, when the distance to the preset area becomes not larger than the second control start distance, the second front member is moved in the interference avoiding direction while the first front member is slowed down. Even with the hydraulic pump limited in its maximum delivery rate, therefore, since a flow rate of the hydraulic fluid consumed by the hydraulic actuator for the first front member during the process of the interference avoidance control is reduced, the hydraulic actuator for the second front member is supplied with the hydraulic fluid at a necessary and sufficient flow rate, enabling the second front member to be quickly moved in the interference avoiding direction. As a result of the quick motion of the second front member and the slowing-down of the first front member, an amount by which the predetermined portion of the front device enters the preset area is suppressed and the predetermined portion of the front device can be smoothly moved in the vicinity of the boundary of the preset area. As a result, smooth control can be achieved with the preset area set as the interference prevention area. In addition, a smaller amount by which the predetermined portion of the front device enters the preset area makes it possible to set a narrower interference prevention area and ensure an even wider work area.

(11) In the above (1), preferably, the calculating means includes means for calculating, based on the detected values of the first detecting means, a distance from the predetermined portion of the front device to an area preset around the vehicle body, and the first control means includes (d1) means for calculating a first limit value of the operation signal from the operating means for the first front member such that when the calculated distance is larger than a preset control start distance, the first limit value is kept at a maximum value, when the calculated distance is not larger than the control start distance, the first limit value is reduced as the calculated distance reduces, and when the calculated distance is less than a certain negative value, the first limit value becomes nil (0), (d2) means for modifying the operation signal from the operating means for the first front member so that the operation signal will not exceed the first limit value, (d3) means for calculating a second limit value of the operation signal from the operating means for the second front member such that when the calculated distance is larger than the control start distance, the second limit value is kept at a maximum value, when the calculated distance is not larger than the control start distance, the second limit value is reduced as the calculated distance reduces and then becomes nil (0) at the calculated distance being nil (0), and when the calculated distance is negative, the second limit value is further reduced and takes a negative value depending on the value of the calculated distance, (d4) means for calculating a control gain in relation to the detected value of the second detecting means such that when the calculated distance is larger than the control start distance, the control gain is kept at nil (0), when the calculated distance is not larger than the control start distance, the control gain is increased as the calculated distance reduces, and when the calculated distance is nil (0) or less, the control gain takes a maximum value, (d5) means for multiplying the detected value of the second detecting means by the control gain to produce a target speed for moving the second front member in the interference avoiding direction, and (d6) means for subtracting the target speed in the interference avoiding direction from the second limit value and modifying the operation signal from the operating means for the second front member such that the operation signal will not exceed a resulted difference value.

(12) In the above (1), preferably, the interference preventing system further comprises (e) setting means for setting, in the ambient around the construction machine, an operable area in which the front device is allowed to move, and second control means for controlling, in accordance with the calculated value of the calculating means, the first front member to stop when the front-device reaches a boundary of the operable area.

With such an arrangement, under the interference avoidance control effected by the first control means as set forth in the above (1), if the front device is moved toward the preset operable area, the first front member is stopped and the second front member is also stopped upon the stop of the first front member when the front device reaches the boundary of the operable area. Therefore, even if there is an obstacle around the construction machine, the front device can be safely moved without hitting against the obstacle and, at the same time, the interference avoidance control can also be achieved.

(13) In the above (12), preferably, the second control means modifies the operation signal from the operating means for the first front member such that the first front member is slowed down as the front device comes closer to the boundary of the operable area.

This arrangement enables the front device to be smoothly stopped at the boundary of the operable area.

(14) In the above (13), preferably, the calculating means includes means for calculating, based on the detected values of the first detecting means, a first distance from the predetermined portion of the front device to an area preset around the vehicle body, and means for calculating, based on the detected values of the first detecting means, a second distance from the predetermined portion of the front device to a boundary of the area preset by the setting means, the first control means calculates a first limit value that is reduced as the first distance reduces, the second control means calculates a second limit value that is reduced as the second distance reduces and is nil (0) when the second distance becomes, nil (0), the second control means modifies the operation signal from the operating means for the first front member such that the operation signal will not exceed the second limit value, and the first control means modifies the operation signal from the operating means for the first front member such that the operation signal will not exceed both the first and second limit values.

(15) In the above (1), preferably, the calculating means includes means for calculating, based on the detected values of the first detecting means, a distance from the predetermined portion of the front device to an area preset around the vehicle body, the first control means starts the control at the time the calculated distance becomes not larger than a preset distance, and the interference preventing system further comprises (g) third detecting means for detecting a factor affecting operating characteristics of the front device under control of the first control means, and (h) distance modifying means for modifying, based on a detected value of the third detecting means, the calculated distance such that the front device will not enter the preset area even when the operating characteristics of the front device is changed depending on the factor.

In hydraulic construction machinery such as a hydraulic excavator, operating characteristics of a front device are changed upon change in a factor such as a fluid temperature. If a fluid temperature is changed to a low value, for example, the second front member becomes hard to move in the interference avoiding direction during the process of the interference avoidance control set forth in the above (1), and the predetermined portion of the front device is more likely to enter the interference prevention area.

By detecting the factor affecting the operating characteristics of the front device and modifying the calculated distance as stated above, if the factor such as a fluid temperature is changed, the control start distance is modified depending on change in the factor and, as a result, the predetermined portion of the front device is less likely to enter the interference prevention area.

(16) In the above (15), preferably, the distance modifying means includes means for determining a modification value of the control start distance based on the detected value of the third detecting means, and means for subtracting the modification value from the calculated distance.

(17) Also in the above (15), for example, the factor is a fluid temperature of the hydraulic fluid, and the distance modifying means modifies the calculated distance such that the control start distance is increased as the fluid temperature lowers.

(18) Further in the above (15), for example, the factor is a revolution speed of a prime mover for driving the hydraulic pump, and the distance modifying means modifies the calculated distance such that the control start distance is increased as the revolution speed rises.

(19) Still further in the above (15), for example, the factor is a load pressure of the hydraulic actuator for the first front member, and the distance modifying means modifies the calculated distance such that the control start distance is increased as the load pressure rises.

(20) In the above (1), preferably, the interference preventing system further comprises (i) fourth detecting means for detecting a factor affecting operating characteristics of the front device under control of the first control means, and (j) gain modifying means for modifying, based on a detected value of the fourth detecting means, a control gain of the first control means such that the operating characteristics of the front device will not change to a large extent regardless of change in the factor.

In hydraulic construction machinery such as a hydraulic excavator, if a factor such as a boom angle is changed, operating characteristics of a front device are changed. This may results during the process of the interference avoidance control set forth in the above (1) in that a speed balance between the first and second front members or a response of each of them is shifted from a maximum condition and a hunting occurs.

By detecting the factor affecting the operating characteristics of the front device and modifying the control gain of the first control means as stated above, if the factor such as a boom angle is changed, the speed balance between the first and second front members or the response of each of them is modified correspondingly and the occurrence of a hunting is prevented.

(21) In the above (20), for example, the factor is a rotational angle of the first front member, and the gain modifying means modifies the control gain such that the control gain is increased as the rotational angle of the first front member increases.

(22) Also in the above (20), for example, the factor is a load pressure of the hydraulic actuator for the first front member, and the gain modifying means modifies the control gain such that the control gain is reduced as the load pressure rises.

(23) Further in the above (20), for example, the factor is a fluid temperature of the hydraulic fluid, and the gain modifying means modifies the control gain such that the control gain is reduced as the fluid temperature lowers.

(24) Still further in the above (20), for example, the factor is a revolution speed of a prime mover for driving the hydraulic pump, and the gain modifying means modifies the control gain such that the control gain is reduced as the revolution speed rises.

(25) In the above (20), preferably, the calculating means includes means for calculating, based on the detected values of the first detecting means, a distance from the predetermined portion of the front device to an area preset around the vehicle body, and the first control means includes (d1) means for calculating the control gain as a value that is kept at nil (0) when the calculated distance is larger than a preset control start distance, is gradually increased as the calculated distance reduces when the calculated distance is not larger than the control start distance, and is kept at a maximum value when the calculated distance is nil (0) or less, and (d2) means for multiplying the detected value of the second detecting means by the control gain to produce a target speed for moving the second front member in the interference avoiding direction, the gain modifying means modifying a change rate of the control gain with respect to the calculated distance.

(26) In the above (25), preferably, the gain modifying means modifies the change rate of the control gain with respect to the calculated distance by changing a maximum value of the control gain depending on the factor.

(27) Also in the above (25), the gain modifying means may modify the change rate of the control gain with respect to the calculated distance by changing an increase start distance for the control gain depending on the factor.

(28) In the above (1), preferably, the plurality of operating means are of electric lever type outputting electric signals as the operation signals, and the first control means calculates a command signal based on the operation signal from the operating means for the first front member, outputs the command signal to the flow control valve associated with the first front member, calculates a target speed of the second front member in the interference avoiding direction, calculates a command signal based on the target speed of the second front member in the interference avoiding direction and the operation signal from the operating means for the second front member, and outputs the command signal to the flow control valve associated with the second front member.

(29) In the above (1), preferably, the plurality of operating means are of hydraulic pilot type outputting pilot pressures as the operation signals, and the first control means includes means for calculating a target speed of the second front member in the interference avoiding direction, a proportional solenoid pressure reducing valve for outputting a pilot pressure corresponding to the target speed of the second front member in the interference avoiding direction, and a shuttle valve disposed in a line for introducing the pilot pressure from the operating means for the second front member to the flow control valve associated with the second front member and selecting higher one of the pilot pressure output from the proportional solenoid pressure reducing valve and the pilot pressure from the operating means for the second front member.

(30) In the above (1), preferably, the first front member is a front member requiring the predetermined portion of the front device to be continuously moved around the vehicle body during work where the predetermined portion of the front device may possibly interfere with the vehicle body, and the second front member is a front member not requiring the predetermined portion of the front device to be continuously moved around the vehicle body during the work.

(31) In the above (1), preferably, the construction machine is an offset type hydraulic excavator including a boom, an offset and an arm as the plurality of front members, the first front member is the boom, the second front member is the arm, the operation of the first front member detected by the second detecting means is operation of moving the boom upward, and the operation of the second front member provided by the first control means in the interference avoidance direction is operation of moving the arm in the dumping direction.

BRIEF DESCRIPTION OF THE DRAWINGS

FIG. 8 is a functional block diagram showing control functions of a control unit.

DETAILED DESCRIPTION OF THE PREFERRED EMBODIMENTS

First Embodiment

A first embodiment of the present invention will be described with reference to FIGS. 1 to 6.

Figure 1:
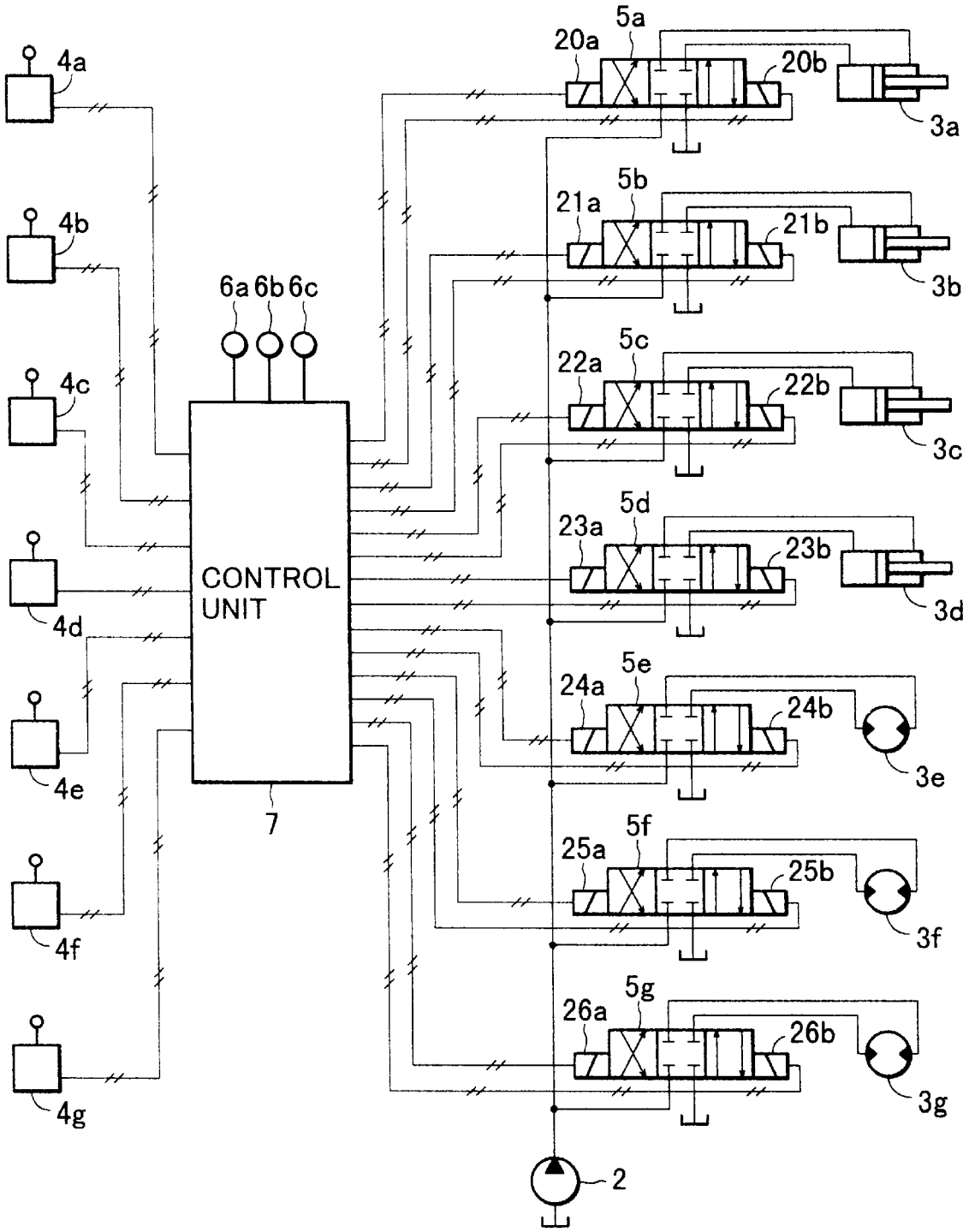
FIG. 1 is a diagram showing an interference preventing system for a hydraulic excavator according to a first embodiment of the present invention, along with a hydraulic circuit thereof.

In FIG. 1, a hydraulic excavator to which the present invention is applied has a hydraulic pump 2, a plurality of hydraulic actuators including a boom cylinder 3*a*, an arm cylinder 3*b*, a bucket cylinder 3*c*, an offset cylinder 3*d*, a swing motor 3*e*, and left and right track motors 3*f*, 3*g* which are driven by a hydraulic fluid supplied from the hydraulic pump 2, control lever units 4*a*–4*g* provided respectively corresponding to the hydraulic actuators 3*a*–3*g*, and a plurality of flow control valves 5*a*–5*g* connected between the hydraulic pump 2 and the plurality of hydraulic actuators 3*a*–3*g* and controlled by operation signals input from the control lever units 4*a*–4*g* for controlling flow rates of the hydraulic fluid supplied to the hydraulic actuators 3*a*–3*g*, respectively.

Figure 2:
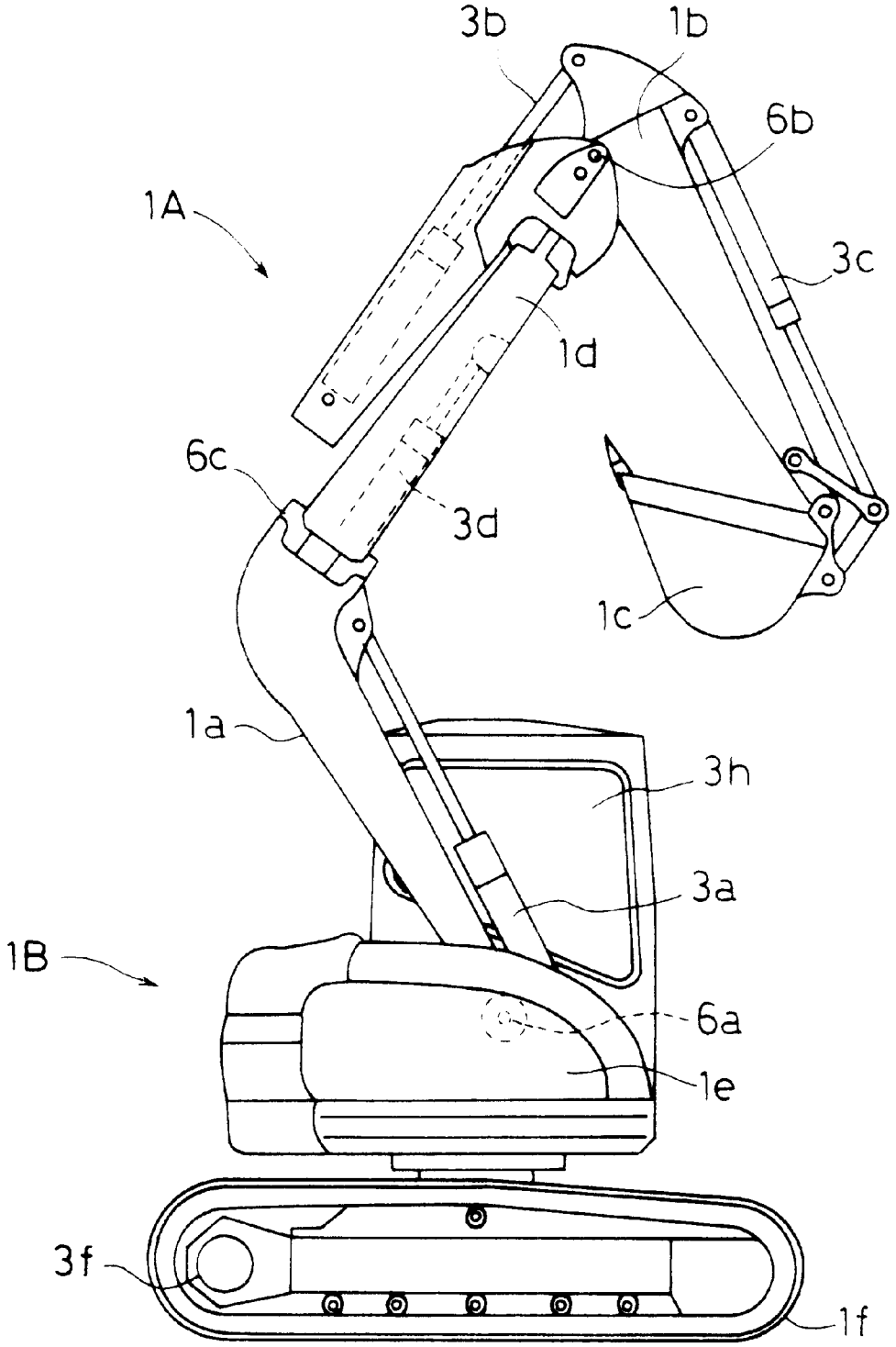
FIG. 2 is a side view showing an appearance of a hydraulic excavator to which the present invention is applied.
Figure 3:
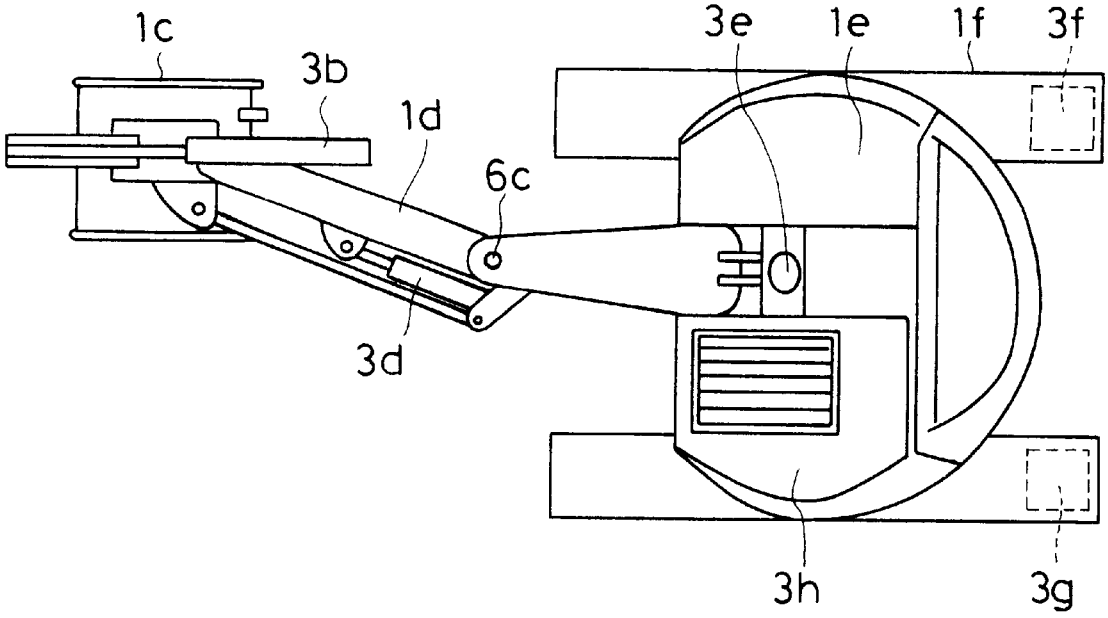
FIG. 3 is a top plan view showing an appearance of the hydraulic excavator to which the present invention is applied.

Also, the hydraulic excavator comprises, as shown in FIGS. 2 and 3, a multi-articulated front device 1A made up of a boom 1*a*, an arm 1*b*, a bucket 1*c* and an offset 1*d* which are each pivotable in a vertical plane, and a vehicle body 1B consisted of an upper structure 1*e* and an undercarriage 1*f*. The boom 1*a* of the front device 1A is supported at its based end by a front portion of the upper structure 1*e*. The boom 1*a*, the arm 1*b*, the bucket 1*c*, the offset 1*d*, the upper structure 1*e* and the undercarriage 1*f* are driven by the boom cylinder 3*a*, the arm cylinder 3*b*, the bucket cylinder 3*c*, the offset cylinder 3*d*, the swing motor 3*e*, and the left and right track motors 3*f*, 3*g* in response to instructions from the control levers units 4*a*–4*g*, respectively.

The vehicle body 1B is mounted on the upper structure 1*e* and has a cab 3*h* including a seat on which an operator sits to operate the excavator.

Returning to FIG. 1, the control levers units 4*a*–4*g* are each an electric lever for driving corresponding one of the flow control valves 5*a*–5*g* in accordance with an input amount by which the lever is operated. Thus, the control levers units 4*a*–4*g* supply voltages depending on respective input amounts and directions by and in which levers are manipulated by the operator, to solenoid driving sectors 20*a*–26*b* of the associated flow control valves.

An interference preventing system according to this embodiment is equipped on the hydraulic excavator constructed as explained above. The interference preventing system comprises angle sensors 6*a*, 6*b*, 6*c* disposed at respective pivoting points of the boom 1*a*, the arm 1*b* and the offset 1*d* for detecting respective rotational angles thereof as status variables relating to the position and attitude of the front device 1A, and a control unit 7 for receiving signals from the angle sensors 6*a*, 6*b*, 6*c* and the control levers units 4*a*–4*g* and outputting electric signals to carry out interference avoidance control.

Figure 4:
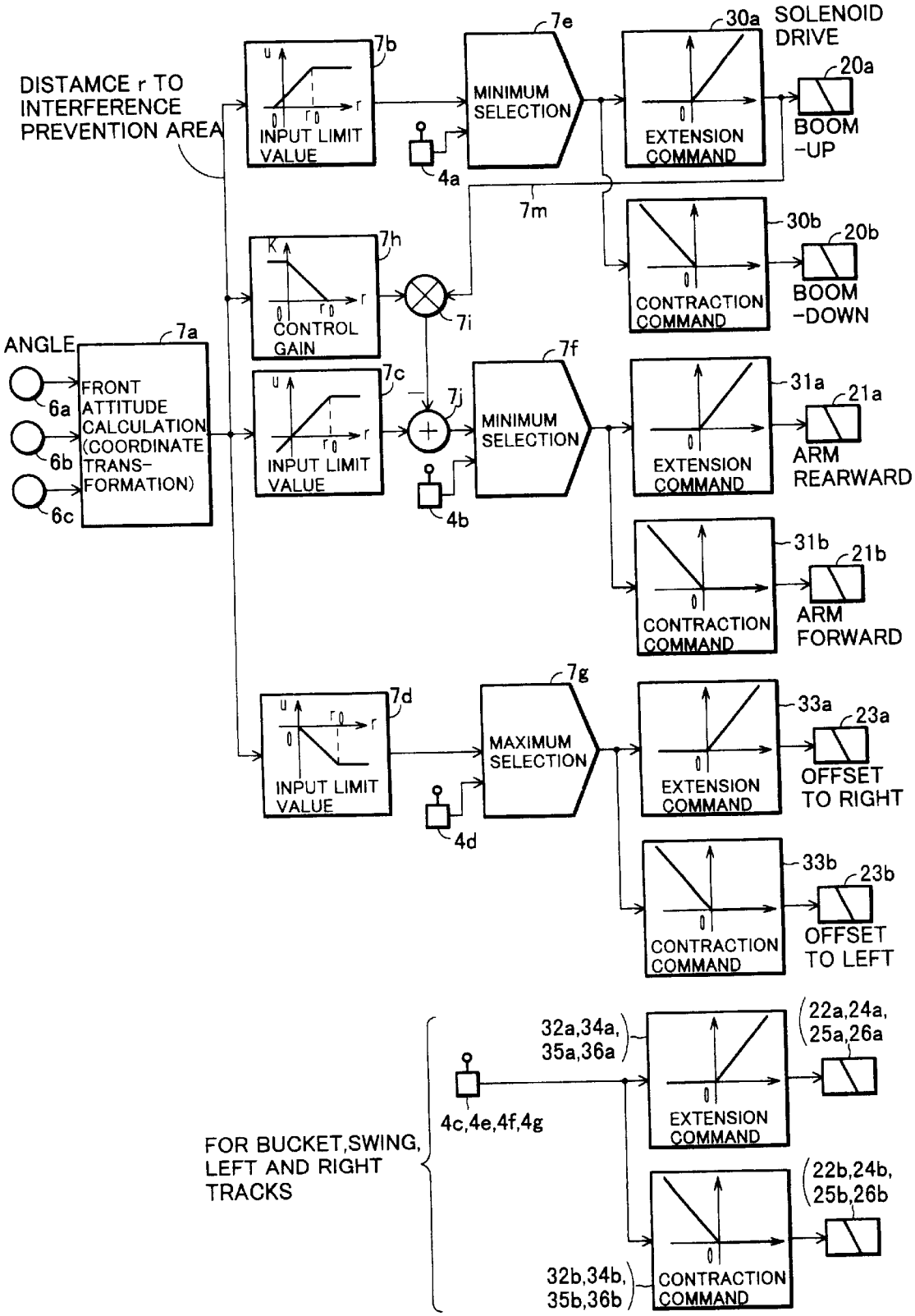
FIG. 4 is a functional block diagram showing control functions of a control unit.

Control functions of the control unit 7 are shown in FIG. 4. The control unit 7 has functions executed by a front attitude calculating portion 7*a*, input limit value calculating portions 7*b*–7*d*, maximum/minimum value selecting portions 7*e*–7*g* for input limitation, a control gain calculating portion 7*h*, a multiplier 7*i*, an adder 7*j*, a detection line 7*m*, and portions 30*a*–36*b* for calculating command values applied to the flow control valves on the extension and contractions sides of the respective actuators.

Figure 5:
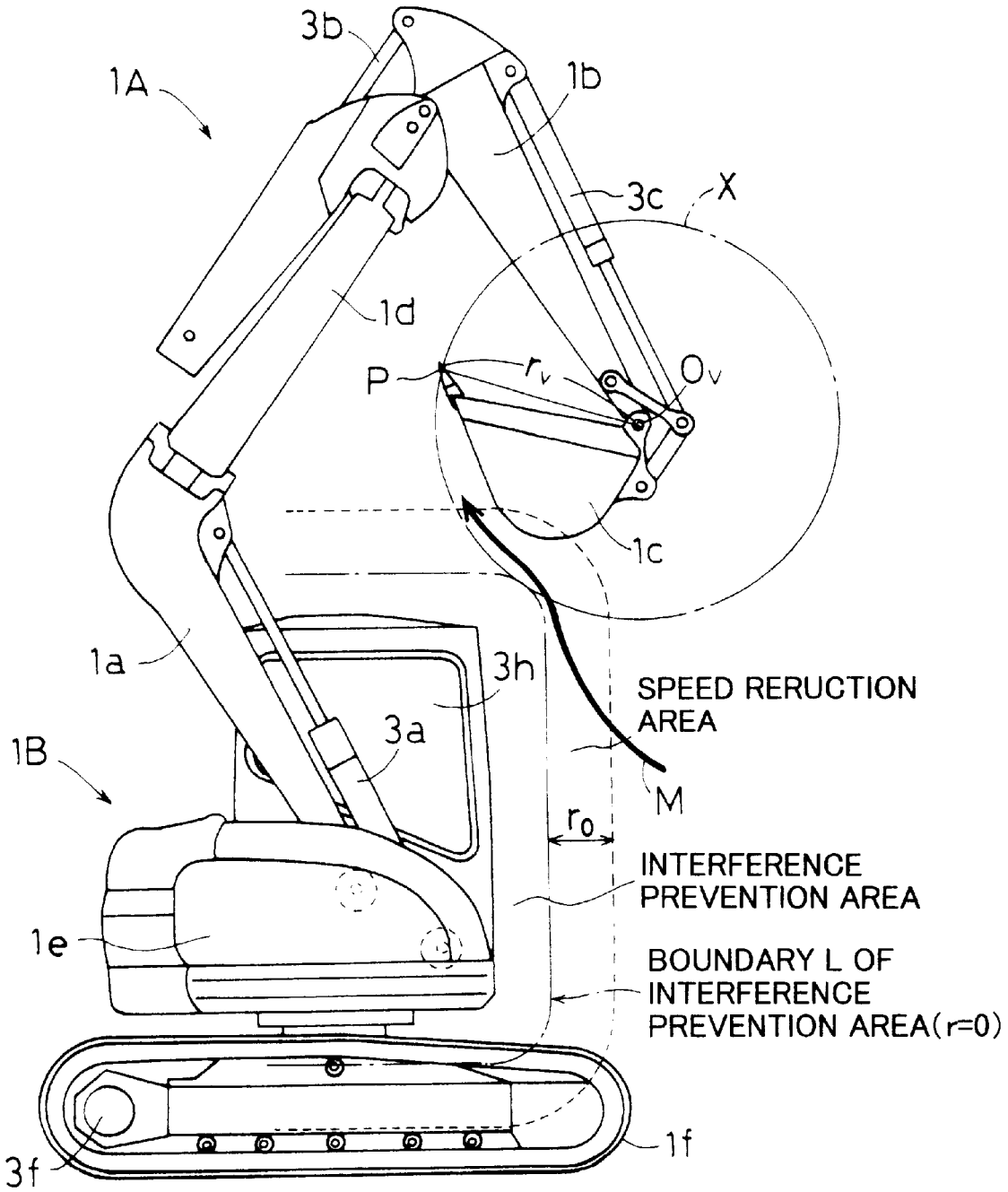
FIG. 5 is a view showing areas used in interference avoidance control according to this embodiment.
Figure 6:
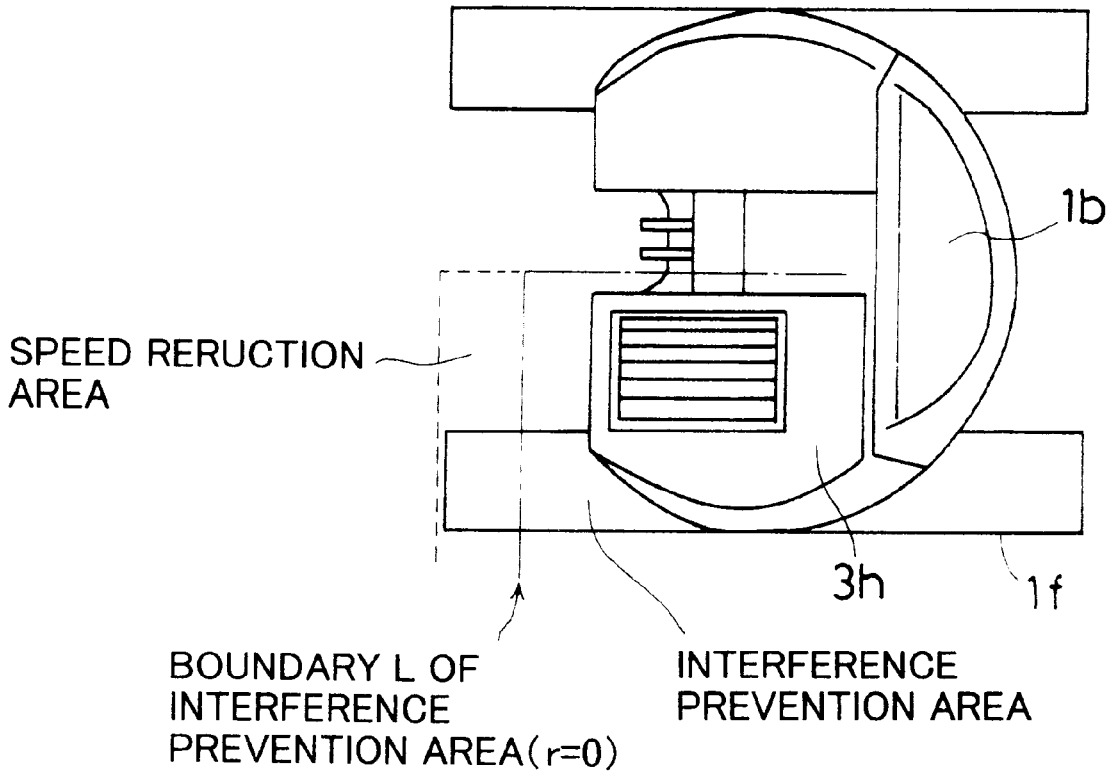
FIG. 6 is a view showing areas used in interference avoidance control according to this embodiment.

The front attitude calculating portion 7*a* receives the rotational angles of the boom, the arm and the offset detected by the angle sensors 6*a*–6*c*, calculates a position of the tip end (monitoring point) of the front device 1A based on the input rotational angles through transformation of coordinate system, and then computes a distance r from the tip end position to an interference prevention area. The interference prevention area is set to prevent the tip end of the front device 1A from interfering with the vehicle body 1B, in particular, the cab 3*h*. As shown in FIGS. 5 and 6, the interference prevention area is set around the cab 3*h* with a safety distance, e.g., 30 cm, left from the cab 3*h*. The tip end position of the front device 1A is calculated as a position of the point which locates on an imaginary circle X having the center defined at a pivoting point 0*v* of the bucket 1*c* and a radius rv defined by the distance from the center to a tip end P of the bucket 1*c*, and which is nearest to a boundary L of the interference prevention area. Then, the distance from that point to the interference prevention area.

The input limit value calculating portions 7*b*–7*d* each calculate an input limit value u based on the distance r determined as explained above and the preset calculation formula for speed reduction control.

In the input limit value calculating portion 7*d* for the offset id, the relationship between the distance r and the limit value u is set such that if the distance r is larger than the control start distance r0, the limit value u is kept at a maximum value; if the distance r is not larger than the control start distance r0, the limit value u is reduced as the distance r reduces; and if the distance r is nil (0) or less, the limit value u is also made nil (0). With the relationship so set, the limit value u is made nil (0) at the boundary of the interference prevention area and the offset 1*d* is stopped there.

In the input limit value calculating portion 7*b* for the boom 1*a*, the relationship between the distance r and the limit value u is set such that if the distance r is larger than the control start distance r0, the limit value u is kept at a maximum value; if the distance r is not larger than the control start distance r0, the limit value u is reduced as the distance r reduces; and if the distance r is a negative value rn or less, the limit value u is made nil (0). With the relationship so set, the limit value u is set to a value larger than nil (0) at the boundary of the interference prevention area, enabling the boom 1*a* to be operated.

Further, in the input limit value calculating portion 7*c* for the arm 1*b*, the relationship between the distance r and the limit value u is set such that if the distance r is larger than the control start distance r0, the limit value u is kept at a maximum value; if the distance r is not larger than the control start distance r0, the limit Value u is reduced as the distance r reduces; if the distance r is nil (0), the limit value u is also made nil (0); and if the distance r is a negative value, the limit value u also takes a negative value depending on the negative value of the distance r. With the relationship so set, the limit value u is made nil (0) at the boundary of the interference prevention area, and when the arm 1*b* enters the interference prevention area beyond the boundary, the limit value u is set to be negative (–), causing the arm 2*b* to move in an opposite direction (i.e., in an arm dumping direction).

Additionally, in the input limit value calculating portions 7*b*–7*d*, the maximum values of the limit values u are set to values substantially coincident with respective maximum values of the operation signals input from the control lever units 4*a*, 4*b*, 4*c*.

The maximum/minimum value selecting portions 7*e*–7*g* compare the input signals from the control lever units 4*a*, 4*b*, 4*c* and the input limit values u, and select either of them so that the input signals will not exceed the limit values u.

In the portions 30*a*–36*b* for calculating command values applied to the flow control valves on the extension and contractions sides of the respective actuators, the command values are calculated so as to excite the solenoid driving sectors 20*a*–26*a* on the extension side when the sign of an input is positive, and excite the solenoid driving sectors 20*b*–26*b* on the contraction side when the sign of an input is negative. Here, when the maximum/minimum value selecting portions 7*e*–7*g* select the limit values u calculated by the calculating portions 7*b*–7*d*, the command values calculated by the calculating portions 30*a*, 31*a*, 33*b* are provided as speed reduction command values.

The control gain calculating portion 7*h* calculates a control gain K based on the distance r to the interference prevention area and the preset calculation formula. In the control gain calculating portion 7*h*, the relationship between the distance r and the control gain K is set such that if the distance r is larger than the control start distance r0, the control gain K is kept at nil (0); if the distance r is not larger than the control start distance r0, the control gain K is increased as the distance r reduces; and if the distance r is nil (0) or less, the control gain K takes a maximum fixed value.

The detection line 7*m* detects the command value on the boom-up side calculated by the command value calculating portion 30*a*.

The multiplier 7*i* determines the product of the control gain K and the command value on the boom-up side taken out through the command value calculating portion 30*a*. As described later, the value determined by the multiplier 7*i* serves as a speed increase command value in the interference avoiding direction (i.e., an interference avoidance target speed).

The adder 7*j* determines a difference between the input limit value for the arm and the product of the control gain K and the command value on the boom-up side.

In the foregoing, supposing that the control lever units 4*a*, 4*b*, 4*c*, 4*d* constitute a plurality of operating means for instructing the operations of the boom, the arm, the bucket and the offset which serve as a plurality of front members, the boom 1*a* constitutes a first front member, and the arm 1*b* constitutes a second front member, the angle sensors 6*a*–6*b* constitute first detecting means for detecting status variables in relation to a position and attitude of the front device 1A, and the front attitude calculating portion 7*a* constitutes calculating means for calculating the position and attitude of the front device based on signals from the first detecting means.

Also, the detection line 7*m* for taking out the command value on the boom-up side constitutes second detecting means for detecting the operation of the first front member in accordance with the operation signal from the operating means. The input limit value calculating portions 7*b*, 7*c*, the minimum value selecting portions 7*e*, 7*f*, the control gain calculating portion 7*h*, the multiplier 7*i*, the adder 7*j*, and the command value calculating portions 30*a*–31*b* jointly constitute first control means for controlling, based on a calculated value of the calculating means and a detected value of the second detecting means, the second front member to move in the interference avoiding direction relative to the vehicle body while continuing to operate the first front member in accordance with the operation signal, if a predetermined portion of the front device comes close to the vehicle body when the first front member is being moved in accordance with the operation signal.

In this embodiment, the first control means controls the second front member (arm) to move in the forward (dumping) direction relative to the vehicle body that is the interference avoiding direction relative to the vehicle body.

Further, in this embodiment, the first control means calculates, based on a detected value of the second detecting means, a target speed of the second front member (arm) in the interference avoiding direction corresponding to an operating speed of the first front member (boom) in a combination of the minimum value selecting portion 7*f*, the control gain calculating portion 7*h*, the multiplier 7*i*, the adder 7*j*, and the command value calculating portion 31*b*, and controls the second front member to move in the interference avoiding direction at the calculated target speed.

Moreover, in this embodiment, the calculating means (front attitude calculating portion 7*a*) calculates, based on detected values of the first detecting means, a distance r from the predetermined portion of the front device to an area (interference prevention area) preset around the vehicle body, and the first control means modifies, in the input limit value calculating portion 7*b*, the operation signal from the operating means for the first front member such that when the distance r is not larger than a preset first control start distance r0, the first front member is further slowed down as the distance r reduces, and then starts the above control at the time the distance r becomes not larger than a second control start distance r0 that is equal to the preset first control start distance, in the combination of the minimum value selecting portion 7*f*, the control gain calculating portion 7*h*, the multiplier 7*i*, the adder 7*j*, and the command value calculating portion 31*b*. Note that the second control start distance may be set smaller than the first control start distance.

The operation of this embodiment constructed as described above will be described below. The description will be made of several examples of work, i.e., (a) where the arm 1*b* is operated toward the operator (rearward of the vehicle body, namely, in the arm crowding direction) so that the front device 1A approaches the cab 3*h* from the front, (b) where the boom 1*a* is operated upward, (c) where the arm 1*b* is operated toward the operator while the boom 1*a* is operated upward, and (d) where the offset 1*d* is operated to the left.

(a) In the work where the arm 1*b* is operated toward the operator (rearward of the vehicle body, namely, in the arm crowding direction), if the tip end of the front device 1A comes close to the interference prevention area and the distance r becomes smaller than the control start distance r0, the command value for the extension side of the arm cylinder 3*b* is restricted depending on the limit value u calculated by the input limit value calculating portion 7*c*, to output a speed reduction command for the arm 1*b*. The arm 1*b* is thereby gradually slowed down and then stopped at the boundary L of the interference prevention area.

If the tip end of the front device should enter the interference prevention area, the limit value u calculated by the input limit value calculating portion 7*c* becomes negative (−) to forcibly increase the command value for the contraction side of the arm cylinder 3*b*, whereby the arm 1*b* is sped up forward (in the arm dumping direction) and the tip end of the front device retires from the interference prevention area. Accordingly, the operator can operate the arm 1*b* safely with no need of taking care of an interference between the front device 1A and the cab 3*h*.

(b) In the work where the boom 1*a* is operated upward, if the tip end of the front device 1A comes close to the interference prevention area and the distance r becomes smaller than the control start distance r0, the command value for the extension side of the boom cylinder 3*a* is restricted depending on the limit value u calculated by the input limit value calculating portion 7*b*, to output a speed reduction command for the boom 1*a*. The boom 1*a* is thereby gradually slowed down. At the same time, the detection line 7*m*, the control gain calculating portion 7*h* and the multiplier 7*i* cooperatively calculate, as a target speed of the arm 1*b* in the interference avoiding direction relative to the vehicle body 1B, a speed increase command value for the arm 1*b* in the arm dumping direction (forward of the vehicle body) which is proportional to the command value for the extension side of the boom cylinder 3*a*. If the speed increase command value is larger than the limit value u calculated by the input limit value calculating portion 7*c* and a value resulted by subtracting the speed increase command value from the calculated limit value u in the adder 7*j* becomes negative (−), a speed increase command value is output for the contraction side of the arm cylinder 3*b* to speed up the arm 1*b* in the dumping direction (forward). As a result of the speed reduction of the boom 1*a* and the movement of the arm 1*b* in the dumping direction, the tip end of the front device 1A is moved along the boundary L of the interference prevention area near the boundary L as indicated by arrow M in FIG. 5. Accordingly, the operator can continuously operate the boom 1*a* safely with no need of taking care of an interference between the front device 1A and the cab 3*h*.

(c) In the work where the arm 1*b* is operated toward the operator (rearward of the vehicle body, namely, in the arm crowding direction) while the boom 1*a* is operated upward, if the distance r becomes smaller than the control start distance r0, the command value for the extension side of the boom cylinder 3*a* is restricted and the boom 1*a* is gradually slowed down as with the above case (b). At the same time, the multiplier 7*i* calculates a speed increase command value for the arm 1*b* in the arm dumping direction which is proportional to the command value for the extension side of the boom cylinder 3*a*. If a value resulted by subtracting the speed increase command value from the limit value u calculated by the input limit value calculating portion 7*c* is positive (+), the command value for the extension side of the arm cylinder 3*b* is restricted depending on the resulted difference value. If that difference value becomes negative (−), it is output as a command value for the contraction side of the arm cylinder 3*b* to speed up the arm 1*b* in the dumping direction (forward). As a result of those movements of the boom and the arm, similarly to the above case, the tip end of the front device 1A is moved along the boundary L of the interference prevention area near the boundary L as indicated by arrow M in FIG. 5. Accordingly, the operator can continuously operate the boom 1*a* safely with no need of taking care of an interference between the front device 1A and the cab 3*h*.

(d) In the work where the offset 1*d* is operated to the left, if the tip end of the front device 1A comes close to the interference prevention area and the distance r becomes smaller than the control start distance r0, the command value for the contraction side of the offset cylinder 3*d* is restricted depending on the limit value u calculated by the input limit value calculating portion 7*d*, to output a speed reduction command for the offset id. The offset 1*d* is thereby gradually slowed down and then stopped at the boundary L of the interference prevention area. Accordingly, the operator can operate the offset 1*d* safely with no need of taking care of an interference between the front device 1A and the cab 3*h*.

As described above, according to this embodiment, when the boom 1*a* is operated upward or when the arm 1*b* is operated toward the operator while the boom 1*a* is operated upward, the arm 1*b* is moved in the dumping direction, i.e., in the interference avoiding direction relative to the vehicle body, while the boom 1*a* continues to move upward and, therefore, the front device 1A can be moved continuously while being prevented from interfering with the cap 3*h* (interference avoidance control).

Also, since the arm 1*b* is moved in the dumping direction while the boom 1*a* continues to move upward, the front device can be operated as intended by the operator in accordance with the operation signal for moving the boom upward.

Further, since an interference with the cab is avoided without moving the offset 1*d* laterally, the position of the bucket 1*c* in the lateral direction remains the same. This eliminates the need of setting the tip end of the front device to the original lateral position again in work loading earth and sand, for example, and hence can shorten the time required for one cycle of the work. It is therefore possible to avoid an interference of the tip end of the front device with the vehicle body and perform work with better efficiency.

Moreover, since the boom 1*a* continues to move upward, the front device 1A is prevented from being jerk in its motion, resulting in interference avoidance control that allows the tip end of the front device to move smoothly around the cab.

As a result, an interference between the tip end of the front device and the cab can be prevented without reducing the maneuverability and the working efficiency. In addition, according to this embodiment, the target speed of the arm 1*b* in the dumping direction is calculated based on the command value for the boom-up operation calculated by the command value calculating portion 30*a*. Therefore, when the arm 1*b* is moved in the dumping direction, a speed of the arm 1*b* moving in the dumping direction corresponds to the move-up speed of the boom 1*a* and a speed balance is held between the boom-up operation and the arm dumping operation. Consequently, it is possible to achieve the interference avoidance control in which the motion of the front device 1A is smoother. Also, even if the moving-up speed of the boom 1*a* is changed, the distance at which the tip end of the front device comes close to the cab is not largely changed and hence a wide work area can be ensured.

Further, since the boom-up movement is slowed down when the arm is moved in the dumping direction while the boom continues to move upward, the flow rate of the hydraulic fluid consumed by the boom cylinder 3*a* is reduced and the hydraulic fluid is supplied at a necessary and sufficient flow rate to the arm cylinder 3*b*, enabling the arm 1*b* to quickly move in the dumping direction. This suppresses, in combination with the speed reduction of the boom-up movement, an amount by which the tip end of the front device enters the interference prevention area. As a result, the tip end of the front device can be smoothly moved along the interference prevention area. Additionally, a smaller amount by which the tip end of the front device enters the interference prevention area makes it possible to set a narrower interference prevention area and ensure an even wider work area.

When the arm 1*b* is operated toward the operator, the arm is gradually slowed down as the tip end of the front device approaches the interference prevention area, and then stopped at the boundary L of the interference prevention area. If the tip end of the front device enters the interference prevention area, the arm is sped up in the dumping direction (forward) to retire the tip end of the front device away from the interference prevention area and, therefore, the arm can be operated safely.

When the offset 1*d* is operated to the left, the offset is gradually slowed down as the tip end of the front device approaches the interference prevention area, and then stopped at the boundary L of the interference prevention area. Therefore, the offset can be operated safely as with the above case.

Second Embodiment

Figure 7:
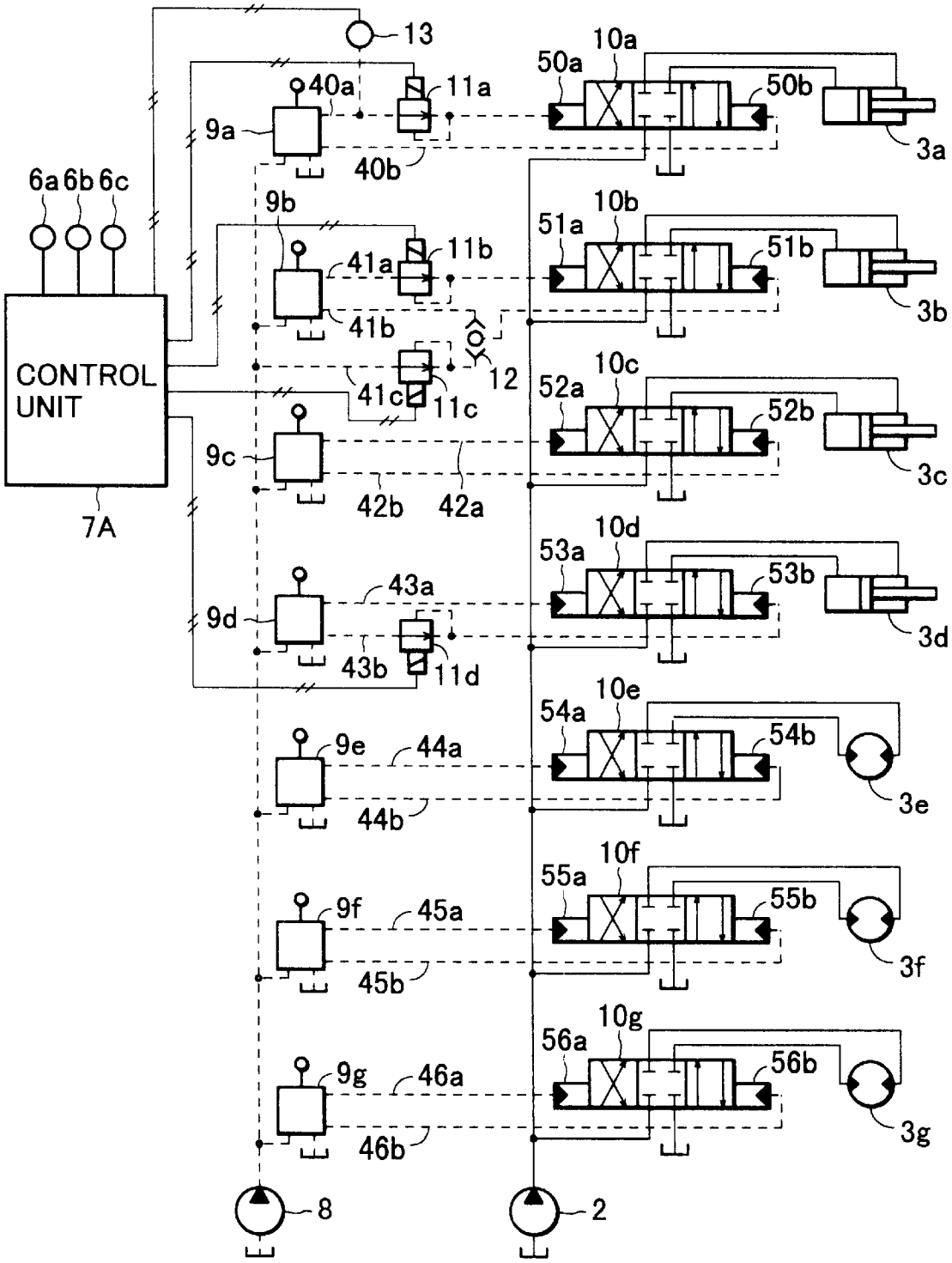
FIG. 7 is a diagram showing an interference preventing system for a hydraulic excavator according to a second embodiment of the present invention, along with a hydraulic circuit thereof.

A second embodiment of the present invention will be described with reference to FIGS. 7 and 8. In this embodiment, the present invention is applied to a hydraulic excavator using control lever units of hydraulic pilot type. In FIGS. 7 and 8, equivalent members and parts to those in the above-referred corresponding figures are denoted by the same reference numerals.

In FIG. 7, a hydraulic excavator employing this embodiment includes control lever units 9*a*–9*g* of hydraulic pilot type rather than the control lever units 4*a*–4*g*. Based on a pilot pressure produced by a pilot pump 8, the control levers units 9*a*–9*g* supply pilot pressure depending on respective input amounts and directions by and in which levers are manipulated by the operator, to hydraulic driving sectors 50*a*–56*b* of the associated flow control valves 10*a*–10*g* through pilot lines 40*a*–46*b*, thereby driving the associated flow control valves 10*a*–10*g* by the pilot pressures supplied thereto.

An interference preventing system according to this embodiment is equipped on the hydraulic excavator constructed as explained above. The interference preventing system includes, in addition to the components of the first embodiment, a pressure sensor 13 disposed in the pilot line 40*a* extending from the control lever unit 9*a* for the boom and detecting a pressure as an input amount by which the control lever unit 9*a* is operated by the operator, proportional solenoid pressure reducing valves 11*a*–11*d* driven by electric signals, and a shuttle valve 12. The proportional solenoid pressure reducing valves 11*a*, 11*b*, 11*d* are disposed respectively in the pilot lines 40*a*, 41*a*, 43*b* to reduce pilot pressures depending on the electric signals and then output the reduced pilot pressures to the hydraulic driving sectors 50*a*, 51*a*, 53*b* of the flow control valves 10*a*, 10*b*, 10*d*. The proportional solenoid pressure reducing valve 11*c* is disposed in the specific pilot line 41*c* directly connected to the pilot pump 8, and the shuttle valve 12 selects higher one of a pilot pressure in the pilot line 41*b* and a control pressure output from the proportional solenoid pressure reducing valve 11*c*, the selected higher pressure being introduced to the hydraulic driving sector 51*b* of the flow control valves 10*b*.

Differences in control functions of this embodiment from those of the first embodiment will be described with reference to FIG. 8.

In a basic hydraulic excavator of hydraulic pilot type provided with no interference preventing system, the flow control valves 10*a*–10*g* are directly driven by respective pilot pressures adjusted by the control lever units 9*a*–9*g*. Therefore, the portions for calculating command values applied to pressure reducing valves for the extension side and the contraction side of the associated actuator are no longer necessary except those for the arm.

Also, because of characteristics of the proportional solenoid pressure reducing valves 11*a*–11*d* and the shuttle valve 12, the maximum/minimum value selecting portions for input limitation are no longer necessary. Instead of those selecting portions, a selecting portion 7*k* for selecting smaller one of an output of the pressure sensor 13 for detecting a pilot pressure determined by the input amount from the control lever unit 9*a* and an output of the input limit value calculating portion 7*b* is added to estimate a pilot pressure acting upon the hydraulic driving sector 50*a* on the boom-up (extension) side. While the pressure sensor 13 may be disposed on the output side of the proportional solenoid pressure reducing valve 11*a* so that a detected value may be directly employed, the above arrangement of detecting the pilot pressure on the input side of the proportional solenoid pressure reducing valve 11*a* is superior in the response point of view.

In the foregoing, supposing that the control lever units 9*a*, 9*b*, 9*c*, 9*d* constitute a plurality of operating means for instructing the operations of the boom, the arm, the bucket and the offset which serve as a plurality of front members, the boom 1*a* constitutes a first front member, and the arm 1*b* constitutes a second front member, the angle sensors 6*a*–6*c* constitute first detecting means for detecting status variables in relation to a position and attitude of the front device 1A, and the front attitude calculating portion 7*a* constitutes calculating means for calculating the position and attitude of the front device based on signals from the first detecting means.

Also, the pressure sensor 13, the minimum value selecting portion 7*k* and the detection line 7*m* jointly constitute second detecting means for detecting the operation of the first front member in accordance with the operation signal from the operating means. The input limit value calculating portions 7*b*, 7*c*, the control gain calculating portion 7*h*, the multiplier 7*i*, the adder 7*j*, the command value calculating portions 31*a*, 31*b*, the proportional solenoid pressure reducing valves 11*a*, 11*b*, 11*c*, and the shuttle valve 12 jointly constitute first control means for controlling, based on a calculated value of the calculating means and a detected value of the second detecting means, the second front member to move in the interference avoiding direction relative to the vehicle body while continuing to operate the first front member in accordance with the operation signal, if a predetermined portion of the front device comes close to the vehicle body when the first front member is being moved in accordance with the operation signal.

Further, in this embodiment, the first control means calculates, based on a detected value of the second detecting means, a target speed of the second front member in the interference avoiding direction corresponding to an operating speed of the first front member in a combination of the control gain calculating portion 7*h*, the multiplier 7*i*, the adder 7*j*, and the command value calculating portion 31*b*, and controls the second front member to move in the interference avoiding direction at the calculated target speed.

Still further, in this embodiment, the calculating means (front attitude calculating portion 7*a*) calculates, based on detected values of the first detecting means, a distance r from the predetermined portion of the front device to an area (interference prevention area) preset around the vehicle body, and the first control means modifies, in the input limit value calculating portion 7*b*, the operation signal from the operating means for the first front member such that when the distance r is not larger than a preset first control start distance r0, the first front member is further slowed down as the distance r reduces, and then starts the above control at the time the distance r becomes not larger than a second control start distance r0 that is equal to the preset first control start distance, in the combination of the control gain calculating portion 7*h*, the multiplier 7*i*, the adder 7*j*, and the command value calculating portion 31*b*. Note that the second control start distance may be set smaller than the first control start distance.

The operation of this embodiment constructed as described above will be described below.

(a) In the work where the arm 1*b* is operated toward the operator (rearward of the vehicle body, namely, in the arm crowding direction), if the tip end of the front device 1A comes close to the interference prevention area and the distance r becomes smaller than the control start distance r0, the pilot pressure for the extension side of the arm cylinder 3*b* is restricted by the proportional solenoid pressure reducing valve 11*b* depending on the limit value u calculated by the input limit value calculating portion 7*c*, to output a speed reduction command for the arm 1*b*. The arm 1*b* is thereby gradually slowed down and then stopped at the boundary L of the interference prevention area.

If the tip end of the front device should enter the interference prevention area, the limit value u calculated by the input limit value calculating portion 7*c* becomes negative (−) and the proportional solenoid pressure reducing valve 11*c* is operated to forcibly increase the pilot pressure for the contraction side of the arm cylinder 3*b*, whereby the arm 1*b* is sped up forward (in the arm dumping direction) and the tip end of the front device retires from the interference prevention area. Accordingly, the operator can operate the arm 1*b* safely with no need of taking care of an interference between the front device 1A and the cab 3*h*.

(b) In the work where the boom 1*a* is operated upward, if the tip end of the front device 1A comes close to the interference prevention area and the distance r becomes smaller than the control start distance r0, the pilot pressure for the extension side of the boom cylinder 3*a* is restricted by the proportional solenoid pressure reducing valve 11*a* depending on the limit value u calculated by the input limit value calculating portion 7*b*, to output a speed reduction command for the boom 1*a*. The boom 1*a* is thereby gradually slowed down. At the same time, the detection line 7*m*, the control gain calculating portion 7*h* and the multiplier 7*i* cooperatively calculate, as a target speed of the arm 1*b* in the interference avoiding direction relative to the vehicle body 1B, a speed increase command value for the arm 1*b* in the arm dumping direction which is proportional to the pilot pressure for the extension side of the boom cylinder 3*a*. If the speed increase command value is larger than the limit value u calculated by the input limit value calculating portion 7*c* and a value resulted by subtracting the speed increase command value from the calculated limit value u in the adder 7*j* becomes negative (−), a speed increase command value is output for the contraction side of the arm cylinder 3*b* to speed up the arm 1*b* in the dumping direction (forward). As a result of the speed reduction of the boom 1*a* and the movement of the arm 1*b* in the dumping direction, the tip end of the front device 1A is moved along the boundary L of the interference prevention area near the boundary L as indicated by arrow M in FIG. 5. Accordingly, the operator can continuously operate the boom 1*a* safely with no need of taking care of an interference between the front device 1A and the cab 3*h*.

(c) In the work where the arm 1*b* is operated toward the operator (rearward of the vehicle body, namely, in the arm crowding direction) while the boom 1*a* is operated upward, if the distance r becomes smaller than the control start distance r0, the pilot pressure for the extension side of the boom cylinder 3*a* is restricted by the proportional solenoid pressure reducing valve 11*a* and the boom 1*a* is gradually slowed down as with the above case (b). At the same time, the multiplier 7*i* calculates a speed increase command value for the arm 1*b* in the arm dumping direction which is proportional to the pilot pressure for the extension side of the boom cylinder 3*a*. If a value resulted by subtracting the speed increase command value from the limit value u calculated by the input limit value calculating portion 7*c* is positive (+), the pilot pressure for the extension side of the arm cylinder 3*b* is restricted by the proportional solenoid pressure reducing valve 11*b* depending on the resulted difference value . If that difference value becomes negative (−), the proportional solenoid pressure reducing valve 11*c* is operated to forcibly increase the pilot pressure for the contraction side of the arm cylinder 3*b*, thereby speeding up the arm 1*b* in the dumping direction (forward). As a result of those movements of the boom and the arm, similarly to the above case, the tip end of the front device 1A is moved along the boundary L of the interference prevention area near the boundary L as indicated by arrow M In FIG. 5. Accordingly, the operator can continuously operate the boom 1*a* safely with no need of taking care of an interference between the front device 1A and the cab 3*h*.

(d) In the work where the offset 1*d* is operated to the left, if the tip end of the front device 1A comes close to the interference prevention area and the distance r becomes smaller than the control start distance r0, the pilot pressure for the contraction side of the offset cylinder 3*d* is restricted by the proportional solenoid pressure reducing valve lid depending on the limit value u calculated by the input limit value calculating portion 7*d*, to output a speed reduction command for the offset 1*d*. The offset 1*d* is thereby gradually slowed down and then stopped at the boundary L of the interference prevention area. Accordingly, the operator can operate the offset 1*d* safely with no need of taking care of an interference between the front device 1A and the cab 3*h*.

As described above, with this embodiment, similar advantages as with the first embodiment can also be provided in a hydraulic excavator employing control lever units of hydraulic pilot type.

Third Embodiment

Figure 9:
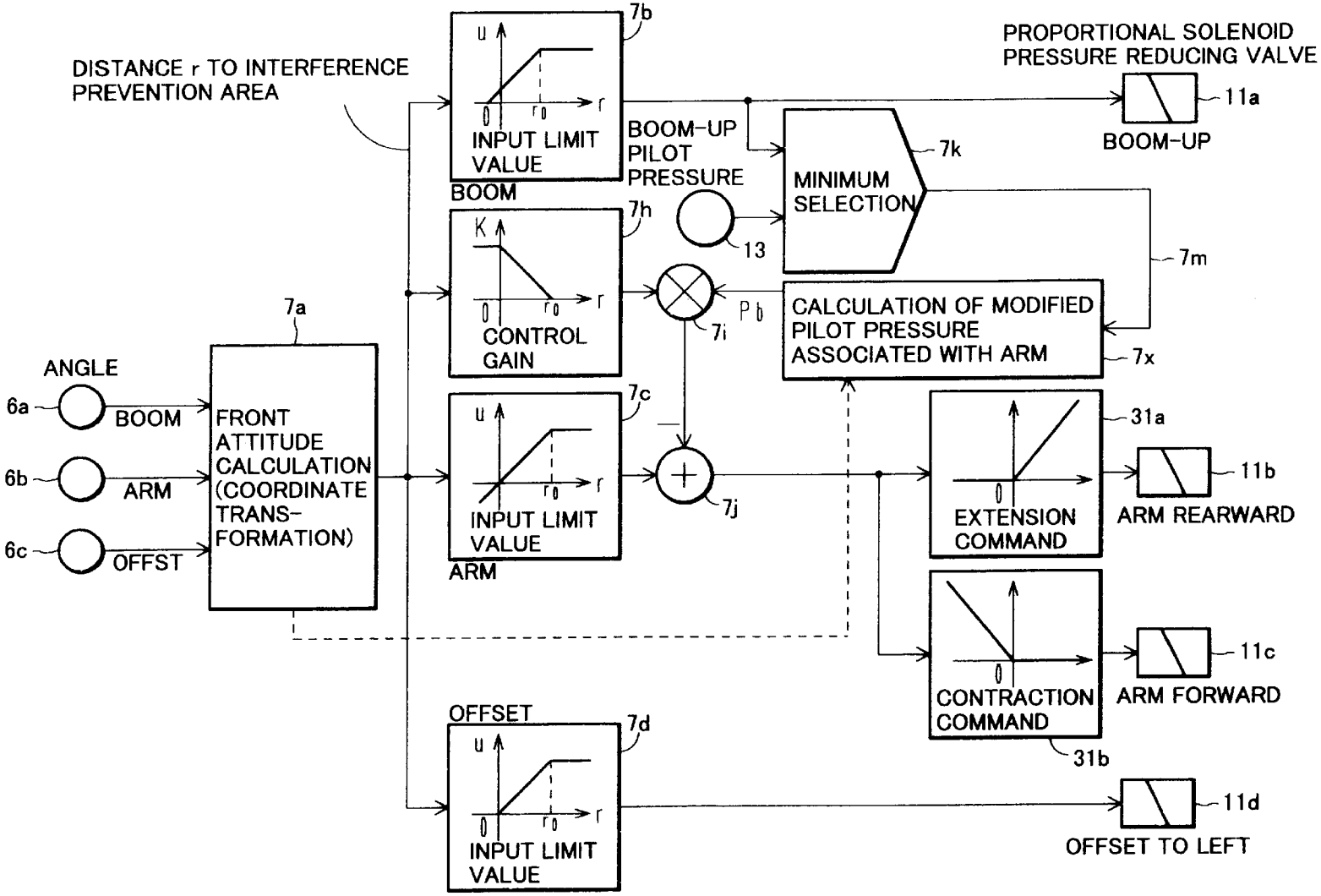
FIG. 9 is a functional block diagram showing control functions of a control unit in an interference preventing system for a hydraulic excavator according to a third embodiment of the present invention.
Figure 10:
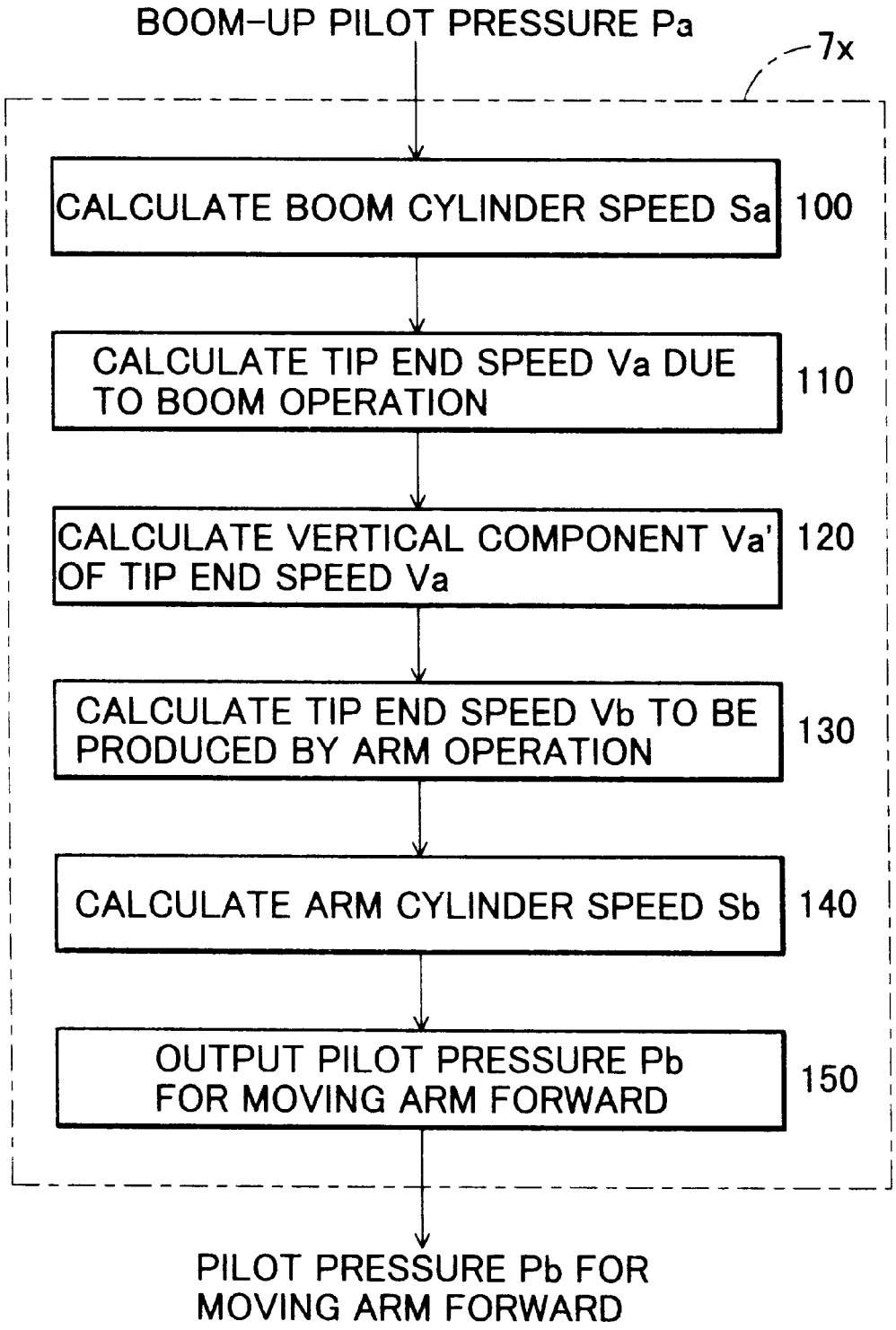
FIG. 10 is a flowchart showing, of the control functions of the control unit, a processing procedure executed in a portion for calculating a modified pilot pressure associated with an arm.
Figure 11:
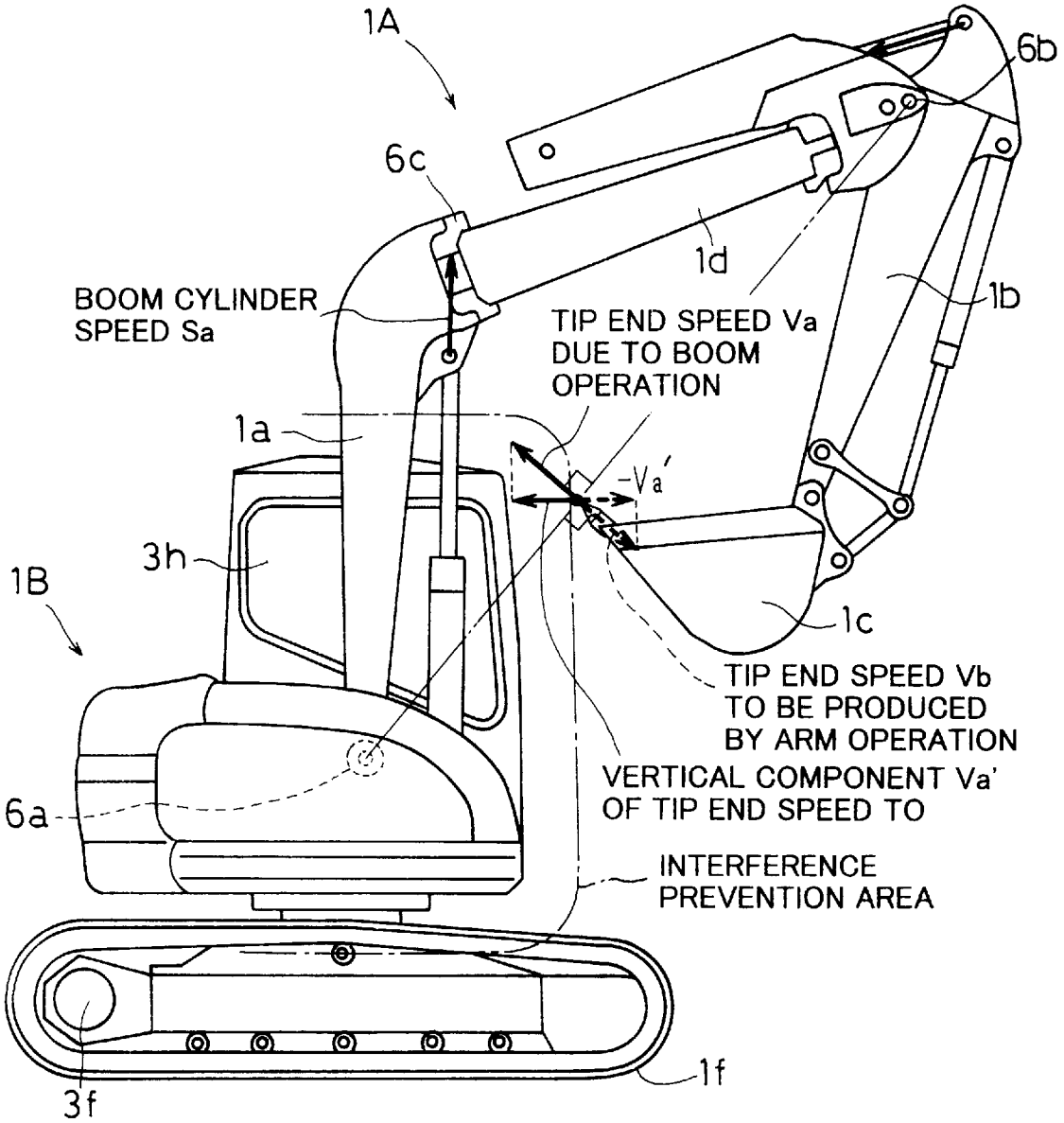
FIG. 11 is a view for explaining the processing procedure executed in the portion for calculating the modified pilot pressure associated with the arm.

A third embodiment of the present invention will be described with reference to FIGS. 9 to 11. This embodiment is modified from the second embodiment in that data relating to the position and attitude of the front device is input to operating predicting means to more accurately predict motion of the front device. In FIGS. 9 to 11, equivalent members and parts to those in the above-referred corresponding figures are denoted by the same reference numerals. The circuit configuration is the same as that of the second embodiment shown in FIG. 2. In FIG. 9, an interference preventing system of this embodiment includes a portion 7*x* for calculating a modified pilot pressure associated with the arm, in addition to the control functions of the control unit in the second embodiment shown in FIG. 8.

The portion 7*x* for calculating a modified pilot pressure associated with the arm calculates, based on a boom-up pilot pressure Pa produced in the hydraulic driving sector 50*a* of the flow control valve 10*a* for the boom, a modified pilot pressure Pb by which the arm is operated to prevent the bucket from entering the interference prevention area due to the boom operation.

Details of this modifying process will be described with reference to FIGS. 10 and 11.

Referring to FIG. 10, in step 100, a speed Sa of the boom cylinder 3*a* is determined based on the boom-up pilot pressure Pa and a flow characteristic of the flow control valve 10*a* for the boom.

Then, in step 110, a tip end speed Va of the bucket 1*c* due to the operation of the boom 1*a* is determined based on the above boom cylinder speed Sa and transformation of coordinate system for the front device 1A. At this time, the calculation is made on an assumption that the bucket angle has a value at which the bucket is closest to the cab.

Then, in step 120, a vertical component Va' of the tip end speed Va of the bucket 1*c* due to the operation of the boom which is vertical to the interference prevention area is determined through transformation of coordinate system. This vertical component Va' is an essential speed component of the front device at which the bucket tip end comes closer to the interference prevention area.

Then, in step 130, a tip end speed Vb necessary for moving the arm 1*b* so as to produce—Va' opposed to the vertical component Va' of the tip end speed Va of the bucket is determined through transformation of coordinate system.

Then, in step 140, a speed Sb of the arm cylinder 3*b* is determined based on the above tip end speed Vb and transformation of coordinate system for the front device 1A.

Then, in step 150, a pilot pressure Pb for moving the arm in the dumping direction (forward) is determined based on the arm cylinder speed Sb and a flow characteristic of the flow control valve 10*b* for the arm.

Returning to FIG. 9, the multiplier 7*i* determines the product of the control gain K and the pilot pressure Pb determined as explained above, thereby calculating, as a target speed of the arm in the interference avoiding direction, a speed increase command value for the arm dumping direction. Subsequently, the control process is carried out similarly to the second embodiment.

According to this embodiment constructed as described above, since a speed component relating to an interference with the cab is extracted out of the moving-up speed of the boom 1*a* and the speed increase command value for the arm in the dumping direction is determined from the extracted speed component, interference avoidance control can be performed in a smoother manner and a wider work area can be ensured.

Fourth Embodiment

A fourth embodiment of the present invention will be described with reference to FIGS. 12 to 14. In these figures, equivalent members and functions to those in FIGS. 1 and 4 are denoted by the same reference numerals.

When work is carried out by employing a hydraulic excavator, there are obstacles such as electric wires and bridges over the head or facilities laid under the ground in some work sites. In such a case, it is required for the operator to pay close attention so that the front device will not contact those obstacles. As a result, the burden upon the operator is increased and the working efficiency is lowered. This embodiment is intended to make it possible to move the front device safely and prevent the front device from interfering with the cab even in such work sites.

Figure 12:
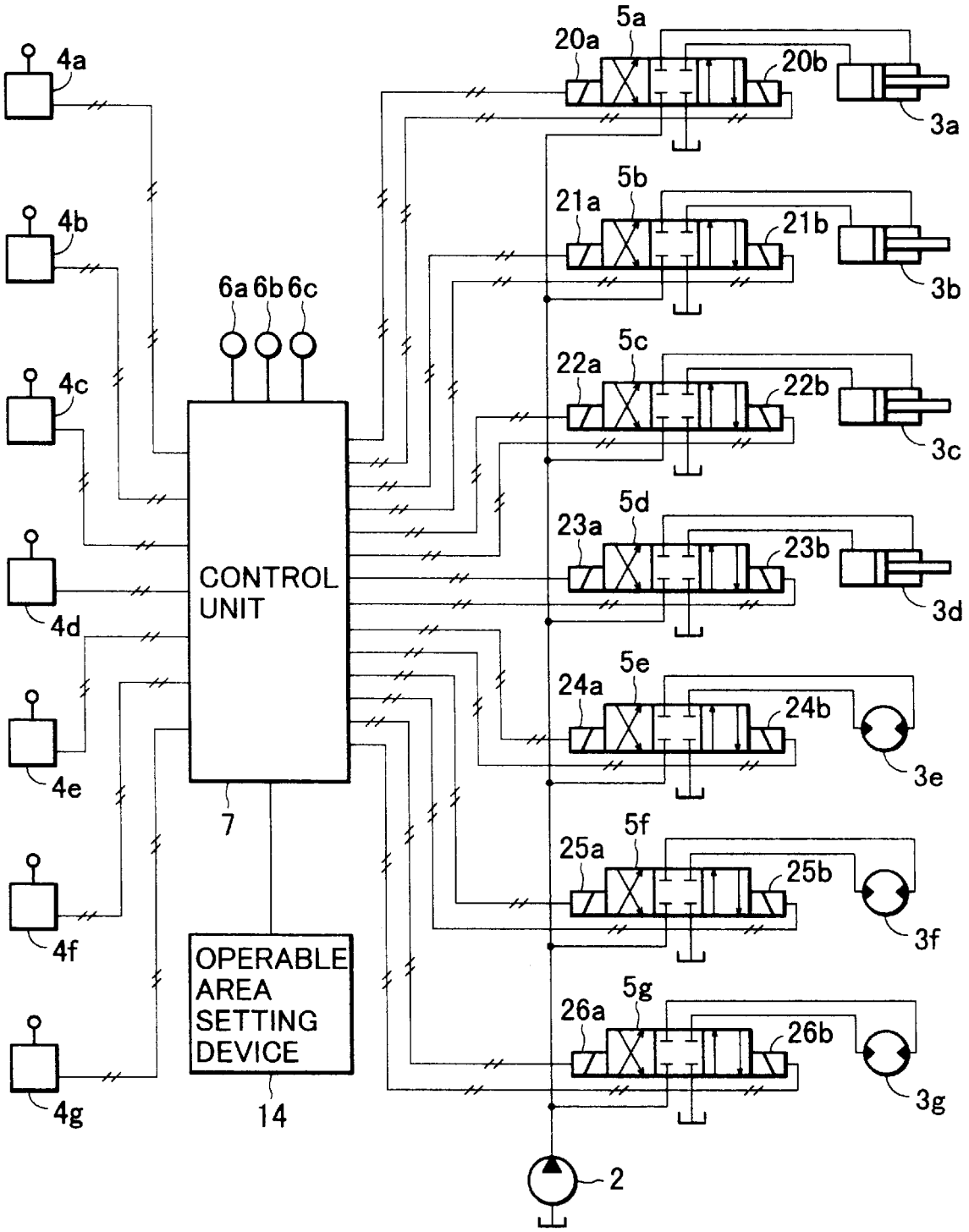
FIG. 12 is a diagram showing an interference preventing system for a hydraulic excavator according to a fourth embodiment of the present invention, along with a hydraulic circuit thereof.

In FIG. 12, an operable area setting device 14 for previously setting an operable area in which the front device 1A is allowed to move in the height or vertical direction is connected to the control unit 7. The operable area setting device 14 sets an operable area upon a limit position in the height direction being entered through input operation using, e.g., a key or an up/down switch. Alternatively, an operable area may also be set by direct teaching in which the front device 1A is moved to the position to be set and a switch is depressed there.

Figure 13:
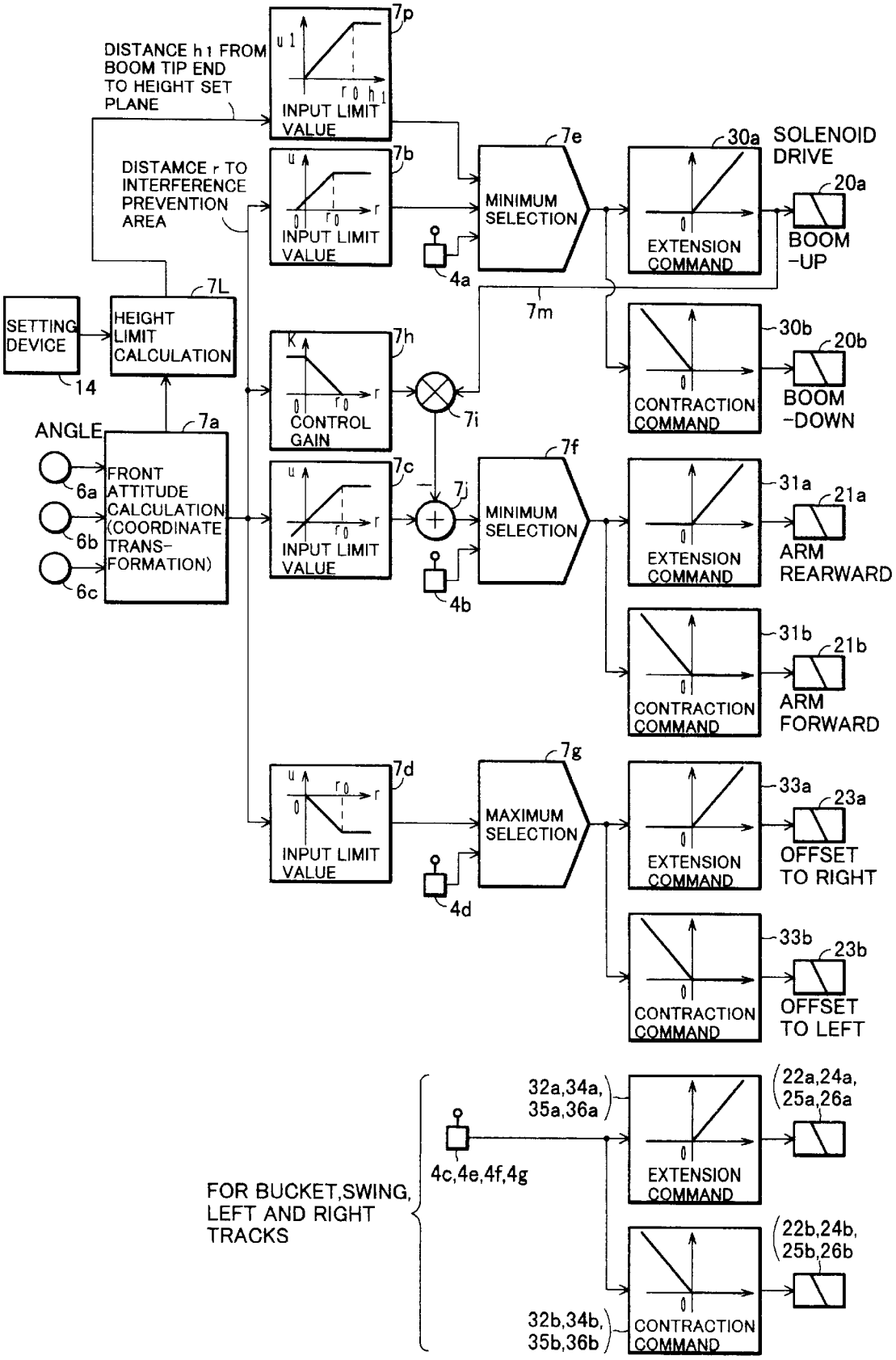
FIG. 13 is a functional block diagram showing control functions of a control unit.

Control functions of the control unit 7 are shown in FIG. 13. In addition to the control functions of the control unit 7 shown in FIG. 4, the control unit 7 of this embodiment includes an area limit calculating device (height limit calculating device in this embodiment) 7L and an input limit value calculating portion 7*p*.

As described above in connection with the first embodiment, the front attitude calculating portion 7*a* receives the rotational angles of the boom, the arm and the offset detected by the angle sensors 6*a*–6*c*, calculates a position of the tip end (monitoring point) of the front device 1A based on the input rotational angles through transformation of coordinate system, and then computes a distance r from the tip end position to the interference prevention area.

The input limit value calculating portions 7*b*–7*d* each calculate, as described above, an input limit value u based on the distance r thus determined and the preset calculation formula for speed reduction control.

Also, the front attitude calculating portion 7*a* calculates a position of the tip end of the offset 1*d* and applies the calculated position, as position information, to the height limit calculating device 7L.

Figure 14:
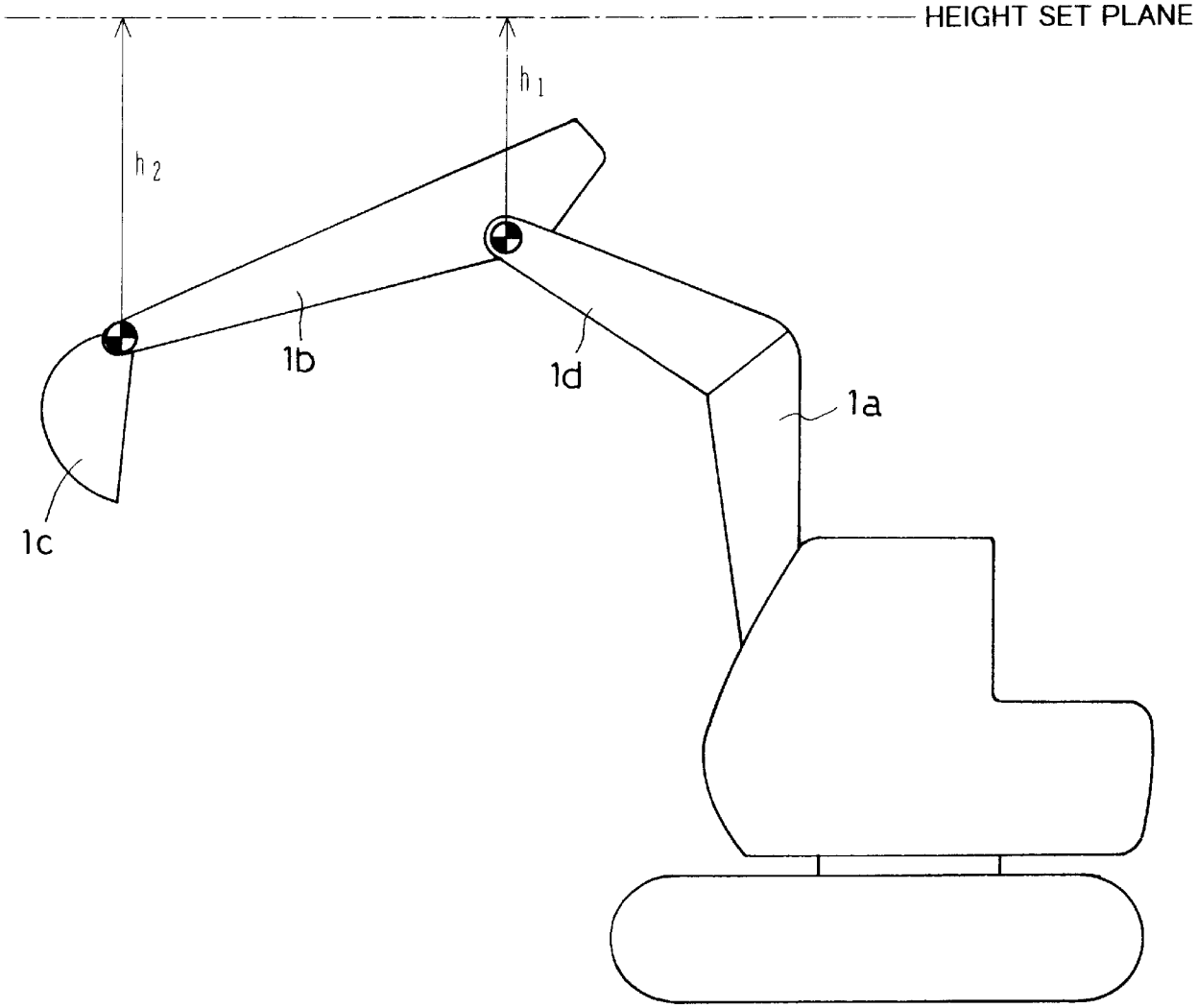
FIG. 14 is an illustration showing an example of a point at which the distance between a height set plane and a front device is measured.

The height limit calculating device 7L calculates, based on the tip end position of the offset 1 calculated by the front attitude calculating portion 7*a* and a height limit position (hereinafter referred to as a height set plane) set by the setting device 14, a distance h1 between the plane of set height and the tip end position of the offset 1*d*, as shown in FIG. 14. The calculated distance h1 is then output to the input limit value calculating portion 7*p*.

The input limit value calculating portion 7*p* calculates an input limit value u1 based on the distance h1 thus determined and the preset calculation formula for speed reduction control. In the input limit value calculating portion 7*p*, the relationship between the distance h1 and the limit value u1 is set such that the unit value u1 is reduced as the distance h1 to the height set plane reduces, i.e., as the tip end of the offset 1*d* comes closer to the height set plane, and then becomes nil (0) when the tip end of the offset id reaches the height set plane. With the relationship so set, the limit value u1 is made nil (0) at the height set plane and the boom 1*a* is stopped there.

The minimum value selecting portion 7*e* compares the input signal from the control lever unit 4*a*, the input limit value u from the first input limit value calculating portion 7*b* for the boom and the limit value u1 from the second input limit value calculating portion 7*p* for the boom, and selects a minimum value of them so that the input signal will not exceed the limit value u or u1.

The remaining functions of the control unit are the same as in the first embodiment.

The operation of this embodiment constructed as described above will be described below.

As with the first embodiment, let consider several examples of work, i.e., (a) where the arm 1*b* is operated toward the operator (rearward of the vehicle body, namely, in the arm crowding direction) so that the front device 1A approaches the cap 3*h* from the front, (b) where the boom 1*a* is operated upward, (c) where the arm 1*b* is operated toward the operator while the boom 1*a* is operated upward, and (d) where the offset 1*d* is operated to the left. The operations in these examples of work are the same as in the first embodiment except the following points.

More specifically, in the above operations of (b) and (c), as the tip end of the offset id approaches the height set plane, the distance h1 to the height set plane calculated by the height limit calculating device 7L is shortened. As a result, the limit value u1 calculated by the input limit value calculating portion 7*p* is gradually reduced and comes close to nil (0). Then, when that limit value u1 is selected by the minimum value selecting portion 7*e*, a speed at which the boom 1*a* moves upward is gradually reduced. When the tip end of the offset 1*d* reaches the height set plane, the distance h1 becomes nil (0) and, correspondingly, the limit value u1 is also made nil (0) to stop the boom 1*a*.

On that occasion, with a decrease in the distance h1, the command value for the boom extension side that is input to the multiplier 7*i* is reduced, whereupon the speed increase command value for the arm 1*b* calculated by the multiplier 7*i* is also reduced and an increase in the speed at which the arm 1*b* moves forward is gradually reduced. When the distance h1 becomes nil (0), the command value for the boom extension side that is input to the multiplier 7*i* is made nil (0) and, therefore, an output of the multiplier 7*i* becomes nil (0). As a result, the arm 1*b* moving forward so far along the boundary L of the interference prevention area (corresponding to points of r=0) is also stopped.

Accordingly, even if there is an obstacle or the like above the hydraulic excavator, it is possible to operate the front device 1A safely and prevent the front device 1A from interfering with the cab.

As described above, this embodiment can provide an advantage below in addition to the advantages obtainable with the first embodiment.

When the boom 1*a* is operated upward, the boom 1*a* is gradually slowed down as the tip end of the offset 1*d* approaches the height set plane, and is stopped at the time the tip end of the offset 1*d* reaches the height set plane. Therefore, even if the interference avoidance control is performed while allowing the boom to continue to move upward, the boom and the arm can be surely stopped at the set plane.

Consequently, even in the vicinity of the cab 3*h*, the front device 1A can continuously perform such work as lifting earth and sand without being stopped, resulting in a wide work area. Further, even in work sites where there is an obstacle or the like above the hydraulic excavator, it is possible to move the front device 1A safely and perform the interference avoidance control in the above operations of (b) and (c) without reducing the working efficiency.

Variation 1 of Fourth Embodiment

Figure 15:
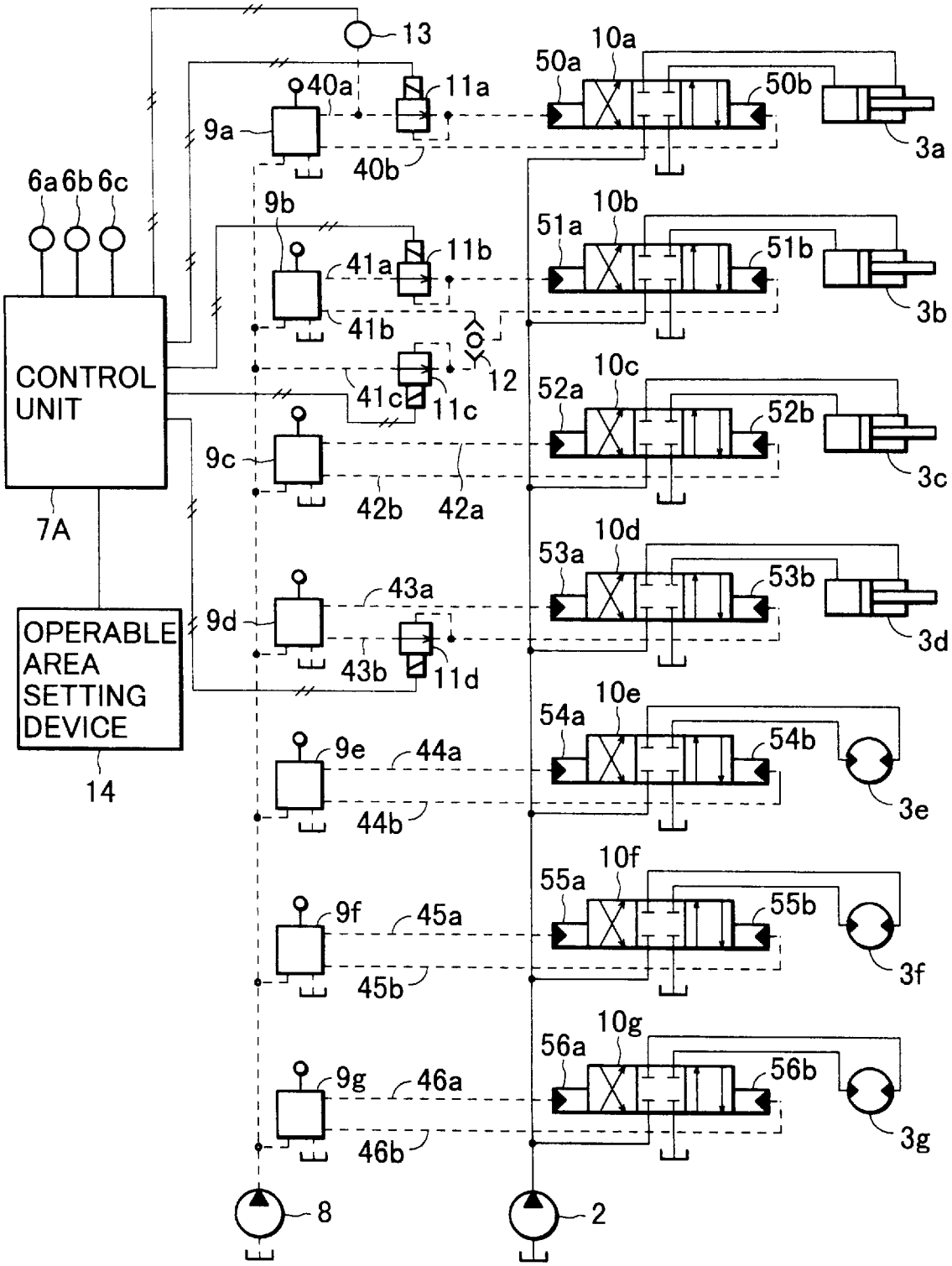
FIG. 15 is a diagram showing an interference preventing system for a hydraulic excavator according to one variation of the fourth embodiment of the present invention, along with a hydraulic circuit thereof.
Figure 16:
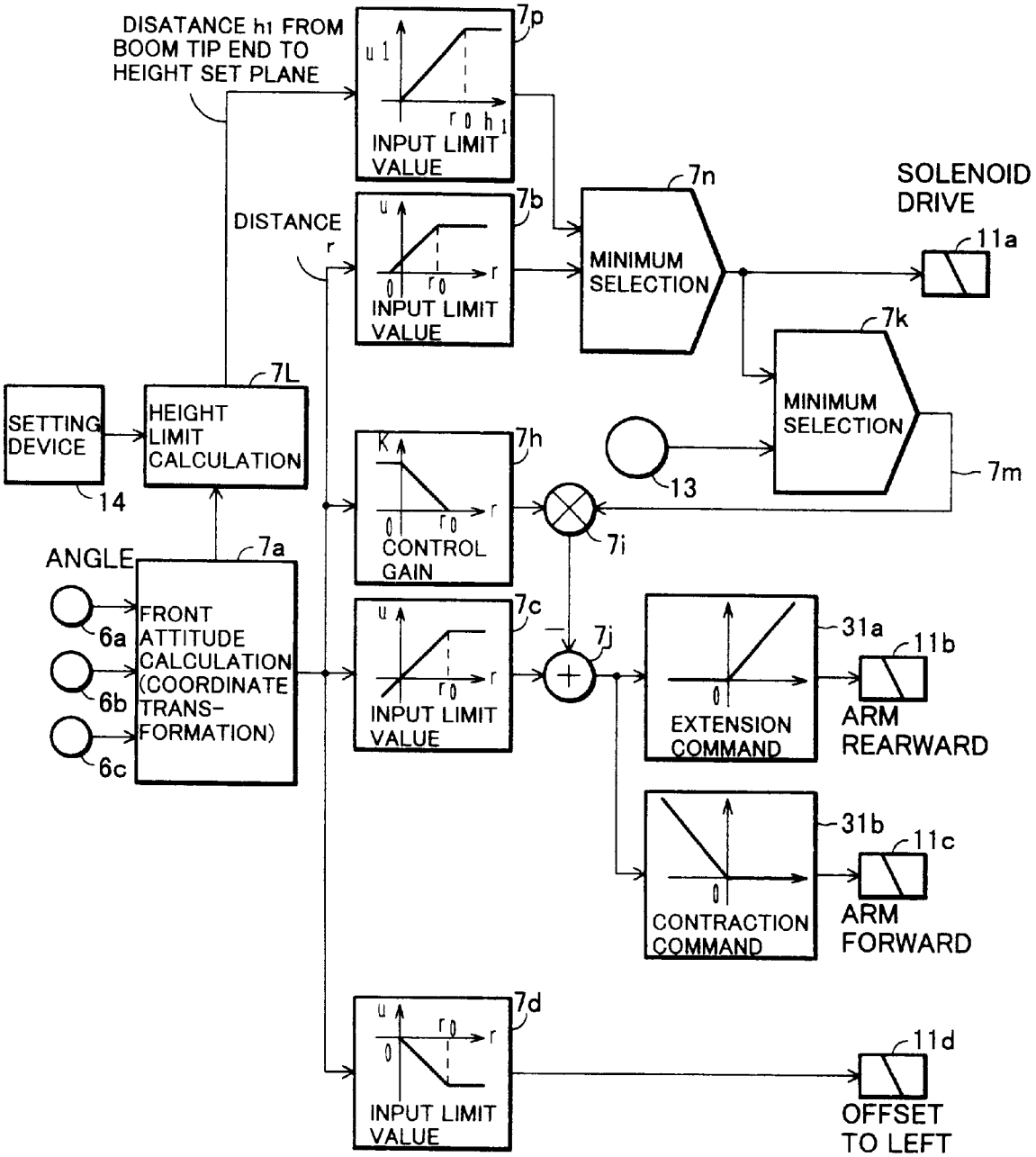
FIG. 16 is a functional block diagram showing control functions of a control unit.

One variation of the fourth embodiment of the present invention will be described with reference to FIGS. 15 and 16. In this variation, the concept of the fourth embodiment is applied to a hydraulic excavator employing control lever units of hydraulic pilot type, as with the second embodiment. In FIGS. 15 and 16, equivalent members and functions to those in FIGS. 7, 8, 12 and 13 are denoted by the same reference numerals.

Referring to FIG. 15, an interference preventing system of this variation is the same as shown in FIG. 7 except that the operable area setting device 14 is added.

Referring to FIG. 16, control functions of the control unit 7 are the same as shown in FIG. 8 except that the height limit calculating device 7L, the input limit value calculating portion 7*p* and a minimum value selecting portion 7*n* are added, and except signals to be selected by the minimum value selecting portion 7*k*.

The minimum value selecting portion 7*n* selects smaller one of an output of the input limit value calculating portion 7*p* and an output of the input limit value calculating portion 7*b*, and minimum value selecting portion 7*k* selects smaller one of an output of the pressure sensor 13 for detecting the pilot pressure determined by the input amount from the control lever unit 9*a* and an output of the minimum value selecting portion 7*n*. Here, the result selected by the minimum value selecting portion 7*n* is to predict a pilot pressure acting upon the hydraulic driving sector 50*a* on the boom-up (extension) side.

The operation of this variation constructed as described above will be described below.

As with the first and second embodiments, let consider several examples of work, i.e., (a) where the arm 1*b* is operated toward the operator (rearward of the vehicle body, namely, in the arm crowding direction) so that the front device 1A approaches the cap 3*h* from the front, (b) where the boom 1*a* is operated upward, (c) where the arm 1*b* is operated toward the operator while the boom 1*a* is operated upward, and (d) where the offset 1*d* is operated to the left. The operations in these examples of work are the same as in the second embodiment except the following points.

More specifically, in the above operations of (b) and (c), as the tip end of the offset 1*d* approaches the height set plane, the distance h1 to the height set plane calculated by the height limit calculating device 7L is shortened. As a result, the limit value u1 calculated by the input limit value calculating portion 7*p* is gradually reduced and comes close to nil (0). Then, when that limit value u1 is selected by the minimum value selecting portion 7*n*, a speed at which the boom 1*a* moves upward is gradually reduced through the proportional solenoid pressure reducing valve 11*a*. When the tip end of the offset 1*d* reaches the height set plane, the distance h1 becomes nil (0) and, correspondingly, the limit value u1 is also made nil (0) to stop the boom 1*a*.

On that occasion, with a decrease in the distance h1, the command value for the boom extension side that is input to the multiplier 7*i* is reduced, whereupon the speed increase command value for the arm 1*b* calculated by the multiplier 7*i* is also reduced and an increase in the speed at which the arm 1*b* moves forward is gradually reduced through the proportional solenoid pressure reducing valve 11*a*. When the distance h1 becomes nil (0), the command value for the boom extension side that is input to the multiplier 7*i* is made nil (0) and, therefore, an output of the multiplier 7*i* becomes nil (0). As a result, the arm 1*b* moving forward so far along the boundary L of the interference prevention area (corresponding to points of r=0) is also stopped.

Accordingly, even if there is an obstacle or the like above the hydraulic excavator, it is possible to operate the front device 1A safely and prevent the front device 1A from interfering with the cab.

As described above, with this variation, similar advantages as with the fourth embodiment can also be provided in a hydraulic excavator employing control lever units of hydraulic pilot type.

Variation 2 of Fourth Embodiment

Another variation of the fourth embodiment of the present invention will be described with reference to FIG. 17.

While the limitation of the operable area in the height direction is effected by observing the height of the tip end of the offset 1*d* in the foregoing fourth embodiment and one variation thereof, this variation is modified to include a third input limit value calculating portion 7*p*A for the boom 1*b* in addition to the variation shown in FIGS. 15 and 16, and observe both the distance h1 from the tip end of the offset 1*d* to the height set plane and a distance h2 from the tip end of the arm 1*b* to the height set plane as shown in FIG. 14.

Figure 17:
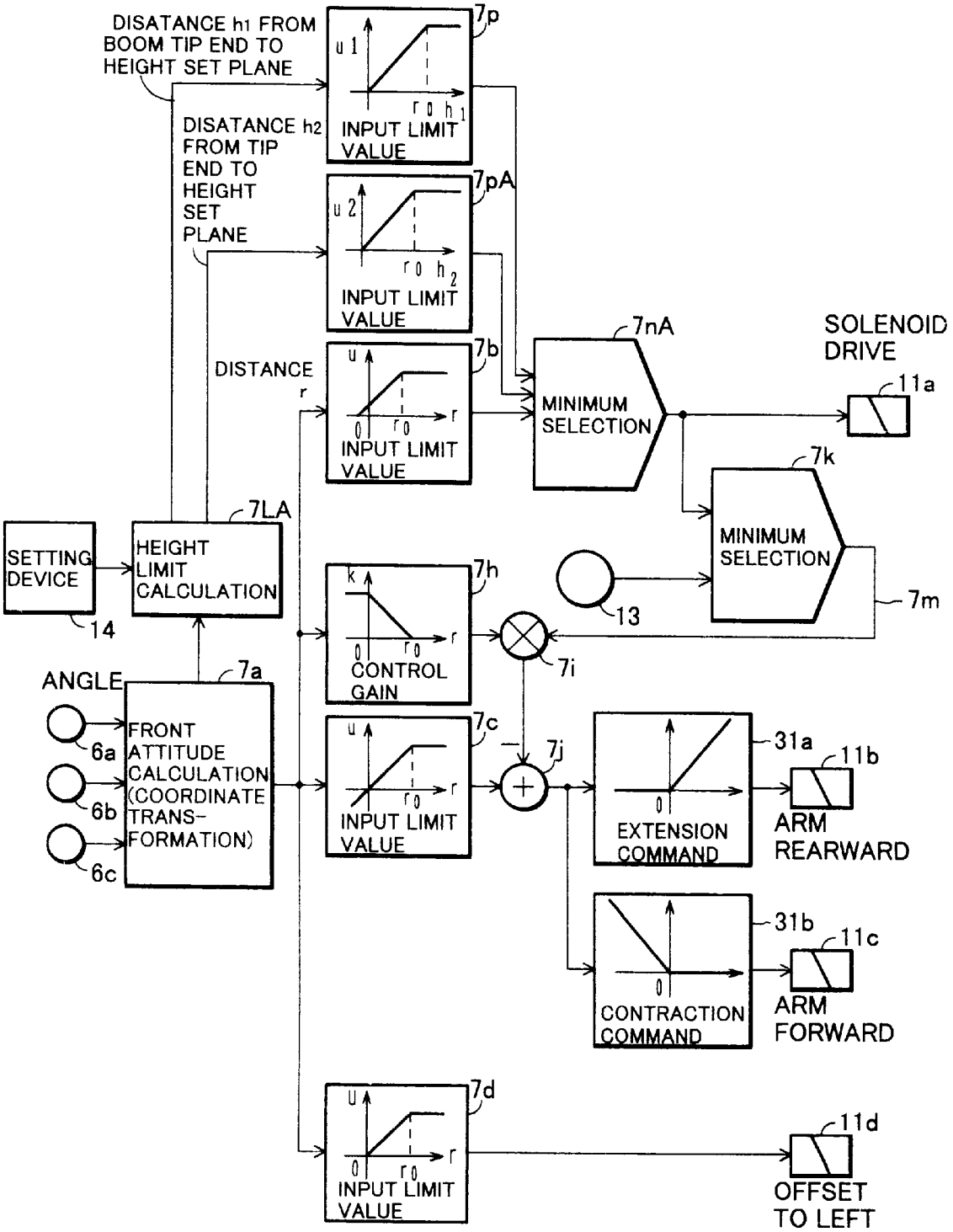
FIG. 17 is a functional block diagram showing control functions of a control unit according to another variation of the fourth embodiment of the present invention.

More specifically, in FIG. 17, a height limit calculating device 7LA calculates both the distance h1 from the tip end of the offset 1*d* to the height set plane and the distance h2 from the tip end of the arm 1*b* to the height set plane. Then, the calculated distance h2 is supplied to the input limit value calculating portion 7*p*A which calculates a limit value u2 based on the preset calculation formula such that the arm moving speed is limited to a smaller value as the distance h2 reduces, and then stopped at the height set plane.

The limit values u1, u2 are input to the minimum value selecting portion 7*n*A. Then, the operations of moving the boom upward and moving the boom upward are stopped in accordance with distance information on which one of the tip end of the offset 1*d* and the tip end of the arm 1*b* that has come close to the height set plane at an earlier time.

As described above, with this variation, similar advantages as with the fourth embodiment can also be provided in a hydraulic excavator employing control lever units of hydraulic pilot type.

In addition, according to this variation, since the front device is slowed down and stopped in accordance with distance information on which one of the tip end of the offset 1*d* and the tip end of the arm 1*b* that has come close to the height set plane at an earlier time, it is possible, even in work sites where there is an obstacle or the like above the hydraulic excavator, to move the front device 1A more safely and perform the interference avoidance control in the above operations of (b) and (c) without reducing the working efficiency.

Fifth Embodiment

A fifth embodiment of the present invention will be described with reference to FIGS. 18 to 20. In these figures, equivalent members and functions to those in FIGS. 1 and 4 are denoted by the same reference numerals. This embodiment intends to minimize an amount by which the tip end of the front device enters the interference prevention area during the process of the foregoing interference avoidance control, regardless of change in a factor affecting the operating characteristics of the front device.

Figure 18:
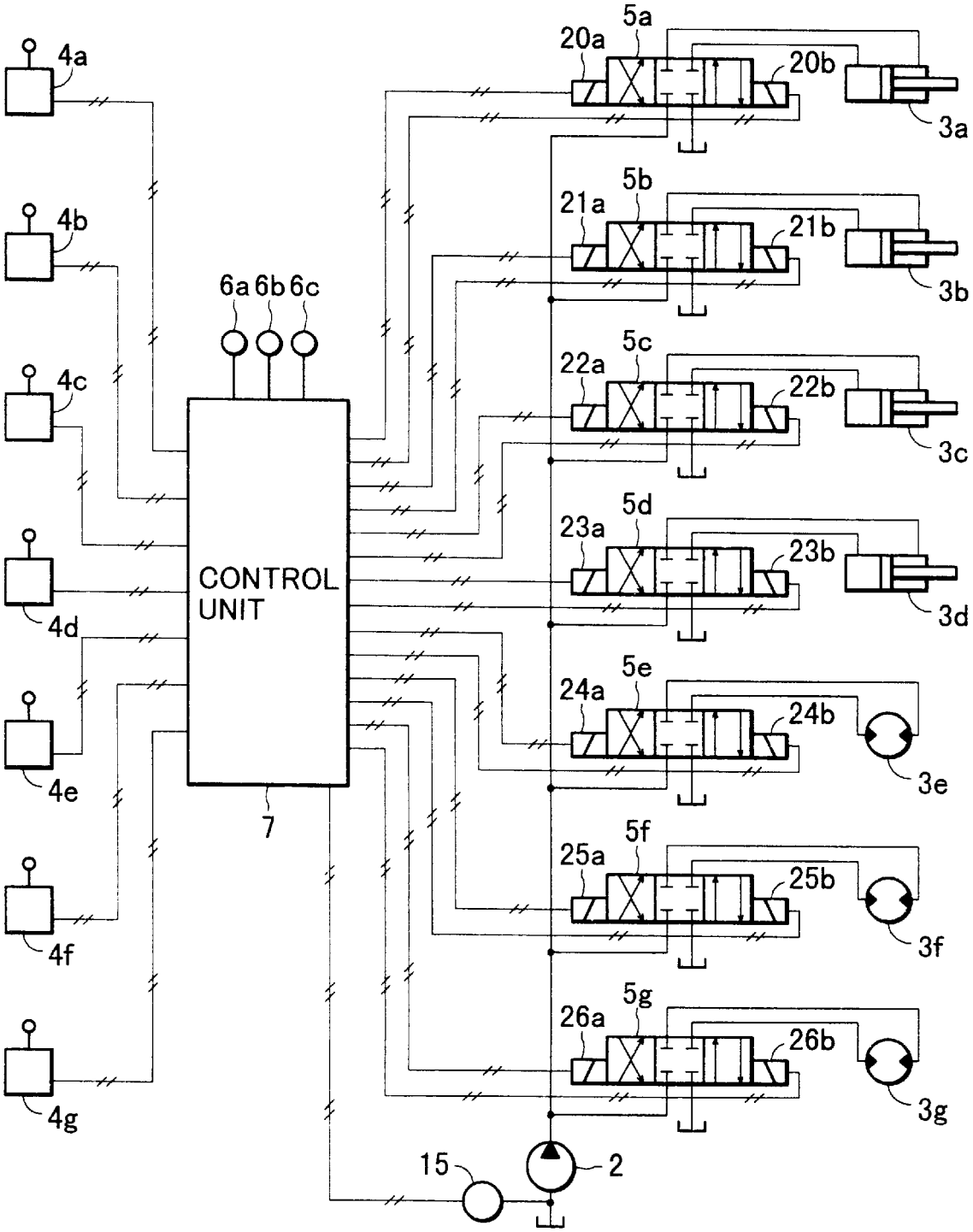
FIG. 18 is a diagram showing an interference preventing system for a hydraulic excavator according to a fifth embodiment of the present invention, along with a hydraulic circuit thereof.

Referring to FIG. 18, an interference preventing system of this embodiment includes a fluid temperature sensor 15 for detecting, as a factor affecting the operating characteristics of the front device, a fluid temperature in the hydraulic circuit, and a signal from the fluid temperature sensor 15 is also input to the control unit 7.

Figure 19:
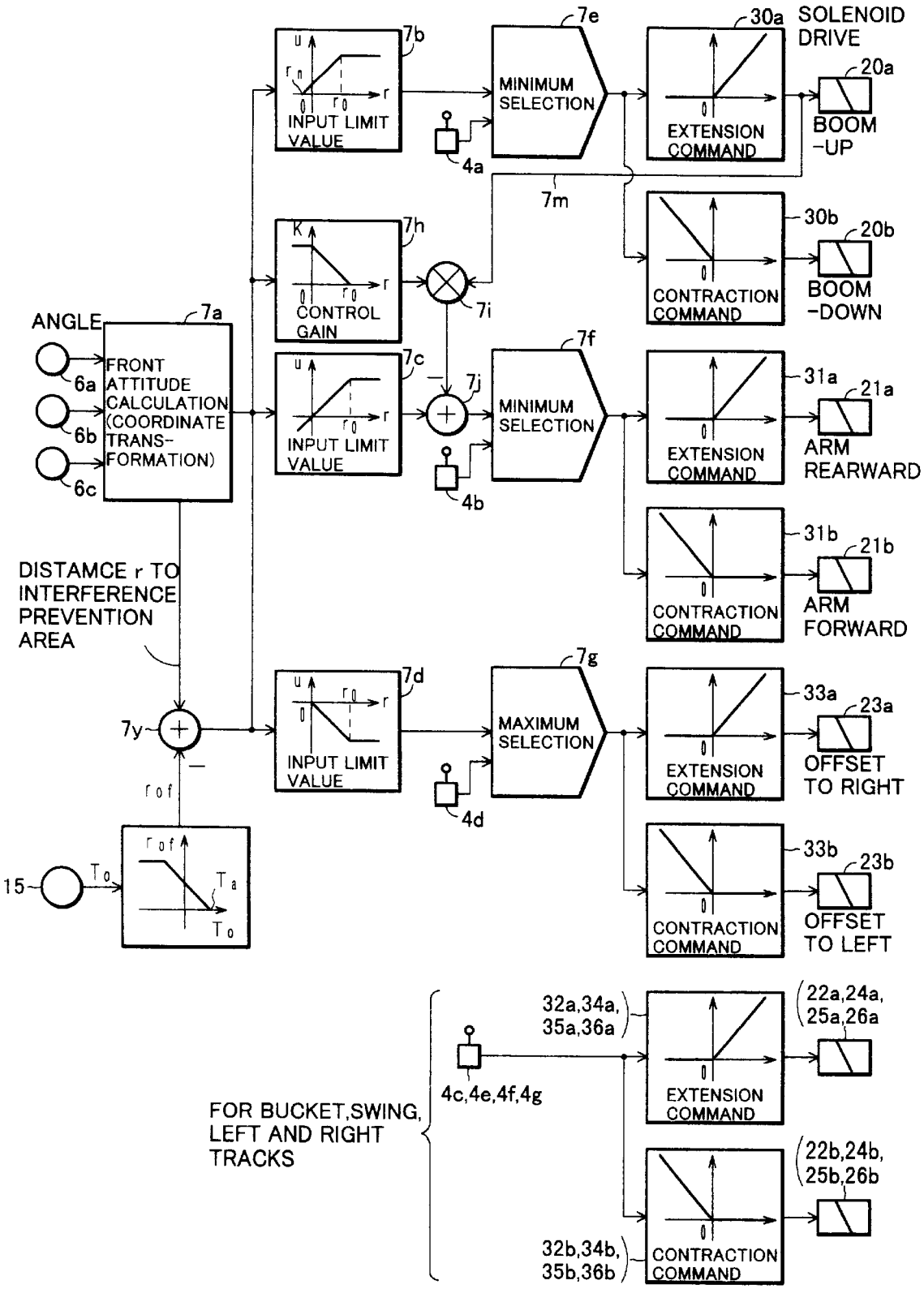
FIG. 19 is a functional block diagram showing control functions of a control unit.
Figure 20A:
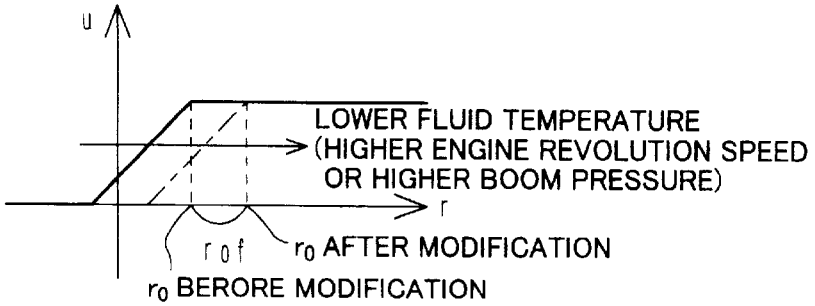
FIGS. 20A–20D are graphs showing changes in the control start distance resulted from distance modification.
Figure 20B:
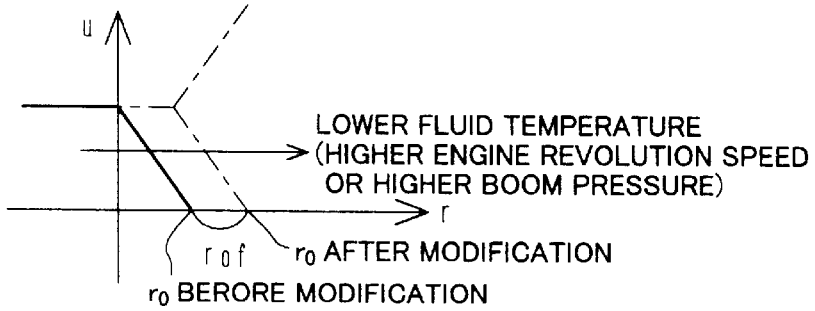
Figure 20C:
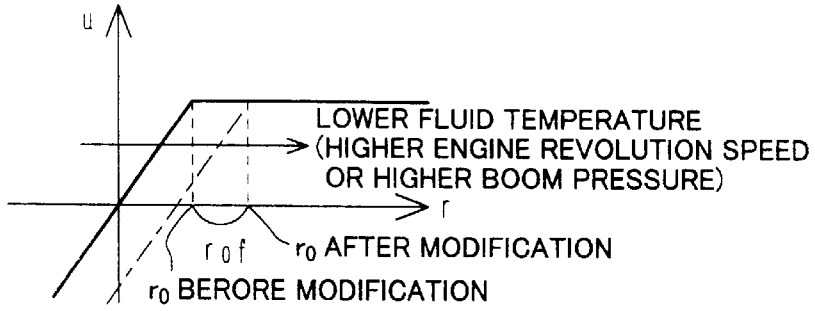
Figure 20D:
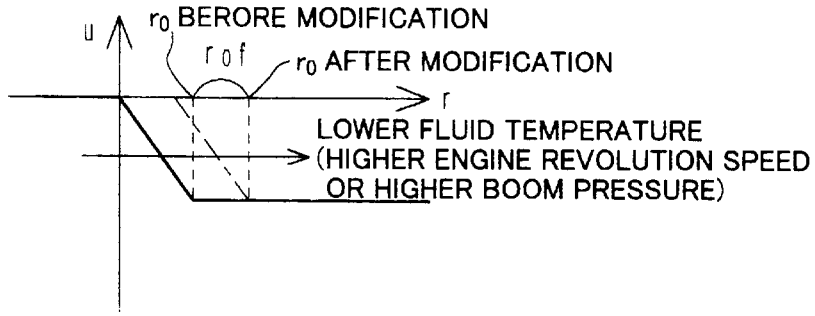

Control functions of the control unit 7 are shown in FIG. 19. In addition to the control functions of the control unit 7 shown in FIG. 4, the control unit 7 of this embodiment includes a portion 7*n* for calculating a modification value of the control start distance and an adder 7*y*.

As described above in connection with the first embodiment, the front attitude calculating portion 7*a* receives the rotational angles of the boom, the arm and the offset detected by the angle sensors 6*a*–6*c*, calculates a position of the tip end (monitoring point) of the front device 1A based on the input rotational angles through transformation of coordinate system, and then computes a distance r from the tip end position to the interference prevention area.

The control start distance modification value calculating portion 7*n* receives a fluid temperature To detected by the fluid temperature sensor 15 and calculates a modification value r0f of the control start distance r0 for use in the aforesaid calculating portions 7*b*–7*d* and 7*h* depending on the received fluid temperature To. In the calculating portion 7*n*, the modification value r0f is set such that it is nil (0) if the fluid temperature is not lower than a predetermined temperature Ta, e.g., 50° C., and is gradually increased up to a fixed value, e.g., 20 cm, if the fluid temperature becomes lower than and then decreases from the predetermined temperature Ta.

The adder 7*y* calculates a distance r after the modification by subtracting the modification value r0f calculated by the control start distance modification value calculating portion 7*n* from the distance r calculated by the front attitude calculating portion 7*a*. By so modifying the distance r, as shown in FIG. 20, the aforesaid calculating portions 7*b*–7*d* and 7*h* are modified in their respective characteristics such that the control start distance r0 is increased as the fluid temperature To lowers.

The remaining functions of the control unit are the same as in the first embodiment.

The operation of this embodiment constructed as described above will be described below.

As with the first embodiment, let consider several examples of work, i.e., (a) where the arm 1*b* is operated toward the operator (rearward of the vehicle body, namely, in the arm crowding direction) so that the front device 1A approaches the cap 3*h* from the front, (b) where the boom 1*a* is operated upward, (c) where the arm 1*b* is operated toward the operator while the boom 1*a* is operated upward, and (d) where the offset 1*d* is operated to the left. The operations in these examples of work are the same as in the first embodiment except the following points.

A hydraulic drive system for use in hydraulic construction machinery such as a hydraulic excavator has characteristics variable depending on change in the fluid temperature. A lower fluid temperature increases viscosity of the hydraulic fluid and delays a response of hydraulic equipment, resulting in a poor response of the entire control system.

In the control related to the present invention, if the fluid temperature lowers, a response of the hydraulic equipment is delayed and the operating characteristics of the front device 1A are changed, resulting in that the tip end of the front device is hard to promptly slow down, stop or speed up during the process of the foregoing interference avoidance control, and hence more likely to enter the interference prevention area.

More specifically, in the work (b) where the boom 1*a* is operated upward, although a speed reduction command for the boom 1*a* is output in accordance with the distance r from the tip end of the front device 1A to the interference prevention area, there occurs a delay until the hydraulic equipment actually responses and slows down the boom 1*a*, and although a command is output to the arm 1*b* to move it forward (in the dumping direction) in accordance with the distance r, there occurs a delay until the hydraulic equipment actually responses and moves the arm 1*b* forward. Therefore, the tip end of the front device 1A may enter the interference prevention area.

In the work (a) where the arm 1*b* is operated toward the operator (rearward of the vehicle body, namely, in the arm crowding direction), a response delay of the hydraulic equipment causes a delay in the speed reduction control executed by the calculating portion 7*c*. Therefore, the tip end of the front device 1A may enter the interference prevention area.

In the work (c) where the arm 1*b* is operated toward the operator while the boom 1*a* is operated upward, the tip end of the front device 1A may enter the interference prevention area as with the above case (b).

In the work (d) where the offset id is operated to the left, a response delay of the hydraulic equipment causes a delay in the speed reduction control executed by the calculating portion 7*d*. Therefore, the tip end of the front device 1A may enter the interference prevention area.

With the above in mind, this embodiment is designed to detect a fluid temperature by the fluid temperature sensor 15 and modify, in a combination of the control start distance modification value calculating portion 7*n* and the adder 7*y*, the distance r such that the control start distance r0 for use in the calculating portions 7*b*–7*d* and 7*h* is increased as the fluid temperature lowers from the predetermined temperature Ta. This arrangement operates as follows. In the work (b) where the boom 1*a* is operated upward, when the fluid temperature lowers from the predetermined temperature Ta, the limit values u calculated by the calculating portions 7*b*, 7*c* are made smaller to output the speed reduction commands for the boom 1*a* and the arm 1*b* at an earlier time with respect to the distance r. Simultaneously, the control gain K calculated by the calculating portion 7*h* is raised up to output the command for moving the arm 1*b* forward at an earlier time with respect to the distance r. Thus, since the speed reduction commands for the boom and the arm and the command for moving the arm forward (in the dumping direction) are output at the larger distance r, the tip end of the front device 1A can be prevented from entering the interference prevention area.

In the work (c), the interference prevention control is performed in a similar manner as above.

In the work (a) where the arm 1*b* is operated toward the operator, when the fluid temperature lowers from the predetermined temperature Ta, the limit value u calculated by the calculating portion 7*c* is made smaller to output the speed reduction command for the arm 1*b* at an earlier time with respect to the distance r. As a result, the tip end of the front device 1A can be prevented from entering the interference prevention area.

In the work (d) where the offset 1*d* is operated to the left, when the fluid temperature lowers from the predetermined temperature Ta, the limit value u calculated by the calculating portion 7*d* is made smaller to output the speed reduction command for the offset id at an earlier time with respect to the distance r. As a result, the tip end of the front device 1A can be prevented from entering the interference prevention area.

As described above, this embodiment can provide an advantage below in addition to the advantages obtainable with the first embodiment.

With this embodiment, even when work is to be carried out at a relatively low fluid temperature as experienced in the winter or cold districts, the tip end of the front device 1A can be surely prevented from entering the interference prevention area during the processes of not only the interference avoidance control for the boom and the arm, but also the speed reduction and stop control for the offset.

Variation 1 of Fifth Embodiment

Figure 21:
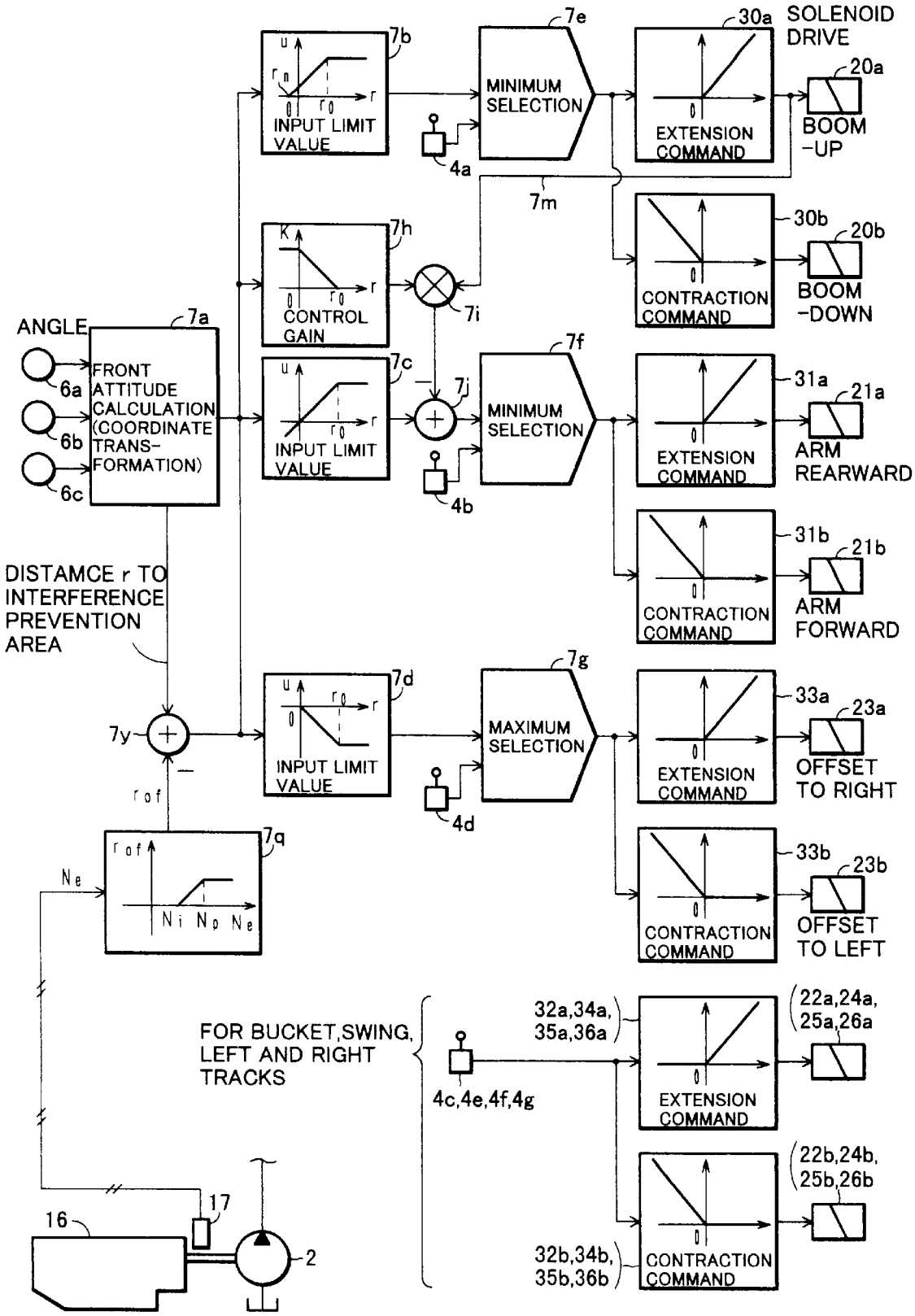
FIG. 21 is a functional block diagram showing control functions of a control unit in an interference preventing system for a hydraulic excavator according to one variation of the fifth embodiment of the present invention.
Figure 22:
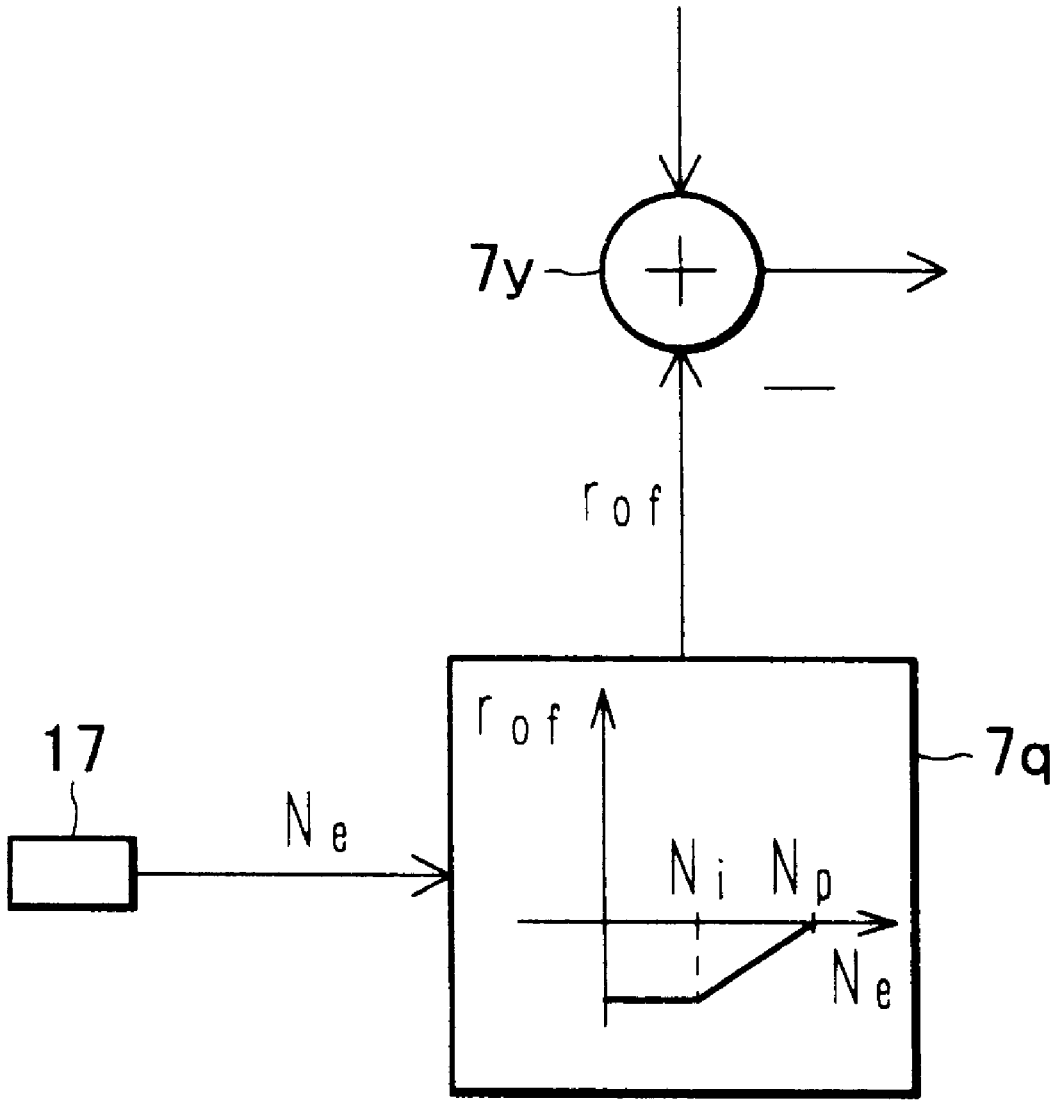
FIG. 22 is a diagram showing a variation of a control start distance modification value calculating portion.

One variation of the fifth embodiment of the present invention will be described with reference to FIGS. 21 and 22. While the fluid temperature is detected as a factor affecting the operating characteristics of the front device in the above fifth embodiment, this variation is modified to detect, as such a factor, a revolution speed of a prime mover for driving the hydraulic pump. In FIGS. 21 and 22, equivalent members and functions to those in FIGS. 1, 4, 18 and 19 are denoted by the same reference numerals.

Referring to FIG. 21, the hydraulic pump 2 is connected to and driven by an engine 16 for rotation. The engine 16 is provided with a revolution speed sensor 17 for detecting a revolution speed of the engine 16, and a signal from the revolution speed sensor 17 is input to a portion 7*q* for calculating a modification value of the control start distance in the control unit 7 (see FIG. 18). The calculating portion 7*q* calculates a modification value r0f of the control start distance r0 for use in the aforesaid calculating portions 7*b*–7*d* and 7*h* depending on the engine revolution speed Ne input thereto. In the calculating portion 7*q*, the modification value r0f is set such that it is nil (0) if the engine revolution speed Ne is not higher than a relatively low predetermined revolution speed Ni, e.g., an idling revolution speed of 700 rpm, it is gradually increased up to a fixed value, e.g., 20 cm, if the engine revolution speed Ne becomes higher than and then rises from the predetermined revolution speed Ni, and it is kept at the fixed value if the engine revolution speed Ne reaches and exceeds a relatively high predetermined revolution speed Np, e.g., 2000 rpm.

The adder 7*y* calculates a distance r after the modification by subtracting the modification value r0f calculated by the control start distance modification value calculating portion 7*q* from the distance r calculated by the front attitude calculating portion 7*a*. By so modifying the distance r, as with the fifth embodiment shown in FIG. 20, the aforesaid calculating portions 7*b*–7*d* and 7*h* are modified in their respective characteristics such that the control start distance r0 is increased as the engine revolution speed Ne rises.

A hydraulic drive system for use in hydraulic construction machinery such as a hydraulic excavator has characteristics variable depending on change in the revolution speed of the engine 16. Specifically, change in the revolution speed of the engine 16 varies a maximum delivery rate of the hydraulic pump 2 and hence a maximum flow rate of the hydraulic fluid usable. In particular, when the engine revolution speed becomes high, a flow rate of the hydraulic fluid is increased and an operating speed of the front device is raised in its entirety. Such a rise in the operating speed of the front device 1A results in that the tip end of the front device is hard to promptly slow down, stop or speed up during the process of the interference avoidance control in the foregoing work examples (a) to (d), and hence more likely to enter the interference prevention area, as with the above case of the fluid temperature being raised.

With the above in mind, this variation is designed to detect a revolution speed of the engine 16 by the revolution speed sensor 17 and modify, in a combination of the control start distance modification value calculating portion 7*q* and the adder 7*y*, the distance r such that the control start distance r0 for use in the calculating portions 7*b*–7*d* and 7*h* is increased as the engine revolution speed rises from the predetermined revolution speed Ni. This arrangement operates as follows. In the work (b) where the boom 1*a* is operated upward, when the engine revolution speed Ne exceeds the predetermined revolution speed Ni, the limit values u calculated by the calculating portions 7*b*, 7*c* are made smaller to output the speed reduction commands for the boom 1*a* and the arm 1*b* at an earlier time with respect to the distance r. Simultaneously, the control gain K calculated by the calculating portion 7*h* is raised up to output the command for moving the arm 1*b* forward at an earlier time with respect to the distance r. Thus, since the speed reduction commands for the boom and the arm and the command for moving the arm forward (in the dumping direction) are output at the larger distance r, the tip end of the front device 1A can be prevented from entering the interference prevention area.

In the work (c), the interference prevention control is performed in a similar manner as above.

In the work (a) where the arm 1*b* is operated toward the operator, when the engine revolution speed Ne exceeds the predetermined revolution speed Ni, the limit value u calculated by the calculating portion 7*c* is made smaller to output the speed reduction command for the arm 1*b* at an earlier time with respect to the distance r. As a result, the tip end of the front device 1A can be prevented from entering the interference prevention area.

In the work (d) where the offset 1*d* is operated to the left, when the engine revolution speed Ne exceeds the predetermined revolution speed Ni, the limit value u calculated by the calculating portion 7*d* is made smaller to output the speed reduction command for the offset 1*d* at an earlier time with respect to the distance r. As a result, the tip end of the front device 1A can be prevented from entering the interference prevention area.

In the calculating portion 7*q* shown in FIG. 21, the relationship between the engine revolution speed Ne and the modification value u0f may be set as shown in FIG. 22 rather than shown in FIG. 21. More specifically, the relationship therebetween is set in FIG. 22 such that the modification value u0f is a negative fixed value, e.g., −20 cm, if the engine revolution speed Ne is not higher than the relatively low predetermined revolution speed Ni, e.g., the idling revolution speed of 700 rpm, it is gradually increased up to nil (0) if the engine revolution speed Ne becomes higher than and then rises from the predetermined revolution speed Ni, and it is kept at nil (0) if the engine revolution speed Ne reaches and exceeds the relatively high predetermined revolution speed Np, e.g., 2000 rpm. Simultaneously, the initial value r0 of the control start distance for use in the calculating portions 7*b*–7*d* and 7*h* is set to a value, e.g., 50 cm, larger than in the above-mentioned case in conformity with characteristics required at a relatively high engine revolution speed. Such setting of the calculating portion 7*q* and the calculating portions 7*b*–7*d* and 7*h* can also provide the same result of modification of the speed reduction start distance as shown in FIG. 21, and hence similar advantages.

As described above, with this variation, the same interference avoidance control as in the first embodiment can be achieved and, in addition, even if the revolution speed of the engine for driving the hydraulic pump is changed, the tip end of the front device 1A can be surely prevented from entering the interference prevention area during the process of the interference avoidance control.

Variation 2 of Fifth Embodiment

Figure 23:
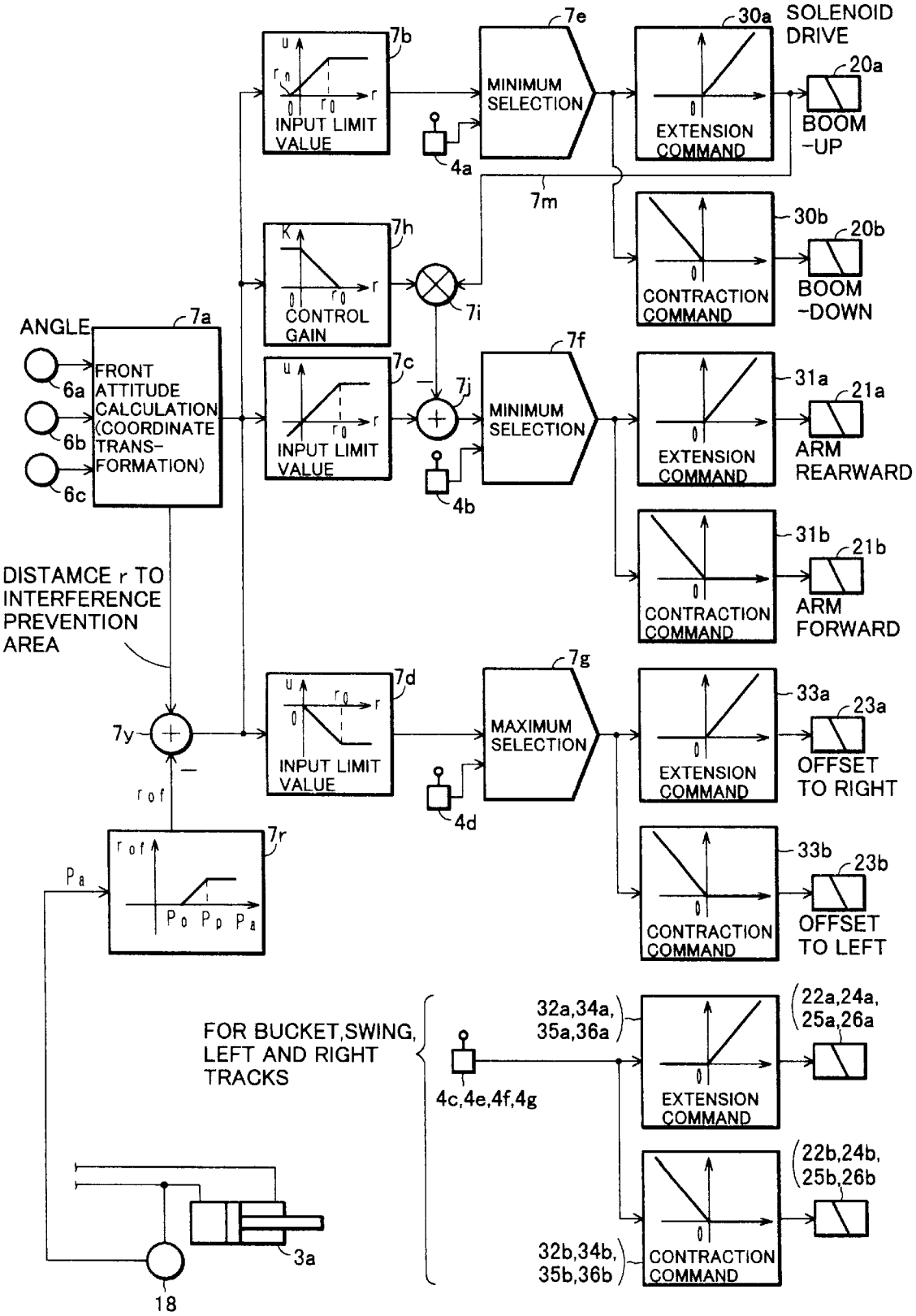
FIG. 23 is a functional block diagram showing control functions of a control unit in an interference preventing system for a hydraulic excavator according to another variation of the fifth embodiment of the present invention.

Another variation of the fifth embodiment of the present invention will be described with reference to FIG. 23. In this variation, a boom-up load pressure of the boom cylinder 3*a* is detected as a factor affecting the operating characteristics of the front device 1A. In FIG. 23, equivalent members and functions to those in FIGS. 1, 4, 18 and 19 are denoted by the same reference numerals.

Referring to FIG. 23, a pressure sensor 18 for detecting a boom-up load pressure Pa of the boom cylinder 3*a* is disposed in an actuator line connecting to the bottom side of the boom cylinder 3*a*, and a signal from the pressure sensor 18 is input to a portion 7*r* for calculating a modification value of the control start distance in the control unit 7 (see FIG. 18). The calculating portion 7*r* calculates a modification value r0f of the control start distance r0 for use in the aforesaid calculating portions 7*b*–7*d* and 7*h* depending on the boom-up load pressure Pa input thereto. In the calculating portion 7*r*, the modification value r0f is set such that it is nil (0) if the boom-up load pressure Pa is not higher than a relatively low predetermined pressure Po, it is gradually increased up to a fixed value, e.g., 20 cm, if the boom-up load pressure Pa becomes higher than and then rises from the predetermined pressure Po, and it is kept at the fixed value if the boom-up load pressure Pa reaches and exceeds a relatively high predetermined pressure Pp. The adder 7*y* calculates a distance r after the modification by subtracting the modification value r0f calculated by the control start distance modification value calculating portion 7*r* from the distance r calculated by the front attitude calculating portion 7*a*, and then outputs the calculated distance r to the calculating portions 7*b*–7*d* and 7*h*. By so modifying the distance r, as with the fifth embodiment shown in FIG. 20, the aforesaid calculating portions 7*b*–7*d* and 7*h* are modified in their respective characteristics such that the control start distance r0 is increased as the boom-up load pressure Pa rises.

When a load upon the front device 1A is enlarged, the inertia of the front device is increased, which results in that the tip end of the front device is hard to promptly slow down, stop or speed up during the process of the interference avoidance control in the foregoing work examples (a) to (d), and hence more likely to enter the interference prevention area.

Meanwhile, a larger load upon the front device 1A raises a load pressure on the boom-up side of the boom cylinder 3*a*. Therefore, a load upon the front device 1A can be detected by sensing the boom-up load pressure Pa.

With the above in mind, this variation is designed to detect a boom-up load pressure Pa by the pressure sensor 18 and modify, in a combination of the control start distance modification value calculating portion 7*r* and the adder 7*y*, the distance r such that the control start distance r0 for use in the calculating portions 7*b*–7*d* and 7*h* is increased as the boom-up load pressure Pa rises from the predetermined pressure Po. This arrangement operates as follows. In the work (b) where the boom 1*a* is operated upward, when the boom-up load pressure Pa exceeds the predetermined pressure Po, the limit values u calculated by the calculating portions 7*b*, 7*c* are made smaller to output the speed reduction commands for the boom 1*a* and the arm 1*b* at an earlier time with respect to the distance r. Simultaneously, the control gain K calculated by the calculating portion 7*h* is raised up to output the command for moving the arm 1*b* forward at an earlier time with respect to the distance r. Thus, since the speed reduction commands for the boom and the arm and the command for moving the arm forward are output at the larger distance r, the tip end of the front device 1A can be prevented from entering the interference prevention area.

In the work (c), the interference prevention control is performed in a similar manner as above.

In the work (a) where the arm 1*b* is operated toward the operator, when the boom-up load pressure Pa exceeds the predetermined pressure Po, the limit value u calculated by the calculating portion 7*c* is made smaller to output the speed reduction command for the arm 1*b* at an earlier time with respect to the distance r. As a result, the tip end of the front device 1A can be prevented from entering the interference prevention area.

In the work (d) where the offset 1*d* is operated to the left, when the boom-up load pressure Pa exceeds the predetermined pressure Po, the limit value u calculated by the calculating portion 7*d* is made smaller to output the speed reduction command for the offset 1*d* at an earlier time with respect to the distance r. As a result, the tip end of the front device 1A can be prevented from entering the interference prevention area.

As described above, with this variation, the same interference avoidance control as in the first embodiment can be achieved and, in addition, even if the load upon the front device is changed, the tip end of the front device 1A can be surely prevented from entering the interference prevention area during the process of the interference avoidance control.

Sixth Embodiment

A sixth embodiment of the present invention will be described with reference to FIGS. 24 to 26. In these figures, equivalent members and functions to those in FIGS. 1 and 4 are denoted by the same reference numerals. This embodiment intends to perform the above-described interference avoidance control without causing a hunting, regardless of change in a factor affecting the operating characteristics of the front device.

The construction of a hydraulic drive system in which this embodiment is employed, and the entire construction of an interference preventing system of this embodiment are both the same as those of the first embodiment shown in FIG. 1. The signals from the angle sensors 6*a*, 6*b*, 6*c* and the control lever units 4*a*–4*g* are input to the control unit 7.

Figure 24:
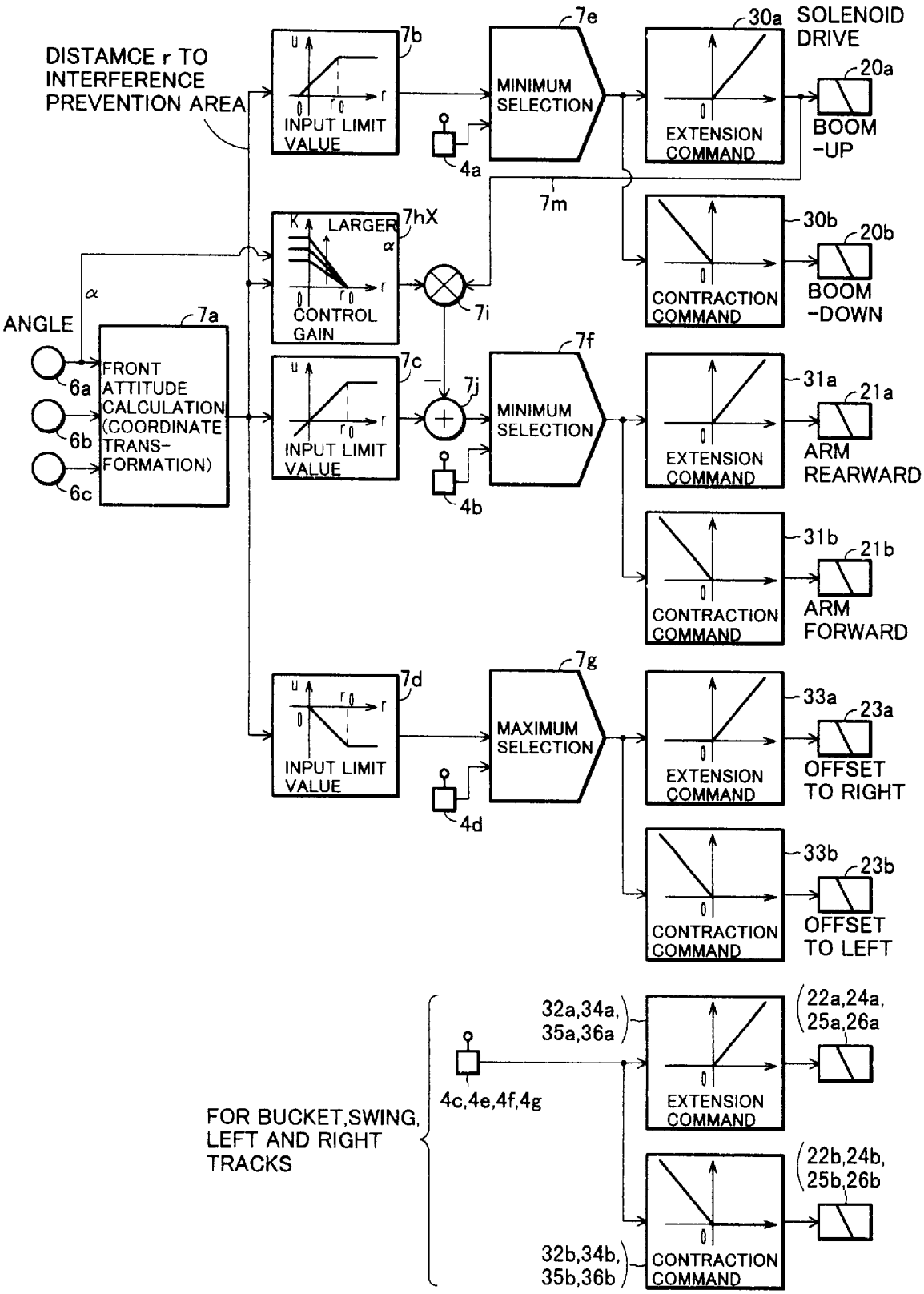
FIG. 24 is a functional block diagram showing control functions of a control unit in an interference preventing system for a hydraulic excavator according to a sixth embodiment of the present invention.

Control functions of the control unit 7 are shown in FIG. 24. The control unit 7 of this embodiment is the same as of the first embodiment except that a control gain calculating portion 7*h*X has a different function from the control gain calculating portion 7*h* shown in FIG. 4, The control gain calculating portion 7*h*X calculates a control gain K based on the distance r to the interference prevention area and the preset calculation formula. In the control gain calculating portion 7*c*, the relationship between the distance r and the control gain K is set such that if the distance r is larger than the control start distance r0, the control gain K is kept at nil (0); if the distance r is not larger than the control start distance r0, the control gain K is increased as the distance r reduces; and if the distance r is nil (0) or less, the control gain K takes a maximum fixed value.

Further, the control gain calculating portion 7*h*X receives the signal from the angle sensor 6*a* for detecting a rotational angle of the boom 1*a* (hereinafter referred to as a boom angle α), as a factor affecting the operating characteristics of the front device 1A, particularly, the operating characteristics thereof relating to the interference prevention control of the present invention, and then modifies the control gain K such that it takes a greater value at a larger boom angle α.

Figure 25:
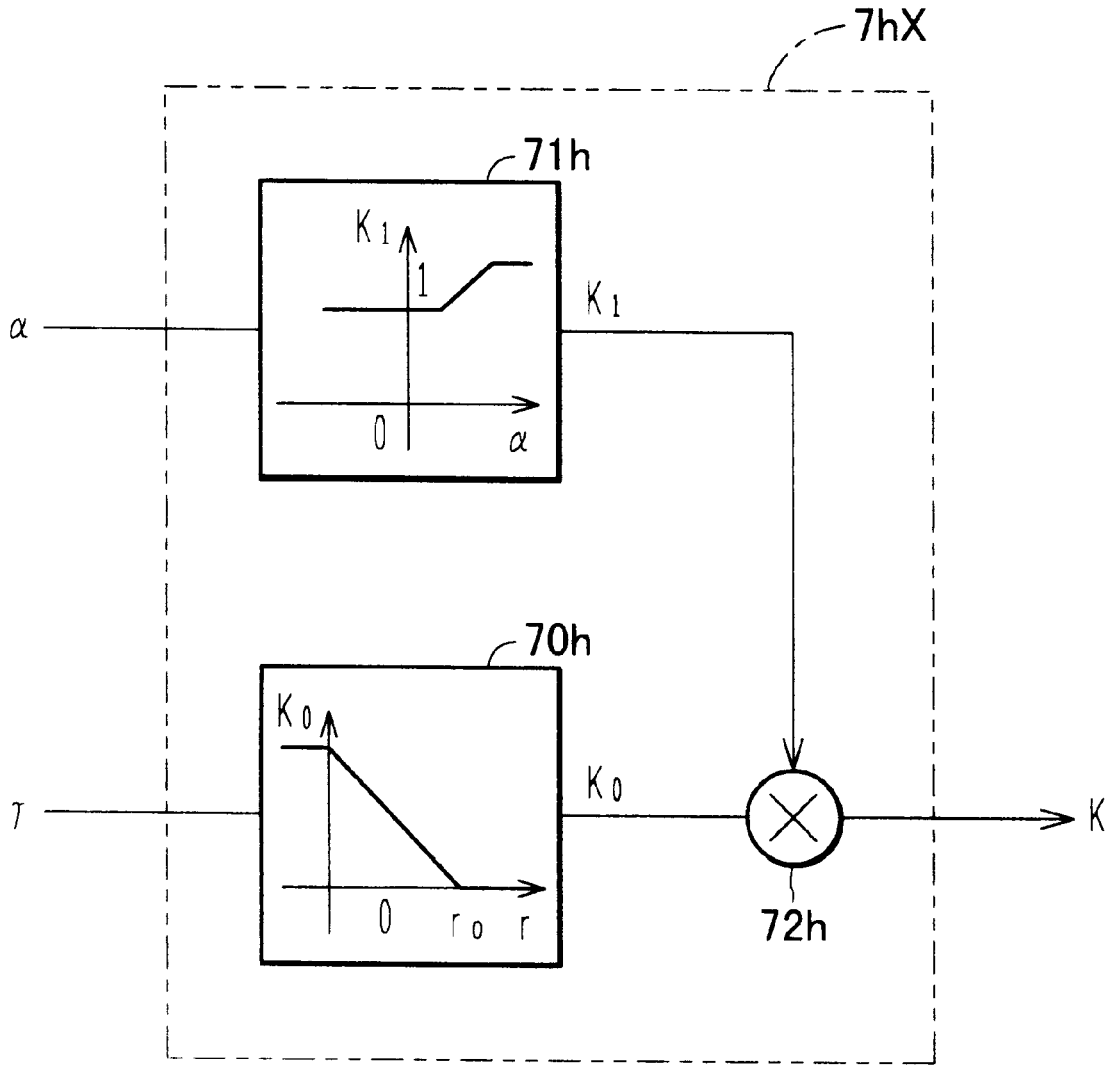
FIG. 25 is a functional block diagram showing details of a control gain calculating portion.

Details of the control gain calculating portion 7*h*X are shown in FIG. 25. The control gain calculating portion 7*h*X has functions executed by a function generator 70*h*, a function generator 71*h* and a multiplier 72*h*. The function generator 70*h* calculates a basic control gain Ko based on the distance r from the tip end of the front device to the interference prevention area. Here, the relationship between the distance r and the basic control gain Ko is set such that when the tip end of the front device is far away from the interference prevention area and the distance r is large, the gain K is nil (0), and as the tip end of the front device approaches the interference prevention area and the distance r comes close to nil (0), the gain K is increased. On the other hand, the function generator 71*h* calculates a modification coefficient K1 depending on the boom angle α. Here, the relationship between the boom angle α and the modification coefficient K1 is set such that when the boom angle α is small, the modification coefficient K1 is one (1), and as the boom angle α increases, the modification coefficient K1 is also increased. The multiplier 72*h* multiplies the basic control gain Ko calculated by the function generator 70*h* by the modification coefficient K1 calculated by the function generator 71*h*, thereby obtaining a control gain K. Thus, in the control gain calculating portion 7*h*X, the control gain K is modified such that as the boom angle α increases, the change rate (gradient of the function) of the control gain K with respect to the distance r is increased and the maximum value of the control gain K is also increased.

The operation of this embodiment constructed as described above will be described below.

As with the first embodiment, let consider several examples of work, i.e., (a) where the arm 1*b* is operated toward the operator (rearward of the vehicle body, namely, in the arm crowding direction) so that the front device 1A approaches the cap 3*h* from the front, (b) where the boom 1*a* is operated upward, (c) where the arm 1*b* is operated toward the operator while the boom 1*a* is operated upward, and (d) where the offset 1*d* is operated to the left. The operations in these examples of work are the same as in the first embodiment except the following points.

The operating characteristics of the front device 1A, particularly, the operating characteristics thereof relating to the interference prevention control performed as stated above, are variable depending on the boom angle α.

Figure 26:
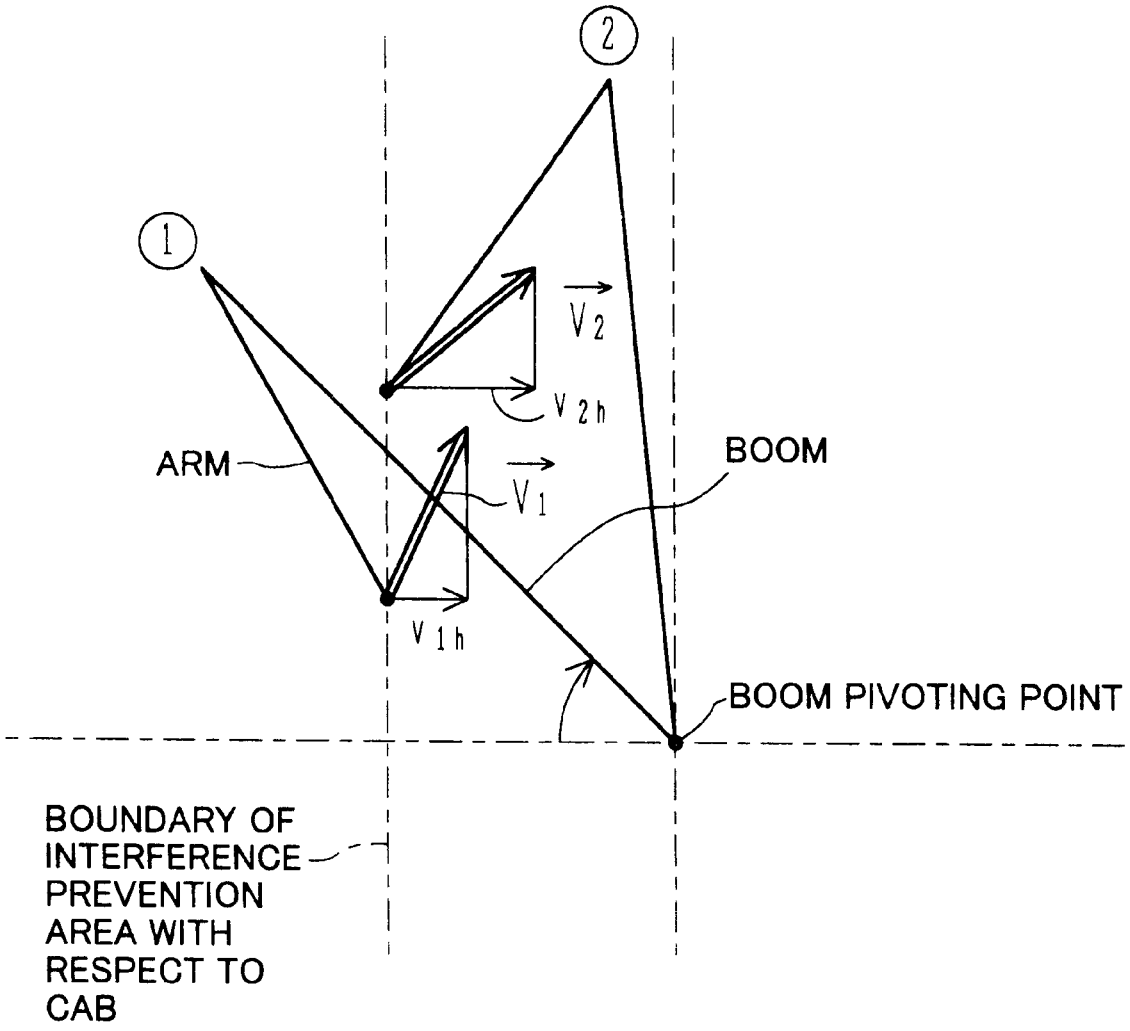
FIG. 26 is a diagram showing change in operating characteristics of the front device depending on change in a boom angle.

FIG. 26 shows change in the operating characteristics of the front device 1A depending on the boom angle α. In FIG. 26, (1) represents an attitude of the front device 1A in which the boom angle α is small and the tip end of the front device is positioned near the boundary of the interference prevention area, and (2) represents an attitude of the front device 1A in which the boom angle α is large and the tip end of the front device is positioned near the boundary of the interference prevention area. Also, vectors V1, V2 represent tip end speeds of the front device 1A provided respectively in the attitudes (1) and (2) depending on the rotation of the boom 1*a*. As will be seen from FIG. 26, in the attitudes (1) and (2), the vectors V1, V2 have the same magnitude, but horizontal components v1h, v2h of the vectors V1, V2, i.e., speeds at which the tip end of the front device 1A, positioning near the boundary of the interference prevention area around the cab, is caused to move toward the cab depending on the rotation of the boom 1*a*, is different from each other, i.e., v1h<v2h. Therefore, in the interference prevention control for the above case (b), the arm is required to move forward at a higher speed in the attitude (2) than in the attitude (1).

When the operator operates the boom 1*a* upward from a condition of the front device 1A being in the attitude (1), the tip end of the front device 1A is moved forward and going to enter the interference prevention area beyond the boundary thereof. On this occasion, according to the interference prevention control of the present invention for the above case (b), the arm 1*b* is automatically moved forward (in the dumping direction) so that the tip end of the front device will not enter the interference prevention area. Under such control, the tip end of the arm is allowed to move up substantially along the boundary of the interference prevention area. At this time, it is preferable that the upward movement of the boom and the forward movement of the arm are well balanced and the tip end of the arm moves up smoothly.

Specifically, to realize the interference avoidance control in such a manner, this embodiment carries out the control as follows. First, as mentioned above, the position of the tip end of the front device 1A and the distance r to the interference prevention area are always calculated from the signals of the angle sensors 6*a*–6*c* disposed on the front device 1A (by the calculating portion 7*a* in FIG. 24). Then, by using the distance r as a feedback value, a speed increase command value for the arm 1*b* in the dumping direction is calculated (by cooperation of the calculating portion 7*h*X, the multiplier 7*i*, and the adder 7*j* in FIG. 24) and the arm 1*b* is automatically moved forward (in the dumping direction) while the moving-up speed of the boom 1*a* is gradually reduced (through the calculating portion 7*b* of FIG. 24).

In this connection, it is required to meet the above demand that a speed reduction rate in the upward movement of the boom 1*a* with respect to the feedback value r (a change rate of the limit value u calculated in the calculating portion 7*b* with respect to the distance r, namely, a gradient (gain) of the function) and a speed increase rate in the forward movement of the arm 1*b* with respect to the feedback value r (a change rate of the control gain K calculated in the calculating portion 7*h*X with respect to the distance r, namely, a gradient (gain) of the function) are well balanced.

Suppose here that a gradient (gain) of the function in the calculating portion 7*b* and a gradient (gain) of the function in the calculating portion 7*h*X are set so as to establish a good balance in the attitude (1) shown in FIG. 26 between a speed reduction rate in the upward movement of the boom and a speed increase rate in the forward movement of the arm. In the attitude (2) shown in FIG. 26, however, because the speed v2h tending to move the tip end of the front device toward the cab is larger than the corresponding speed v1h in the attitude (1) and the arm is required to move forward at a higher speed than in the attitude (1) as mentioned above, the speed reduction rate in the upward movement of the boom 1*a* would be insufficient and the speed increase rate in the forward movement of the arm 1*b* would be insufficient. Therefore, the operation of speeding up the arm 1*b* in the dumping direction could not catch up with the speed at which the tip end of the front device is going to enter the interference prevention area upon the operation of moving the boom 1*a* upward, and the tip end of the front device would pass the boundary of the interference prevention area and enter the area until a position where u=0 is calculated by the calculating portion 7*b* in FIG. 24, and then stop in that position. After that, the arm 1*b* would be gradually moved forward to move the tip end of the front device out of the interference prevention area. Correspondingly, the boom 1*a* would start to move upward again, causing the tip end of the front device to enter the interference prevention area. Thereafter, the boom 1*a* would be stopped again in the position of u=0. With the above process repeated, there may occur a hunting.

In the work (c) where the arm 1*b* is operated in the crowding direction (rearward) while the boom 1*a* is operated upward, a hunting may also occur with the stop of the boom and the forward movement of the arm (in the dumping direction) alternately repeated, similarly to the above case (b).

Taking into account the above, in this embodiment, the change rate (gradient of the function) of the control gain K with respect to the distance r is modified such that it takes a greater value at a larger boom angle α. With this modification, when the boom 1*a* is operated upward in the work (b), a speed increase command value for the arm in the dumping direction (i.e., a target speed for the interference avoidance) is calculated by the multiplier 7*i* to gradually increase at a larger boom angle α and the operating speed of the arm 1*b* in the forward direction is increased. As a result, it is possible to retire the arm forward at an optimum speed depending on the boom angle α and to prevent a hunting.

In the work (c), a hunting is also prevented in a similar manner.

As described above, with this embodiment, the same advantages as obtainable with the first embodiment can be achieved. In addition, regardless of change in the boom angle α, the tip end of the front device 1A can be surely prevented from entering the interference prevention area during the process of the interference avoidance control, and a hunting resulted from the tip end of the front device entering the interference prevention area can also be prevented.

Variation 1 of Sixth Embodiment

Figure 27:
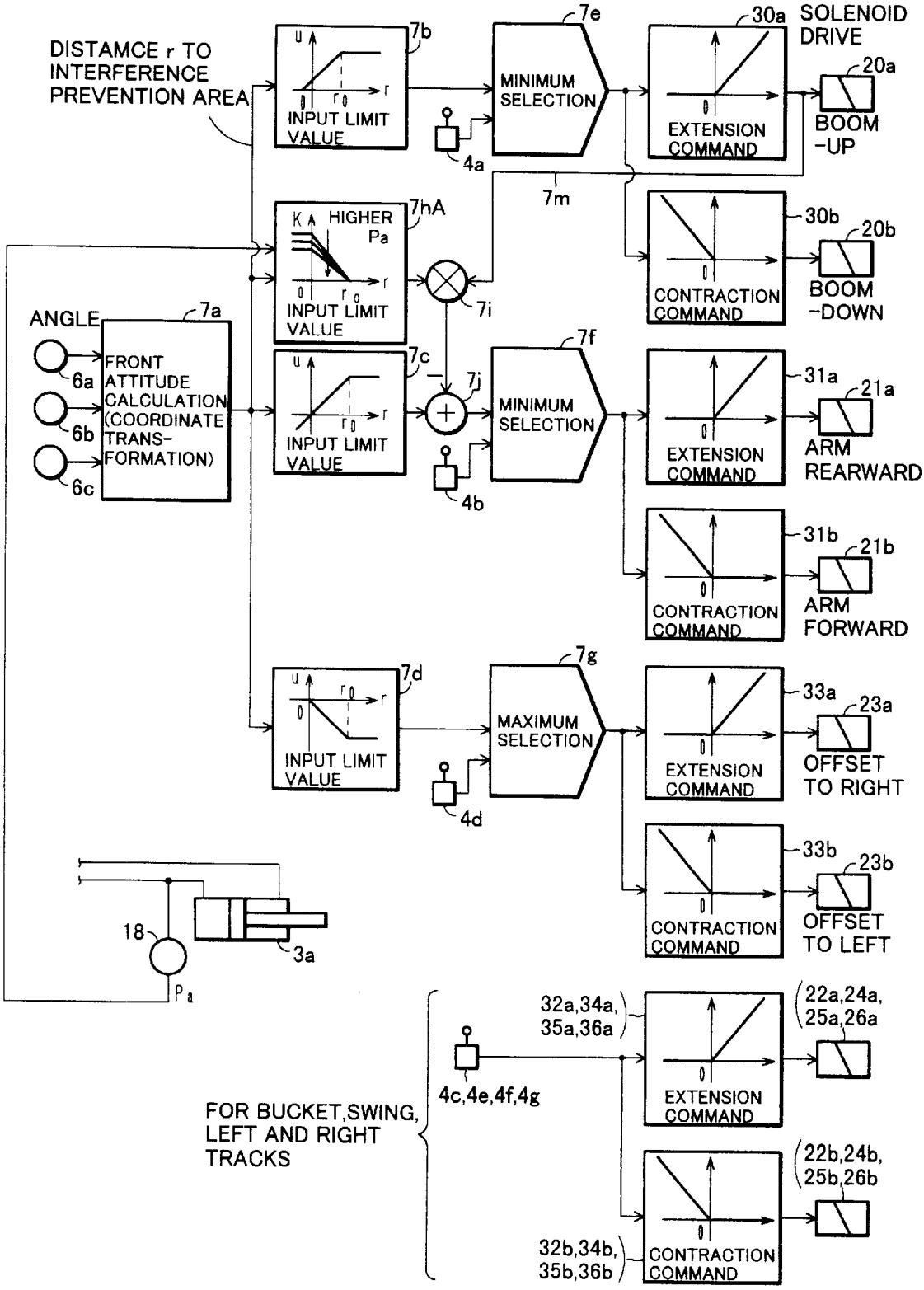
FIG. 27 is a functional block diagram showing control functions of a control unit in an interference preventing system for a hydraulic excavator according to one variation of the sixth embodiment of the present invention.
Figure 28:
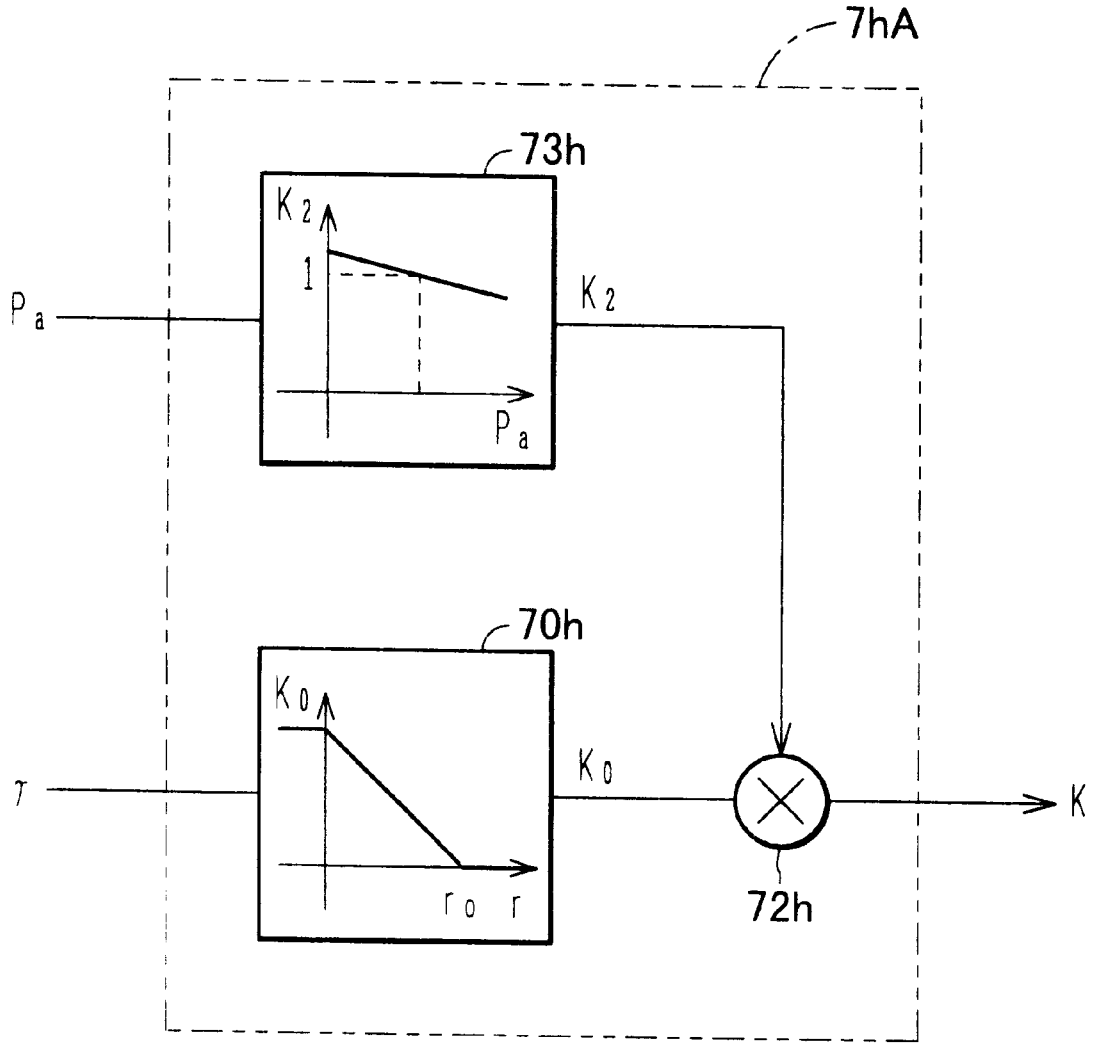
FIG. 28 is a functional block diagram showing details of a control gain calculating portion.

One variation of the sixth embodiment of the present invention will be described with reference to FIGS. 27 and 28. In this variation, a boom-up load pressure of the boom cylinder 3*a* is detected as a factor affecting the operating characteristics of the front device 1A. In FIGS. 27 and 28, equivalent members and functions to those in FIGS. 1, 4 and 24 are denoted by the same reference numerals.

Referring to FIG. 27, a pressure sensor 18 for detecting a boom-up load pressure Pa of the boom cylinder 3*a* is disposed in an actuator line connecting to the bottom side of the boom cylinder 3*a*, and a signal from the pressure sensor 18 is input to a control gain calculating portion 7*h*A in the control unit 7 (see FIG. 1).

The control gain calculating portion 7*h*A calculates a control gain K based on the distance r to the interference prevention area and the preset calculation formula as with the sixth embodiment, and further modifies the control gain K such that it takes a smaller value at a higher boom-up load pressure Pa input thereto.

Details of the control gain calculating portion 7*h*A are shown in FIG. 28. The control gain calculating portion 7*h*A has functions executed by a function generator 70*h*, a function generator 73*h* and a multiplier 72*h*. The function generator 70*h* calculates, as with the sixth embodiment, a basic control gain Ko based on the distance r from the tip end of the front device to the interference prevention area. The function generator 73*h* calculates a modification coefficient K2 depending on the boom-up load pressure Pa. Here, the relationship between the boom-up load pressure Pa and the modification coefficient K2 is set such that when the boom-up load pressure Pa is small, the modification coefficient K2 is not less than one (1), and as the boom-up load pressure Pa rises, the modification coefficient K2 is reduced and takes a value less than one (1). The multiplier 72*h* multiplies the basic control gain Ko calculated by the function generator 70*h* by the modification coefficient K2 calculated by the function generator 73*h*, thereby obtaining a control gain K. Thus, in the control gain calculating portion 7*h*A, the control gain K is modified such that as the boom-up load pressure Pa rises, the change rate (gradient of the function) of the control gain K with respect to the distance r is reduced and the maximum value of the control gain K is also reduced.

When a load upon the front device 1A is enlarged, the boom becomes less prompt in movement and the arm is moved at a higher speed than the boom during the process of the speed reduction and interference avoidance control in the above work examples (b) and (c).

More specifically, in a hydraulic excavator, a balance between flow rates of the hydraulic fluid supplied to the boom cylinder 3*a* and the arm cylinder 3*b* is changed depending on a load upon the front device 1A even with the input amounts of the control lever units (the openings of the flow control valves) remained the same. In particular, as the load increases, the hydraulic fluid tends to more easily flow to the arm 1*b* rather than the boom 1*a* which must bear a larger load.

Meanwhile, as described above in connection with the first embodiment, if a balance of the movements of the arm and the boom with respect to the distance r from the interference prevention area is lost, i.e., if adequate proportions of the speed reduction rate of the boom and the speed increase rate of the arm in the forward direction with respect to the distance r are varied, a hunting may occur with the stop of the boom and the forward movement of the arm alternately repeated, during the process of the interference avoidance control effected in the above work examples (b) and (c) according to the present invention. In other words, if the load upon the front device is changed and the flow rates of the hydraulic fluid supplied to the boom cylinder and the arm cylinder are out of balance therebetween, there may occur a hunting.

Taking into account the above, this variation is designed to detect a boom-up load pressure Pa by the pressure sensor 18, and modify the control gain K in the control gain calculating portion 7*h*A such that the change rate (gradient of the function) of the control gain K with respect to the distance r is gradually increased at a higher boom-up load pressure Pa. With this arrangement, in the work (b) where the boom 1*a* is operated upward, as the boom-up load pressure Pa rises, the control gain K is raised up by the calculating portion 7*h*A to a smaller value with respect to the distance r and the change rate of the operating speed of the arm 1*b* in the forward direction is reduced. By so modifying the change rate of the operating speed of the arm 1*b* in the forward direction, it is possible to retire the arm 1*b* forward at an optimum speed depending on change in the load upon the front device 1A and to prevent a hunting.

In the work (c), a hunting is also prevented in a similar manner.

As described above, with this variation, the same interference avoidance control as in the first embodiment can be achieved and, in addition, even if the load upon the front device is changed, a hunting is prevented from occurring during the process of the interference avoidance control.

Variation 2 of Sixth Embodiment

Another variation of the sixth embodiment of the present invention will be described with reference to FIGS. 29 to 32. In this variation, a fluid temperature in the hydraulic circuit is detected as a status variable affecting the operating characteristics of the front device 1A. In FIGS. 29 to 32, equivalent members and functions to those in FIGS. 1, 4 and 24 are denoted by the same reference numerals.

Figure 29:
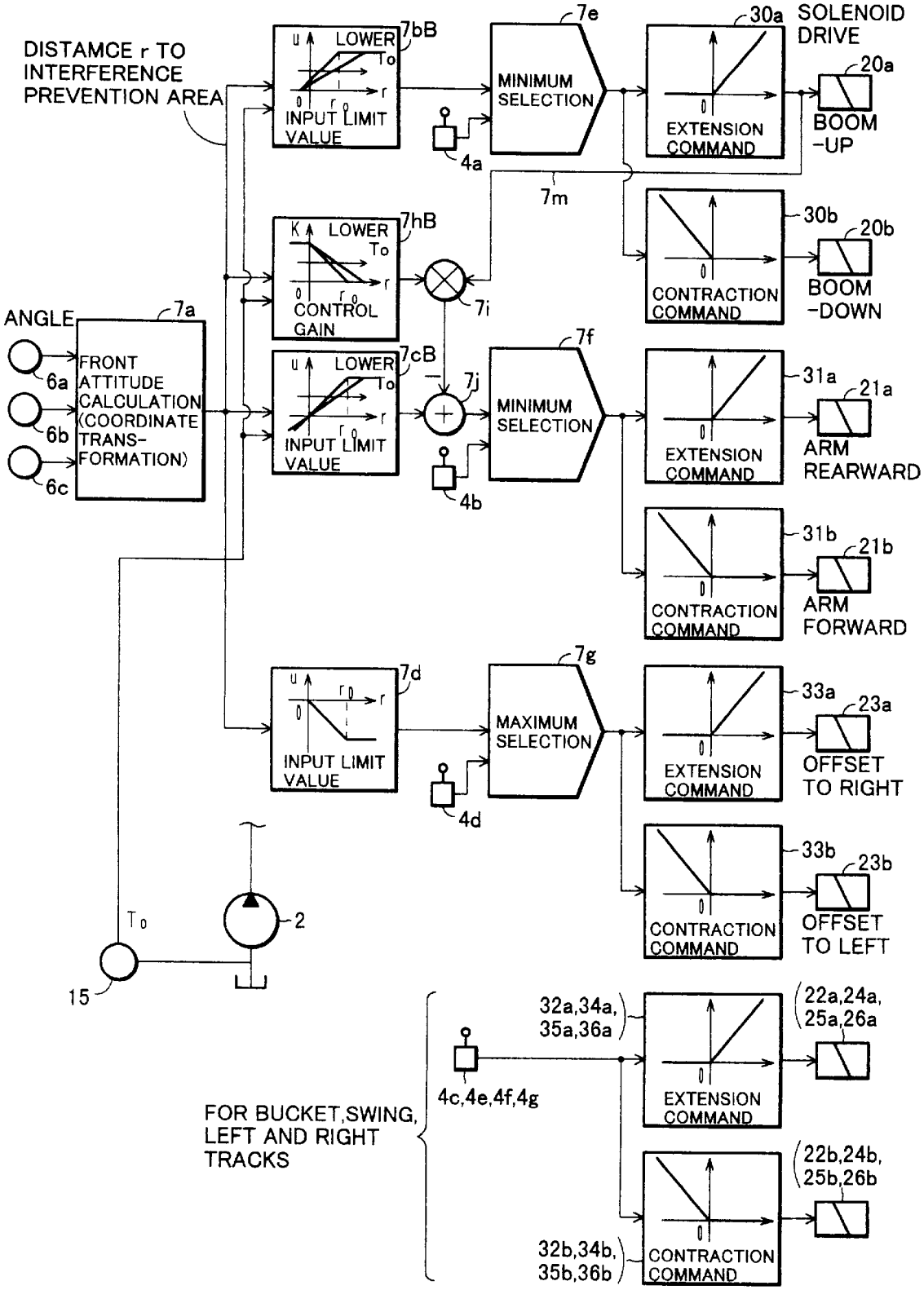
FIG. 29 is a functional block diagram showing control functions of a control unit in an interference preventing system for a hydraulic excavator according to another variation of the sixth embodiment of the present invention.

Referring to FIG. 29, a fluid temperature sensor 15 for detecting a fluid temperature in the hydraulic circuit is disposed and a signal from the fluid temperature sensor 15 is input to a control gain calculating portion 7*h*B and input limit value calculating portions 7*b*B, 7*c*B in the control unit 7 (see FIG. 1).

The control gain calculating portion 7*h*B calculates a control gain K based on the distance r to the interference prevention area and the preset calculation formula as with the sixth embodiment, and further modifies the control gain K such that its change rate is gradually reduced at a lower fluid temperature To input thereto.

Also, the input limit value calculating portions 7*b*B, 7*c*B each calculate a limit value u based on the distance r to the interference prevention area and the preset calculation formula as with the sixth embodiment, and further modifies the limit value u such that it becomes smaller at a lower fluid temperature To input thereto.

Figure 30:
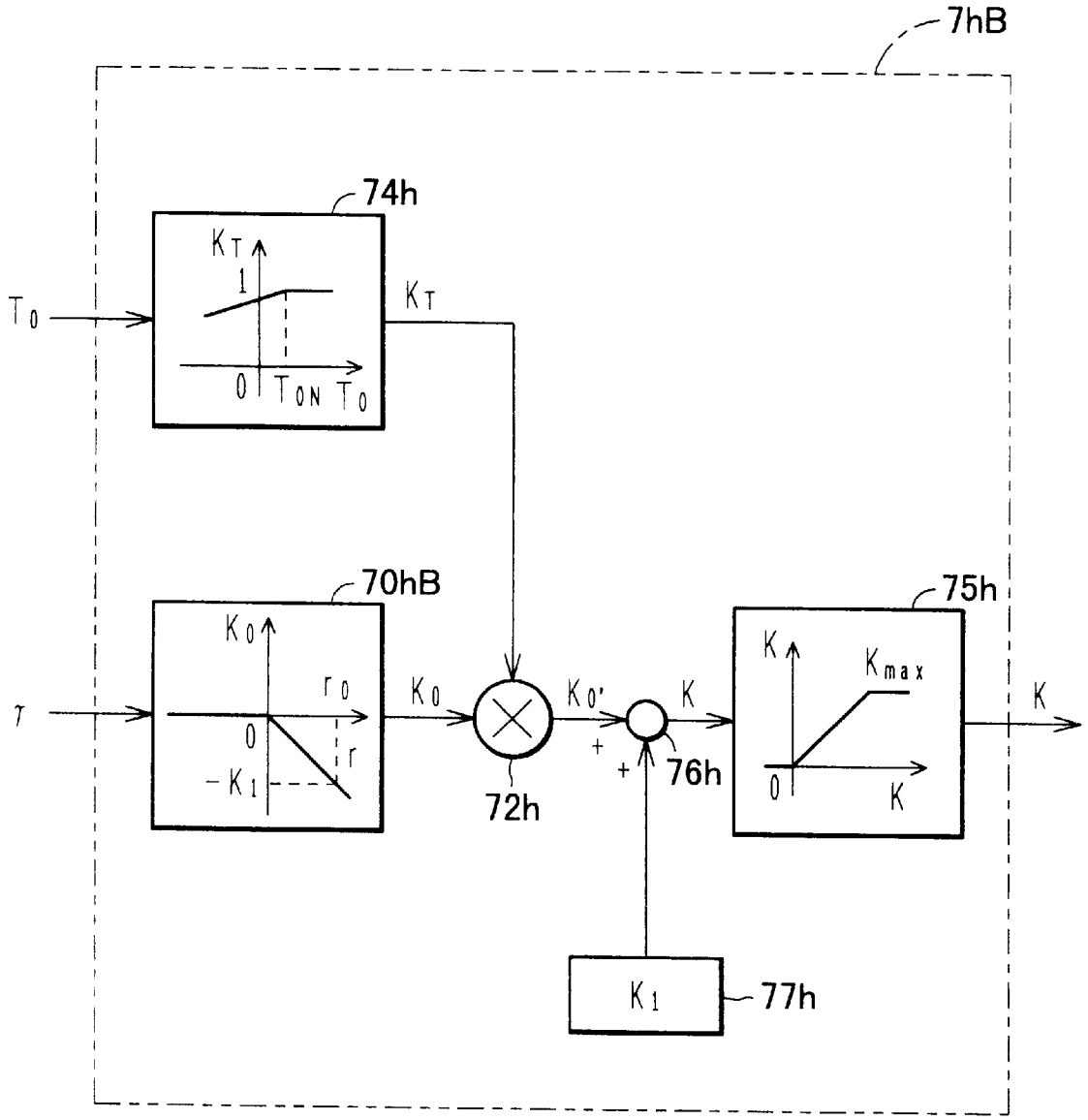
FIG. 30 is a functional block diagram showing details of a control gain calculating portion.

Details of the control gain calculating portion 7*h*B are shown in FIG. 30. The control gain calculating portion 7*h*B has functions executed by a function generator 70*h*B, a function generator 74*h*, a multiplier 72*h*, an upper limiter 75*h*, an adder 76*h* and a constant generator 77*h*. The function generator 70*h* calculates, as with the sixth embodiment, a basic control gain Ko based on the distance r from the tip end of the front device to the interference prevention area. In order that a maximum value (K1=KMAX) of the control gain K calculated by the control gain calculating portion 7*h*B will not change depending on the fluid temperature To, a function used here is obtained by shifting the control gain Ko downward by an extent of K1. The function generator 74*h* calculates a modification coefficient KT depending on the fluid temperature To. Here, the relationship between the fluid temperature To and the modification coefficient KT is set such that when the fluid temperature To is high, the modification coefficient KT is one (1), and as the fluid temperature To lowers from a predetermined temperature TON at which the fluid temperature begins to produce an effect upon the operation, the modification coefficient KT is gradually reduced from one (1). The multiplier 72*h* multiplies the basic control gain Ko calculated by the function generator 70*h*B by the modification coefficient KT calculated by the function generator 74*h*, thereby obtaining a control gain Ko'. Thereafter, the adder 76*h* receives, from the constant generator 77*h*, a value corresponding to K1 by which the control gain has been shifted in the function generator 70*h*B, and then adds that value to Ko' to determine a control gain K. Further, the control gain K is limited by the upper limiter 75*h* such that its upper limit is held at a fixed value.

Thus, in the control gain calculating portion 7*h*B, the control gain K is modified such that as the fluid temperature To lowers, the change rate (gradient of the function) of the control gain K with respect to the distance r is reduced and the distance at which the control gain is started to increase (i.e., the control start distance r0) is increased.

Figure 31:
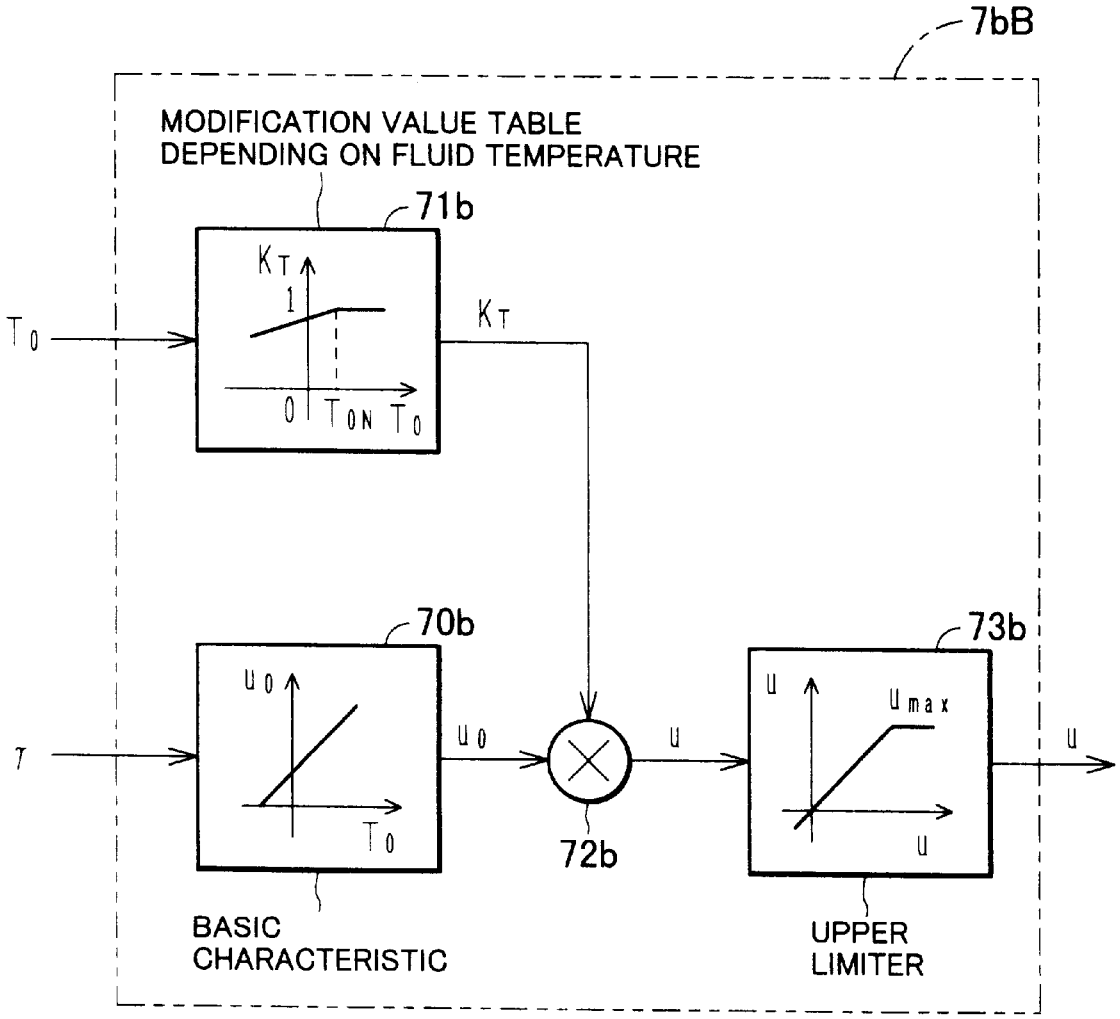
FIG. 31 is a functional block diagram showing details of a limit value calculating portion.

Details of the input limit value calculating portion 7*b*B are shown in FIG. 31. The input limit value calculating portion 7*b*B has functions executed by a function generator 70*b*, a function generator 71*b*, a multiplier 72*b* and an upper limiter 73*b*. The function generator 70*b* calculates, as with the sixth embodiment, a basic limit value u0 depending on the distance r from the tip end of the front device to the interference prevention area. The function generator 71*b* calculates a modification coefficient KT depending on the fluid temperature To. Here, the relationship between the fluid temperature To and the modification coefficient KT is set, as with the foregoing function generator 74*h*, such that when the fluid temperature To is high, the modification coefficient KT is one (1), and as the fluid temperature To lowers from the predetermined temperature TON, the modification coefficient KT is gradually reduced from one (1). The multiplier 72*b* multiplies the basic limit value u0 calculated by the function generator 70*b* by the modification coefficient KT calculated by the function generator 71*b*, thereby obtaining a limit value u. The limit value u is then limited by the upper limiter 73*b* such that its upper limit is held at a fixed value. Thus, in the input limit value calculating portion 7*b*B, the limit value u is modified such that as the fluid temperature To lowers, the change rate (gradient of the function) of the limit value u with respect to the distance r is reduced and the distance at which the limit value is started to reduce (i.e., the control start distance r0) is increased to the same value as the distance at which the control gain is started to increase.

Figure 32:
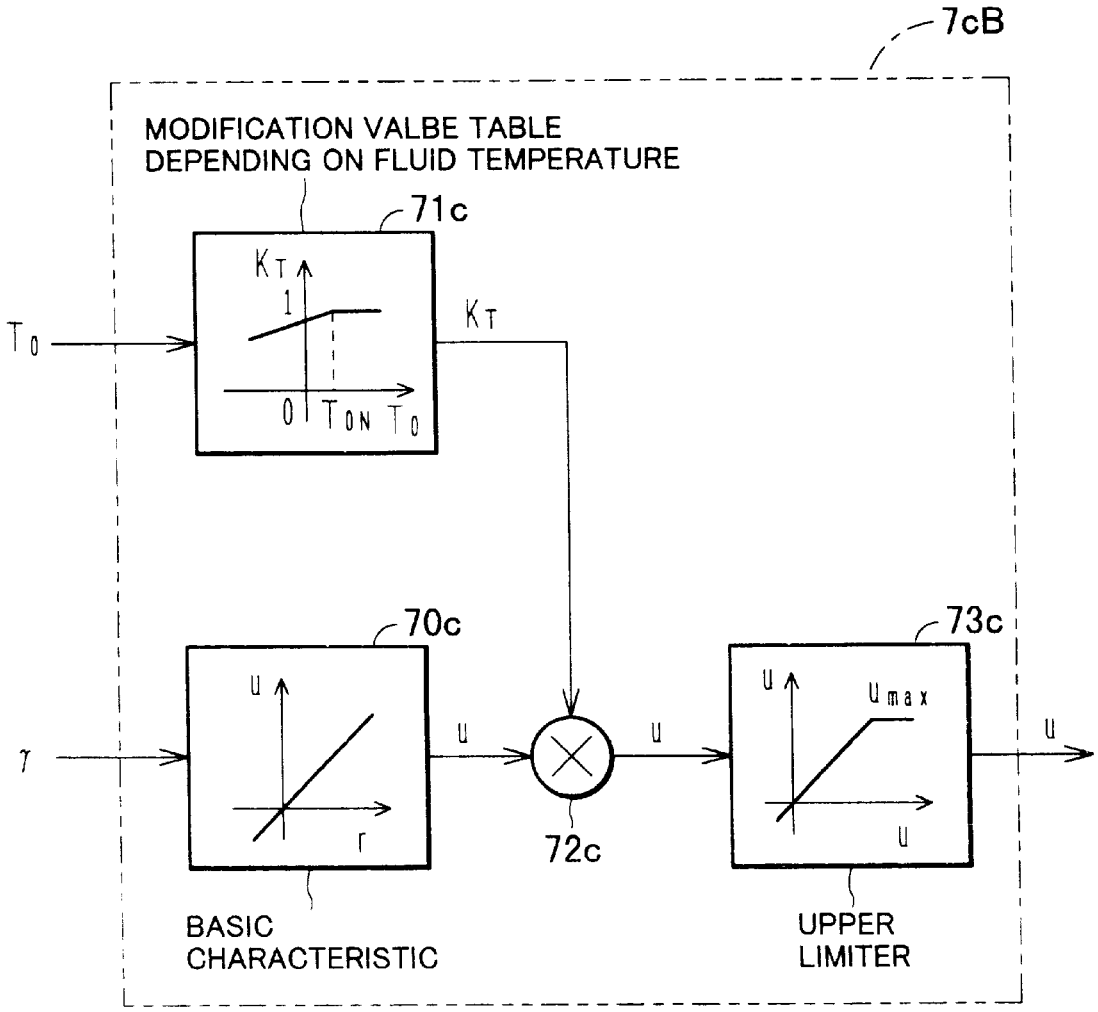
FIG. 32 is a functional block diagram showing details of a limit value calculating portion.

Details of the input limit value calculating portion 7*c*B are shown in FIG. 32. The input limit value calculating portion 7*c*B has functions executed by a function generator 70*c*, a function generator 71*c*, a multiplier 72*c* and an upper limiter 73*c*. The function generator 70*c* calculates, as with the sixth embodiment, a basic limit value u0 depending on the distance r from the tip end of the front device to the interference prevention area. The function generator 71*c*, the multiplier 72*c* and the upper limiter 73*c* are the same as those in the above input limit value calculating portion 7*b*B. Thus, also in the input limit value calculating portion 7*c*B, the limit value u is modified such that as fluid temperature To lowers, the change rate (gradient of the function) of the limit value u with respect to the distance r is reduced and the distance at which the limit value is started to reduce (i.e., the control start distance r0) is increased to the same value as the distance at which the control gain is started to increase.

A hydraulic drive system for use in hydraulic construction machinery such as a hydraulic excavator has characteristics variable depending on change in the fluid temperature. A lower fluid temperature increases viscosity of the hydraulic fluid and delays a response of hydraulic equipment, resulting in a poor response of the entire control system.

In the interference avoidance control effected in the above work examples (b) and (c) according to the present invention, if the fluid temperature lowers, a response of the hydraulic equipment is delayed to cause a time lag when the arm 1*b* should be moved forward at the same time the boom 1*a* is slowed down depending on the distance r as the tip end of the front device comes close to the interference prevention area.

More specifically, in the work (b) where the boom 1*a* is operated upward, although a speed reduction command for the boom 1*a* is output in accordance with the distance r from the tip end of the front device 1A to the interference prevention area, there occurs a delay until the hydraulic equipment actually responses and slows down the boom 1*a*, and although a command is output to the arm 1*b* to move it forward (in the dumping direction) in accordance with the distance r, there occurs a delay until the hydraulic equipment actually responses and moves the arm 1*b* forward. Therefore, the tip end of the front device 1A may enter the interference prevention area. If the tip end of the front device 1A enters the interference prevention area, a command to stop the boom 1*a* is issued from the calculating portion 7*b*B and, simultaneously, a command to move the arm 1*b* forward is calculated as a relatively large value by the calculating portion 7*c*B. Accordingly, the arm 1*b* responds to that command and is forced to move forward at a relatively high speed. When the tip end of the front device 1*a* is thus returned to the outside of the interference prevention area, it now goes ahead excessively due to a response delay in the speed reduction of the boom 1*a* and the start-up of the arm 1*b*. This gives the boom 1*a* a relatively high return speed and causes it to enter the interference prevention area again. With the above process repeated, there may occur a hunting.

In the work (c) where the arm 1*b* is operated toward the operator while the boom 1*a* is operated upward, a hunting may also occur similarly to the above case (b).

Taking into account the above, this variation is designed to detect a fluid temperature by the fluid temperature sensor 15, and modify the control gain K and the limit values u as described above. With this arrangement, in the work (b) where the boom 1*a* is operated upward, when the fluid temperature lowers from the predetermined temperature, the limit values u calculated by the calculating portions 7*b*B, 7*c*B are made smaller to output the speed reduction commands for the boom 1*a* and the arm 1*b* at an earlier time with respect to the distance r. Simultaneously, the control gain K calculated by the calculating portion 7*h*B is raised up to output the command for moving the arm 1*b* forward (in the dumping direction) at an earlier time with respect to the distance r. Thus, since the speed reduction commands for the boom and the arm and the command for moving the arm forward are output at the larger distance r, the occurrence of a hunting can be prevented.

In the work (c), a hunting is also prevented in a similar manner.

As described above, with this variation, the same interference avoidance control and the speed reduction and stop control as in the first embodiment can be achieved. In addition, even if the fluid temperature in the hydraulic fluid is low, a hunting can be prevented from occurring during the process of the interference avoidance control.

Variation 3 of Sixth Embodiment

Figure 33:
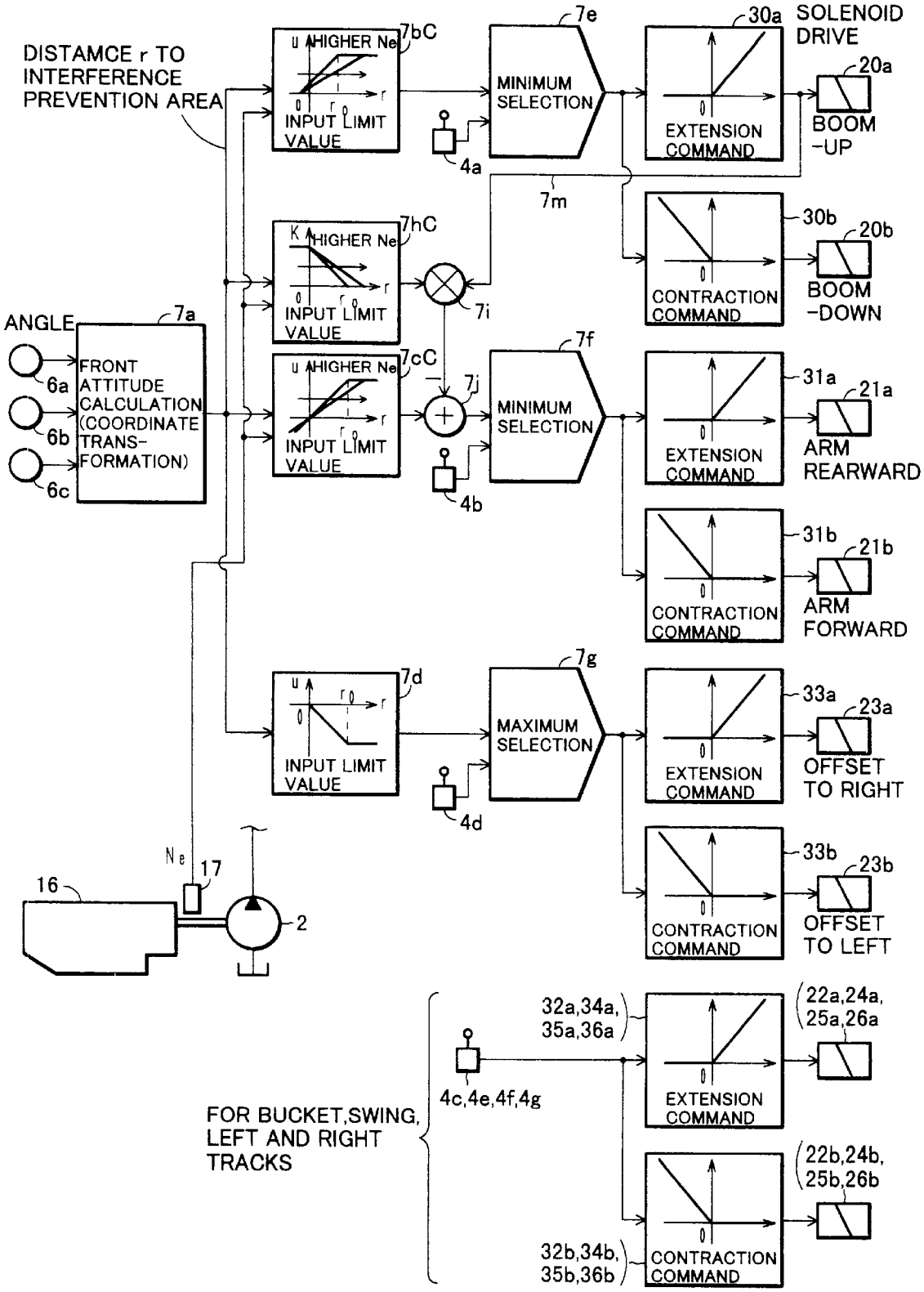
FIG. 33 is a functional block diagram showing control functions of a control unit in an interference preventing system for a hydraulic excavator according to still another variation of the sixth embodiment of the present invention.

Still another variation of the sixth embodiment of the present invention will be described with reference to FIG. 33. In this variation, a revolution speed of a prime mover for driving the hydraulic pump is detected as a status variable affecting the operating characteristics of the front device 1A. In FIG. 33, equivalent members and functions to those in FIGS. 1, 4 and 24 are denoted by the same reference numerals.

Referring to FIG. 33, the hydraulic pump 2 is connected to and driven by an engine 16 for rotation. The engine 16 is provided with a revolution speed sensor 17 for detecting a revolution speed of the engine 16, and a signal from the revolution speed sensor 17 is input to a control gain calculating portion 7*h*C and input limit value calculating portions 7*b*C, 7*c*C in the control unit 7 (see FIG. 1).

The control gain calculating portion 7*h*C calculates a control gain K based on the distance r to the interference prevention area and the preset calculation formula as with the sixth embodiment, and further modifies the control gain K such that its change rate is gradually reduced at a higher engine revolution speed Ne input thereto.

Also, the input limit value calculating portions 7*b*C, 7*c*C each calculate a limit value u based on the distance r to the interference prevention area and the preset calculation formula as with the sixth embodiment, and further modifies the limit value u such that it becomes smaller at a higher engine revolution speed Ne input thereto.

Details of a process of modifying the control gain depending on the engine revolution speed in the control gain calculating portion 7*h*C and details of processes of modifying the limit values depending on the engine revolution speed in the input limit value calculating portions 7*b*C, 7*c*C are essentially the same as those of modifying the control gain and the limit values depending on the fluid temperature in the variation 2 of the sixth embodiment. Accordingly, in the control gain calculating portion 7*h*C, the control gain K is modified such that as engine revolution speed Ne rises, the change rate (gradient of the function) of the control gain K with respect to the distance r is reduced and the distance at which the control gain is started to increase (i.e., the control start distance r0) is increased. Also, in the input limit value calculating portions 7*b*C, 7*c*C, the limit values u are each modified such that at the engine revolution speed Ne rises, the change rate (gradient of the function) of the limit value u with respect to the distance r is reduced and the distance at which the limit value is started to reduce (i.e., the control start distance r0) is increased to the same value as the distance at which the control gain is started to increase.

A hydraulic drive system for use in hydraulic construction machinery such as a hydraulic excavator has characteristics variable depending on change in the revolution speed of the engine 16. Specifically, change in the revolution speed of the engine 16 varies a maximum delivery rate of the hydraulic pump 2 and hence a maximum flow rate of the hydraulic fluid usable. In particular, when the engine revolution speed becomes high, a flow rate of the hydraulic fluid is increased and an operating speed of the front device is raised in its entirety.

In the interference avoidance control effected in the above work examples (b) and (c) according to the present invention, a command for slowing down the boom 1*a* (i.e., an opening command for the flow control valve 5*a*) and a command for operating the arm 1*b* forward (i.e., an opening command for the flow control valve 5*b*) are output in accordance with the distance r from the tip end of the front device to the interference prevention area. Here, supposing that a speed reduction rate of the boom 1*a* calculated by the calculating portion 7*b*C with respect to the distance r (i.e., a reduction rate of the opening command for the flow control valve 5*a*) and an increase rate of the operating speed of the arm 1*b* in the forward direction, which is calculated by cooperation of the calculating portion 7*h*C, the multiplier 7*i* and the adder 7*j*, with respect to the distance r (i.e., an increase rate of the opening command for the flow control valve 5*b*) remain fixed regardless of an increase in the revolution speed of the engine 16, an actual reduction rate of the boom speed and an actual increase rate of the arm speed would be increased during the process of the interference avoidance control because the operating speed of the front device is raised in its entirety as the revolution speed of the engine 16 increases. In other words, a speed reduction rate (gain) of the boom and a speed increase rate (gain) of the arm with respect to the distance r would be increased. If the gain becomes large in such a way, a speed change in the control process would be so large and instable that the front device may cause a hunting in its entirety.

Taking into account the above, this variation is designed to detect a revolution speed of the engine 16 by the revolution speed sensor 17, and modify the control gain K and the limit values u as described above. With this arrangement, in the work (b) where the boom 1*a* is operated upward, when the engine revolution speed Ne exceeds the predetermined speed, the limit values u calculated by the calculating portions 7*b*C, 7*c*C are made smaller at an earlier time with respect to the distance r to reduce the speed reduction rate of the boom 1*a* (i.e., the reduction rate of the opening command for the flow control valve 5*a*) with respect to the distance r. Simultaneously, the control gain K calculated by the calculating portion 7*h*C is raised up at an earlier time with respect to the distance r to reduce the speed increase rate of the arm 1*b* (i.e., the increase rate of the opening command for the flow control valve 5*b*) with respect to the distance r. Thus, the modification is performed so as to keep the reduction and increase rates in speed of the boom and the arm unchanged. As a result, the control is stabilized and the occurrence of a hunting can be prevented.

In the work (c), a hunting is also prevented in a similar manner.

As described above, with this variation, the same interference avoidance control as in the first embodiment can be achieved and, in addition, even if the revolution speed of the engine for driving the hydraulic pump is changed, a hunting can be prevented from occurring during the process of the interference avoidance control.

Remarks

It should be noted that the interference preventing system of the present invention is not limited to the above-described embodiments including their variations, but can be practiced in other various forms.

For example, in the fifth and sixth embodiments, the present invention is applied to a hydraulic drive system using control lever units of electric lever type. But, the concepts of the fifth and sixth embodiments may also be applied to a hydraulic drive system using control lever units of hydraulic pilot type as described in connection with the second embodiment.

While, in the foregoing embodiments, the operation signal applied to the flow control valve for the boom is detected for detecting the boom operation, the boom moving speed may be calculated from an angular speed which is obtained by differentiating a detected value of the angle sensor for detecting the rotational angle of the boom. Also, while the angle sensors for detecting the rotational angles are employed as means for detecting the status variables relating to the position and attitude of the front device 1A, cylinder strokes may be detected instead.

In the foregoing embodiments, the interference avoidance control is performed in combination with the speed reduction control. However, the speed reduction control for the boom is not always necessary and the present invention may be practiced in the form not combined with the speed reduction control, Further, while the present invention is practiced in the foregoing embodiments on an assumption that the first front member is a boom and the second front member is an arm, the first and second front members may be other parts. For example, the present invention may be applied to the interference avoidance control performed in the case where the first front member is an offset, the second front member is an arm, and a side face of the front device is moved toward the interference prevention area laterally of the cab.

Additionally, in the foregoing embodiments, the present invention is applied to a hydraulic excavator of offset type that a front device has an offset. The present invention is however likewise applicable to any construction machine in which a front device may possibly interfere with a vehicle body, such as a hydraulic excavator of swing type that a front device is swung, or a hydraulic excavator that a front device has a two-piece boom.

What is claimed is:

1. An interference preventing system for a construction machine comprising a vehicle body, a front device mounted on said vehicle body and made up of a plurality of front members including first and second front members pivotable in the vertical direction, a plurality of hydraulic actuators for driving said plurality of front members, a plurality of operating means for instructing operations of said plurality of front members, and a plurality of flow control valves for controlling flow rates of a hydraulic fluid supplied to the associated hydraulic actuators in accordance with respective operation signals input from said plurality of operating means, said interference preventing system regulating motion of said front device when said front device come close to said vehicle body, wherein said interference preventing system comprises:

(a) first detecting means for detecting status variables in relation to a position and attitude of said front device, (b) calculating means for calculating the position and attitude of said front device based on detected values of said first detecting means, (c) second detecting means for detecting the operation of said first front member in accordance with the operation signal from said operating means, and (d) first control means for controlling, based on a calculated value of said calculating means and a detected value of said second detecting means, said second front member to move in the interference avoiding direction relative to said vehicle body while continuing to operate said first front member in accordance with said operation signal, when a predetermined portion of said front device comes close to said vehicle body while said first front member is being moved in accordance with said operation signal.

2. An interference preventing system for a construction machine according to claim 1, wherein said first control means controls said second front member to move in the forward direction relative to said vehicle body as said interference avoiding direction relative to said vehicle body.

3. An interference preventing system for a construction machine according to claim 1, wherein said first control means calculates, based on a detected value of said second detecting means, a target speed of said second front member in the interference avoiding direction corresponding to an operating speed of said first front member, and controls said second front member to move at the calculated target speed.

4. An interference preventing system for a construction machine according to claim 3, wherein said first control means calculates a higher target speed of said second front member in the interference avoiding direction as the operating speed of said first front member increases.

5. An interference preventing system for a construction machine according to claim 3, wherein said first control means calculates a higher target speed of said second front member in the interference avoiding direction as the predetermined portion of said front device comes closer to said vehicle body.

6. An interference preventing system for a construction machine according to claim 3, wherein said first control means calculates a larger control gain as the predetermined portion of said front device comes closer to said vehicle body, and multiplies the detected value of said second detecting means by the calculated control gain, thereby producing the target speed of said second front member in the interference avoiding direction.

7. An interference preventing system for a construction machine according to claim 3, wherein said first control means calculates, based on the calculated value of said calculating means and the detected value of said second detecting means, a component of the speed at the predetermined portion of said front device in the direction toward said vehicle body when said first front member is being moved in accordance with said operation signal, calculates a larger control gain as the predetermined portion of said front device comes closer to said vehicle body, and multiplies the calculated speed component by the calculated control gain, thereby producing the target speed of said second front member in the interference avoiding direction.

8. An interference preventing system for a construction machine according to claim 1, wherein said second detecting means is means for detecting the operation signal applied to said flow control valve associated with said first front member.

9. An interference preventing system for a construction machine according to claim 1, wherein:

said calculating means includes means for calculating, based on the detected values of said first detecting means, a distance from the predetermined portion of said front device to an area preset around said vehicle body, and said first control means starts s aid control at the time said calculated distance becomes not larger than a preset distance.

10. An interference preventing system for a construction machine according to claim 1, wherein:

said calculating means includes means for calculating, based on the detected values of said first detecting means, a distance from the predetermined portion of said front device to an area preset around said vehicle body, and said first control means modifies the operation signal from said operating means for said first front member such that when said calculated distance is not larger than a preset first control start distance, said first front member is further slowed down as said calculated distance reduces, and then starts said control at the time said calculated distance becomes not larger than a second control start distance that is equal to or smaller than said first control start distance.

11. An interference preventing system for a construction machine according to claim 1, wherein:

said calculating means includes means for calculating, based on the detected values of said first detecting means, a distance from the predetermined portion of said front device to an area preset around said vehicle body, and said first control means includes;

(d1) means for calculating a first limit value of the operation signal from said operating means for said first front member such that when said calculated distance is larger than a preset control start distance, said first limit value is kept at a maximum value, when said calculated distance is not larger than said control start distance, said first limit value is reduced as said calculated distance reduces, and when said calculated distance is less than a certain negative value, said first limit value becomes nil (0), (d2) means for modifying the operation signal from said operating means for said first front member so that the operation signal will not exceed said first limit value, (d3) means for calculating a second limit value of the operation signal from said operating means for said second front member such that when said calculated distance is larger than said control start distance, said second limit value is kept at a maximum value, when said calculated distance is not larger than said control start distance, said second limit value is reduced as said calculated distance reduces and then becomes nil (0) at said calculated distance being nil (0), and when-said calculated distance is negative, said second limit value is further reduced and takes a negative value depending on the value of said calculated distance, (d4) means for calculating a control gain in relation to the detected value of said second detecting means such that when said calculated distance is larger than said control start distance, said control gain is kept at nil (0), when said calculated distance is not larger than said control start distance, said control gain is increased as said calculated distance reduces, and when said calculated distance is nil (0) or less, said control gain takes a maximum value, (d5) means for multiplying the detected value of said second detecting means by said control gain to produce a target speed for moving said second front member in the interference avoiding direction, and (d6) means for subtracting said target speed in the interference avoiding direction from said second limit value and modifying the operation signal from said operating means for said second front member such that the operation signal will not exceed a resulted difference value.

12. An interference preventing system for a construction machine according to claim 1, further comprising:

(e) setting means for setting, in the ambient around said construction machine, an operable area in which said front device is allowed to move, and (f) second control means for controlling, in accordance with the calculated value of said calculating means, said first front member to stop when said front device reaches a boundary of said operable area.

13. An interference preventing system for a construction machine according to claim 12, wherein said second control means modifies the operation signal from said operating means for said first front member such that said first front member is slowed down as said front device comes closer to the boundary of said operable area.

14. An interference preventing system for a construction machine according to claim 13, wherein:

said calculating means includes means for calculating, based on the detected values of said first detecting means, a first distance from the predetermined portion of said front device to an area preset around said vehicle body, and means for calculating, based on the detected values of said first detecting means, a second distance from the predetermined portion of said front device to a boundary of the area preset by said setting means, said first control means calculates a first limit value that is reduced as said first distance reduces, said second control means calculates a second limit value that is reduced as said second distance reduces and is nil (0) when said second distance becomes nil (0), said second control means modifies the operation signal from said operating means for said first front member such that the operation signal will not exceed said second limit value, and said first control means modifies the operation signal from said operating means for said first front member such that the operation signal will not exceed both said first and second limit values.

15. An interference preventing system for a construction machine according to claim 1, wherein:

said calculating means includes means for calculating, based on the detected values of said first detecting means, a distance from the predetermined portion of said front device to an area preset around said vehicle body, said first control means starts said control at the time said calculated distance becomes not larger than a preset distance, and said interference preventing system further comprises;

(g) third detecting means for detecting a factor affecting operating characteristics of said front device under control of said first control means, and (h) distance modifying means for modifying, based on a detected value of said third detecting means, said calculated distance such that said front device will not enter said preset area even when the operating characteristics of said front device is changed depending on said factor.

16. An interference preventing system for a construction machine according to claim 15, wherein said distance modifying means includes means for determining a modification value of said control start distance based on the detected value of said third detecting means, and means for subtracting said modification value from said calculated distance.

17. An interference preventing system for a construction machine according to claim 15, wherein said factor is a fluid temperature of the hydraulic fluid, and said distance modifying means modifies said calculated distance such that said control start distance is increased as the fluid temperature lowers.

18. An interference preventing system for a construction machine according to claim 15, wherein said factor is a revolution speed of a prime mover for driving an hydraulic pump, and said distance modifying means modifies said calculated distance such that said control start distance is increased as the revolution speed rises.

19. An interference preventing system for a construction machine according to claim 15, wherein said factor is a load pressure of the hydraulic actuator for said first front member, and said distance modifying means modifies said calculated distance such that said control start distance is increased as the load pressure rises.

20. An interference preventing system for a construction machine according to claim 1, further comprising:

(i) fourth detecting means for detecting a factor affecting operating characteristics of said front device under control of said first control means, and (j) gain modifying means for modifying, based on a detected value of said fourth detecting means, a control gain of said first control means such that the operating characteristics of said front device will not change to a large extent regardless of change in said factor.

21. An interference preventing system for a construction machine according to claim 20, wherein said factor is a rotational angle of said first front member, and said gain modifying means modifies said control gain such that said control gain is increased as the rotational angle of said first front member increases.

22. An interference preventing system for a construction machine according to claim 20, wherein said factor is a load pressure of the hydraulic actuator for said first front member, and said gain modifying means modifies said control gain such that said control gain is reduced as the load pressure rises.

23. An interference preventing system for a construction machine according to claim 20, wherein said factor is a fluid temperature of the hydraulic fluid, and said gain modifying means modifies said control gain such that said control gain is reduced as the fluid temperature lowers.

24. An interference preventing system for a construction machine according to claim 20, wherein said factor is a revolution speed of a prime mover for driving an hydraulic pump, and said gain modifying means modifies said control gain such that said control gain is reduced as the revolution speed rises.

25. An interference preventing system for a construction machine according to claim 20, wherein:

said calculating means includes means for calculating, based on the detected values of said first detecting means, a distance from the predetermined portion of said front device to an area preset around said vehicle body, and said first control means include;

(d1) means for calculating said control gain as a value that is kept at nil (0) when said calculated distance is larger than a preset control start distance, is gradually increased as said calculated distance reduces when said calculated distance is not larger than said control start distance, and is kept at a maximum value when said calculated distance is nil (0) or less, and (d2) means for multiplying the detected value of said second detecting means by said control gain to produce a target speed for moving said second front member in the interference avoiding direction, said gain modifying means modifying a change rate of said control gain with respect to said calculated distance.

26. An interference preventing system for a construction machine according to claim 25, wherein said gain modifying means modifies the change rate of said control gain with respect to said calculated distance by changing a maximum value of said control gain depending on said factor.

27. An interference preventing system for a construction machine according to claim 25, wherein said gain modifying means modifies the change rate of said control gain with respect to said calculated distance by changing an increase start distance for said control gain depending on said factor.

28. An interference preventing system for a construction machine according to claim 1, wherein said plurality of operating means are of electric lever type outputting electric signals as said operation signals, and said first control means calculates a command signal based on the operation signal from said operating means for said first front member, outputs the command signal to said flow control valve associated with said first front member, calculates a target speed of said second front member in the interference avoiding direction, calculates a command signal based on the target speed of said second front member in the interference avoiding direction and the operation signal from said operating means for said second front member, and outputs the command signal to said flow control valve associated with said second front member.

29. An interference preventing system for a construction machine according to claim 1, wherein said plurality of operating means are of hydraulic pilot type outputting pilot pressures as said operation signals, and said first control means includes means for calculating a target speed of said second front member in the interference avoiding direction, a proportional solenoid pressure reducing valve for outputting a pilot pressure corresponding to the target speed of said second front member in the interference avoiding direction, and a shuttle valve disposed in a line for introducing the pilot pressure from said operating means for said second front member to said flow control valve associated with said second front member and selecting higher one of the pilot pressure output from said proportional solenoid pressure reducing valve and the pilot pressure from said operating means for said second front member.

30. An interference preventing system for a construction machine according to claim 1, wherein said first front member is a front member requiring the predetermined portion of said front device to be continuously moved around said vehicle body during work where the predetermined portion of said front device may possibly interfere with said vehicle body, and said second front member is a front member not requiring the predetermined portion of said front device to be continuously moved around said vehicle body during said work.

31. An interference preventing system for a construction machine according to claim 1, wherein said construction machine is an offset type hydraulic excavator including a boom, an offset and an arm as said plurality of front members, said first front member is the boom, said second front member is the arm, the operation of said first front member detected by said second detecting means is operation of moving said boom upward, and the operation of said second front member provided by said first control means in the interference avoidance direction is operation of moving said arm in the dumping direction.

* * * * *